US008410873B2

(12) United States Patent
Kasashima et al.

(10) Patent No.: US 8,410,873 B2
(45) Date of Patent: Apr. 2, 2013

(54) DIELECTRIC RESONATOR HAVING A DIELECTRIC RESONANT ELEMENT WITH TWO OPPOSITELY LOCATED NOTCHES FOR EH MODE COUPLING

(75) Inventors: Takashi Kasashima, Ichinomiya (JP); Noriyasu Sugimoto, Kohnan (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 344 days.

(21) Appl. No.: 12/679,188

(22) PCT Filed: Sep. 19, 2008

(86) PCT No.: PCT/JP2008/067041

§ 371 (c)(1),
(2), (4) Date: Mar. 19, 2010

(87) PCT Pub. No.: WO2009/038200

PCT Pub. Date: Mar. 26, 2009

(65) Prior Publication Data

US 2010/0244992 A1 Sep. 30, 2010

(30) Foreign Application Priority Data

| | | |
|---|---|---|
| Sep. 19, 2007 | (JP) | 2007-242092 |
| Sep. 19, 2007 | (JP) | 2007-242093 |
| Sep. 19, 2007 | (JP) | 2007-242094 |
| Oct. 11, 2007 | (JP) | 2007-265382 |
| Sep. 4, 2008 | (JP) | 2008-227550 |
| Sep. 4, 2008 | (JP) | 2008-227551 |
| Sep. 4, 2008 | (JP) | 2008-227552 |
| Sep. 4, 2008 | (JP) | 2008-227644 |

(51) Int. Cl.
*H01P 7/10* (2006.01)

(52) U.S. Cl. ..... 333/219.1; 333/202

(58) Field of Classification Search ..... 333/202, 333/219.1
See application file for complete search history.

(56) References Cited

U.S. PATENT DOCUMENTS

| | | | |
|---|---|---|---|
| 4,489,293 | A | 12/1984 | Fiedziuszko et al. |
| 4,642,591 | A | 2/1987 | Kobayashi |
| 4,760,361 | A | 7/1988 | Kobayashi |

(Continued)

FOREIGN PATENT DOCUMENTS

| | | | |
|---|---|---|---|
| GB | 2367952 | | 4/2002 |
| JP | 61121502 | A | 6/1986 |

(Continued)

OTHER PUBLICATIONS

Written Opinion of the International Searching Authority for PCT/JP2008/067041, Nov. 2008.

Bila et al., "Direct electromagnetic optimization method for microwave filter design," Electronic Letters, 1999, vol. 35, No. 5, pp. 400-401.

(Continued)

*Primary Examiner* — Benny Lee

(74) *Attorney, Agent, or Firm* — Stites & Harbison PLLC; Jeffrey A. Haeberlin

(57) ABSTRACT

Disclosed are a dielectric resonator having simple configuration applicable to a multiple mode with no electrical signal transmission loss, and a method of controlling a resonance state (coupling mode) in the dielectric resonator. The dielectric resonator includes a cylindrical or polygonal external conductor, and a dielectric resonant element arranged at the substantially center of the external conductor. A notched portion is formed at a part of the dielectric resonant element so as to control the resonance state of the dielectric resonator.

4 Claims, 79 Drawing Sheets

U.S. PATENT DOCUMENTS

| | | | | |
|---|---|---|---|---|
| 5,880,650 | A * | 3/1999 | Latouche et al. | 333/202 |
| 6,573,812 | B1 * | 6/2003 | Wakamatsu et al. | 333/219.1 |
| 6,762,658 | B1 * | 7/2004 | Isomura et al. | 333/202 |
| 6,801,105 | B2 * | 10/2004 | Karhu | 333/202 |
| 2003/0076200 | A1 | 4/2003 | Fiedziuszko et al. | |
| 2003/0197579 | A1 * | 10/2003 | Kegasa et al. | 333/202 |
| 2006/0097825 | A1 * | 5/2006 | Kurisu et al. | 333/219.1 |

FOREIGN PATENT DOCUMENTS

| | | | |
|---|---|---|---|
| JP | 2016801 | | 1/1990 |
| JP | 5-110337 | A | 4/1993 |
| JP | 8-18304 | A | 1/1996 |
| JP | 2002-33605 | | 1/2002 |
| JP | 2003/174302 | | 6/2003 |
| JP | 2005065040 | A | 3/2005 |

OTHER PUBLICATIONS

JPO, Office Action issued in related application JP 2008-227552, dispatched Aug. 9, 2011.

JPO, Office Action issued in related application JP 2008-227644, dispatched Aug. 9, 2011.

International Search Report for PCT/JP2008/067041.

D.Baillargeat, et.al., "Slotted Dielectric Resonators for Rigorous Design of a Four-Poles Dual Mode Filter", IEEE Microwave and Guided Wave Letters, 1994, vol. 4, No. 10, pp. 332-334.

JPO, Office Action issued in corresponding application JP 2008-227550, dispatched Oct. 25, 2011.

* cited by examiner

DIELECTRIC RESONATOR HAVING A DIELECTRIC RESONANT ELEMENT WITH TWO OPPOSITELY LOCATED NOTCHES FOR EH MODE COUPLING

TECHNICAL FIELD

The present invention relates to a dielectric resonator, a dielectric resonator filter, and a method of controlling a dielectric resonator.

BACKGROUND ART

In recent years, an electronic apparatus, such as a personal digital assistant or a communication terminal, impressively achieves high performance and is reduced in size. A personal digital assistant or a communication terminal is embedded with a resonator filter. The reduction in the size of the personal digital assistant or the like increases demands for the reduction in the size of the resonator filter. Accordingly, a dielectric resonator is increasingly used.

As the dielectric resonator, Patent Document 1 describes a multiple-mode dielectric resonator. In this multiple-mode dielectric resonator, a dielectric resonant element is arranged in a cavity resonator, and a metal screw is provided in the cavity resonator toward the dielectric resonant element so as to generate a resonant coupling mode. Thus, this multiple-mode dielectric resonator copes with a plurality of frequencies. In such a dielectric resonator, however, there is a problem in that the metal screw in the resonator causes an increase in the transmission loss of electrical signals for resonance.

In order to solve the above-described problem, Patent Document 2 describes a multiple-mode dielectric resonator in which a columnar opening is formed with respect to a dielectric resonant element so as to perform a resonant coupling mode. Thus, this multiple-mode dielectric resonator copes with a plurality of frequencies. In such a dielectric resonator, however, processing, such as cutting or the like, is needed, which results in an increase in manufacturing costs. Further, a sufficient resonant coupling mode may not be generated. As a result, a practical multiple-mode resonator which copes with a plurality of frequencies may not be realized.

Patent Document 1: Japanese Patent Unexamined Publication No. S57-194603-A

Patent Document 2: Japanese Patent Unexamined Publication No. S62-204601-A

DISCLOSURE OF THE INVENTION

Problem that the Invention is to Solve

It is an object of the invention to provide a dielectric resonator having simple configuration applicable to a multiple mode with no electrical signal transmission loss, a dielectric resonator filter, and a method of controlling a resonance state (coupling mode) in the dielectric resonator.

Means for Solving the Problem

In order to achieve the above-described object, an embodiment of the invention provides a dielectric resonator. The dielectric resonator includes a cylindrical or polygonal external conductor, a dielectric resonant element arranged at the substantially center of the external conductor, the dielectric resonant element having a notched portion for generating an attenuation pole, and an electrical signal input section and an electrical signal output section.

Another embodiment of the invention provides a method of controlling a dielectric resonator including a cylindrical polygonal external conductor and a dielectric resonant element arranged at the substantially center of the external conductor. A notched portion is formed at a part of the dielectric resonant element so as to control the resonance state of the dielectric resonator and to generate an attenuation pole.

According to the embodiment of the invention, in addition to the basic configuration in which a columnar or polygonal dielectric resonant element is provided in an external conductor, a notched portion is formed in the dielectric resonant element to control the resonance state (coupling mode) of the dielectric resonator. Therefore, unlike the related art, a metal screw or the like is not used in order to control the resonance state (coupling mode), so there is no transmission loss of electrical signals for resonance. Further, a complex process, such as processing of the dielectric resonant element or the like, is not used. As a result, a dielectric resonator with a controlled resonance state (coupling mode) can be easily obtained.

The notched portion is provided at a position where the filter characteristic of the dielectric resonator has an attenuation pole. This may be, for example, a location in the dielectric resonator where the degree of coupling to the electrical signal input section and the electrical signal output section is low. Specifically, the electrical signal input section and the electrical signal output section are arranged at about 90 degrees on the side surface of the external conductor, and the notched portion is provided at one or more of the positions at about 45 degrees and about 225 degrees from the electrical signal input section.

With this configuration, it is considered that the change in the resonance state (coupling mode) of the dielectric resonator changes results from the change in inductance and/or coupling capacitance to an electrical signal introduced into the dielectric resonator.

According to an aspect of the invention, the notched portion of the dielectric resonant element is formed so as not to be opposite the electrical signal input section and the electrical signal output section provided in the dielectric resonator. With this configuration, the resonance state (coupling mode) of the dielectric resonator can be more effectively controlled. In this case, it is considered that inter-mode inductance of an electrical signal introduced into the dielectric resonator is hardly changed, and coupling capacitance is mainly changed.

The notched portion may be formed by grinding the dielectric resonant element vertically along a height direction such that the dielectric resonant element has a vertical section in the height direction due to the notched portion. The notched portion may be formed by grinding the dielectric resonant element vertically along a height direction such that the dielectric resonant element has a groove portion having a vertical section in the height direction due to the notched portion. The notched portion may be formed by grinding the dielectric resonant element including the end thereof at an angle of 45 degrees such that the dielectric resonant element has a section at an angle of 45 degrees due to the notched portion.

According to the above-described aspect, the resonance state (coupling mode) of the dielectric resonator can be more effectively controlled.

In order to achieve the above-described object, yet another embodiment of the invention provides a dielectric resonator. The dielectric resonator includes a cylindrical or polygonal external conductor, a dielectric resonant element arranged at the substantially center of the external conductor, and an electrical signal input section and an electrical signal output section. A notched portion is formed at a part of the dielectric resonant element at a position and in size such that a coupling coefficient to a plurality of introduced electrical signals indicates a peak.

Yet another embodiment of the invention provides a method of controlling a dielectric resonator including a cylindrical or polygonal external conductor and a dielectric resonant element arranged at the substantially center of the external conductor. A notched portion is formed at a part of the dielectric resonant element at a position and in size such that a coupling coefficient to a plurality of introduced electrical signals indicates a peak.

According to the embodiments of the invention, in addition to the basic configuration in which a columnar or polygonal dielectric resonant element is provided in an external conductor, a notched portion is formed in the dielectric resonant element. The position and size of the notched portion are determined such that the coupling mode of a plurality of electrical signals introduced into the dielectric resonator is in a peak state. Therefore, unlike the related art, a metal screw or the like is not used in order to control the coupling mode (resonance state), so there is no transmission loss of electrical signals for resonance. Further, a complex process, such as processing of the dielectric resonant element or the like, is not used. As a result, a dielectric resonator with an optimum controlled coupling mode (resonance state) can be easily obtained.

With this configuration, it is considered that the change in the coupling mode (resonance state) of the dielectric resonator changes results from the change in inductance and/or coupling capacitance to an electrical signal introduced into the dielectric resonator.

According to an aspect of the invention, the notched portion may be formed by grinding the dielectric resonant element vertically along a height direction, and the dielectric resonant element may have a vertical section in the height direction due to the notched portion. Therefore, the peak state of the coupling mode (resonance state) in the dielectric resonator can be more easily realized.

According to another aspect of the invention, at least two notched portions may be provided, the two notched portions may be provided at the opposing surfaces of the dielectric resonant element, and the dielectric resonant element may have two sections perpendicular to the height direction and parallel to each other due to the two notched portions. With the two notched portions, the peak state of the coupling mode (resonance state) in the dielectric resonator can be more easily realized.

Advantage of the Invention

As described above, according to the invention, it is possible to provide a dielectric resonator having simple configuration applicable to a multiple mode with no electrical signal transmission loss, and a method of controlling a resonance state (coupling mode) in the dielectric resonator.

BEST MODE FOR CARRYING OUT THE INVENTION

Hereinafter, embodiments of the invention will be described.

First Embodiment

Figure 1:
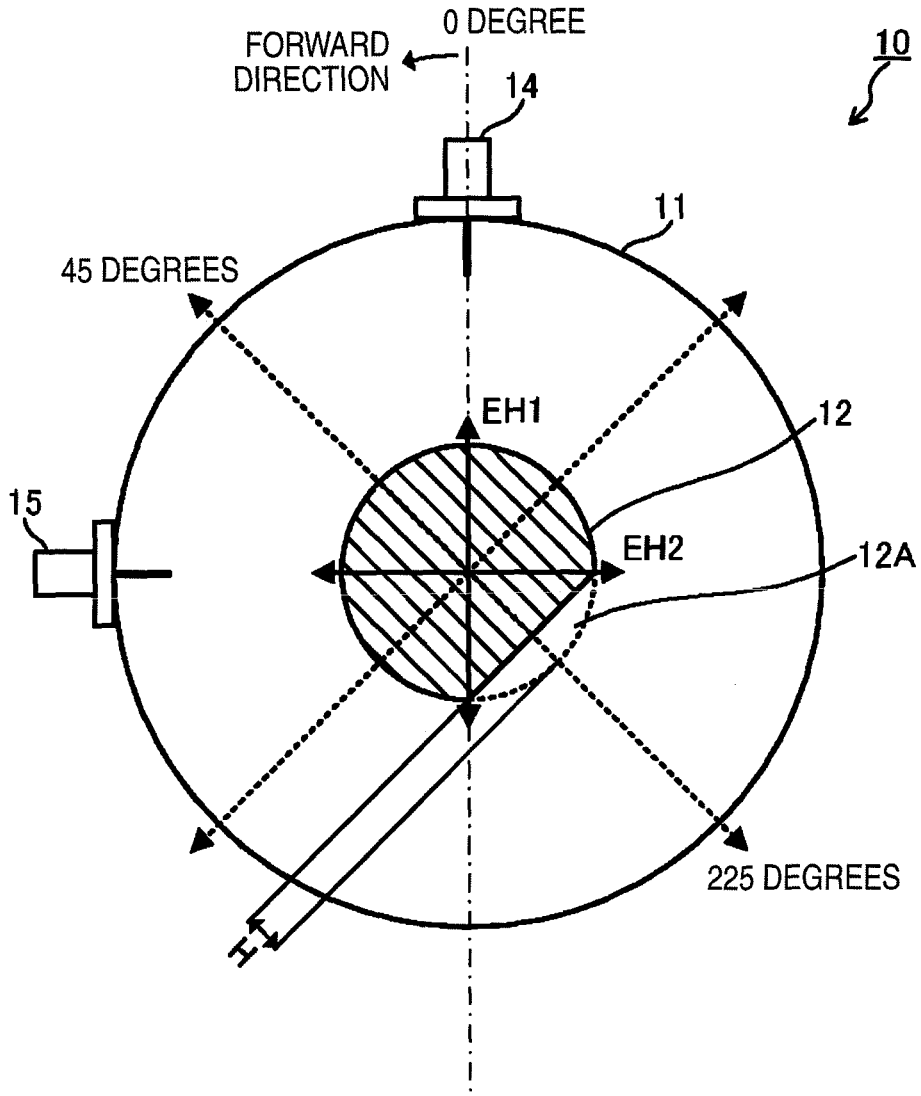
FIG. 1 is a plan view of a dielectric resonator according to a first embodiment.
Figure 2:
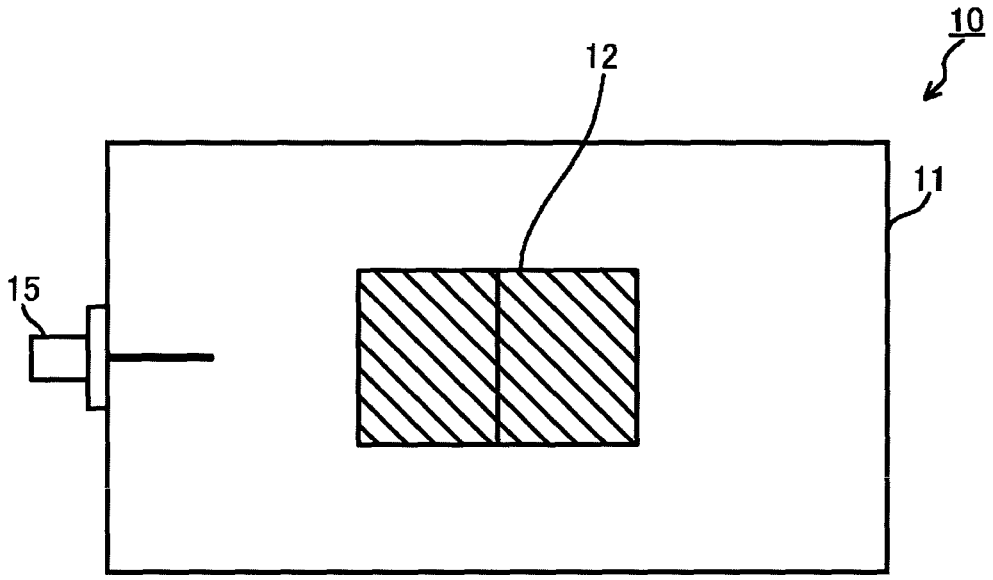
FIG. 2 is a side view of the dielectric resonator shown in FIG. 1.
Figure 3:
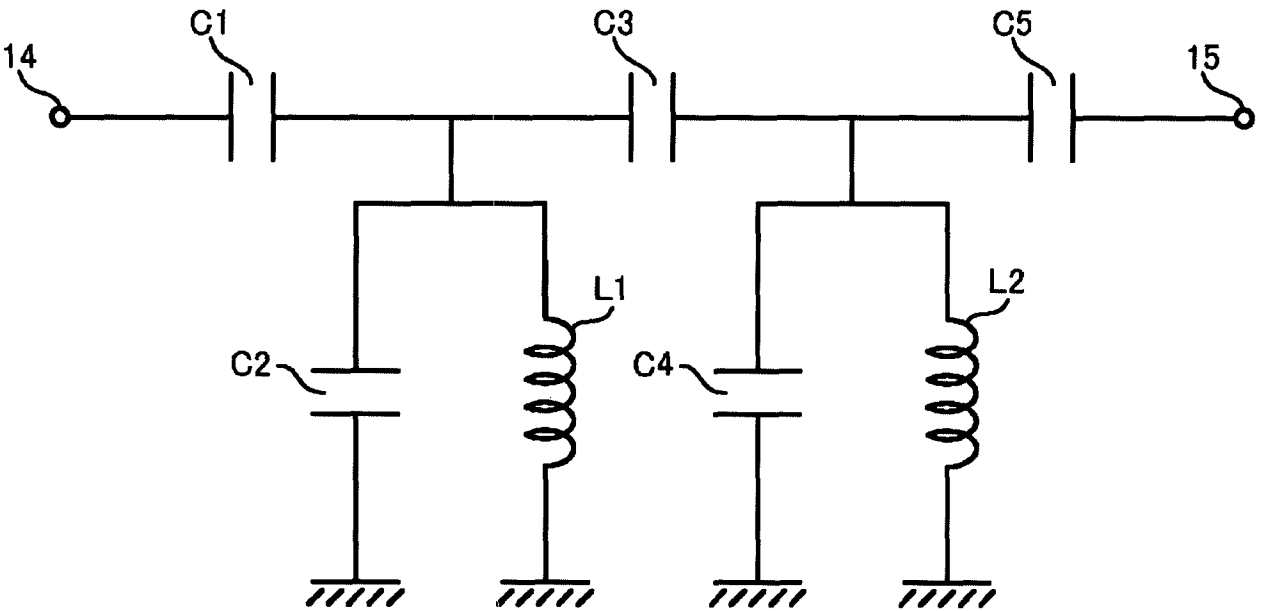
FIG. 3 is an equivalent circuit of the dielectric resonator shown in FIGS. 1 and 2.

FIG. 1 is a plan view of a dielectric resonator according to this embodiment. FIG. 2 is a side view of the dielectric resonator shown in FIG. 1. FIG. 3 is an equivalent circuit of the dielectric resonator shown in FIGS. 1 and 2.

As shown in FIGS. 1 and 2, dielectric resonator 10 according to this embodiment includes cylindrical external conductor 11, columnar dielectric resonant element 12 arranged at the substantially center of external conductor 11, and electrical signal input section 14 and electrical signal output section 15 arranged on the circumferential surface of external conductor 11 at an angle of 90 degrees. Dielectric resonant element 12 is arranged on a support board (not shown) made of, for example, alumina or the like.

Dielectric resonant element 12 is provided with notched portion 12A which is formed by grinding dielectric resonant element 12 vertically along a height direction so as not to be opposite electrical signal input section 14 and electrical signal output section 15 provided in dielectric resonator 10. As a result, dielectric resonant element 12 has a vertical section in the height direction due to notched portion 12A.

In FIG. 3, reference numeral C1 denotes a capacitive coupling circuit which is capacitively coupled to the resonance circuit of electrical signal input section 14 and dielectric resonator 10. Reference numeral C5 denotes a capacitive coupling circuit which is capacitively coupled to the resonance circuit of electrical signal output section 15 and dielectric resonator 10. Reference numerals C2 and L1 and reference numerals C4 and L2 respectively denote a capacitive coupling circuit and an inductance constituting the resonance circuit of dielectric resonator 10. Reference numeral C3 denotes inter-stage coupling capacitance formed by the notched portion 12A.

In FIG. 3, capacitive coupling circuits C1 and C5 are changed depending on the materials and sizes of electrical signal input section 14 and electrical signal output section 15. In FIG. 3, capacitive coupling circuits C2 and C4 and inductance L1 and L2 are changed depending on the materials and the like of notched portion 12A and external conductor 11.

In this embodiment, notched portion 12A is provided so as to control the values of capacitive coupling circuits C2 and C4 and the value of C3, and to control inductance L1 and L2, thereby controlling the resonance state (coupling mode).

Figure 4:
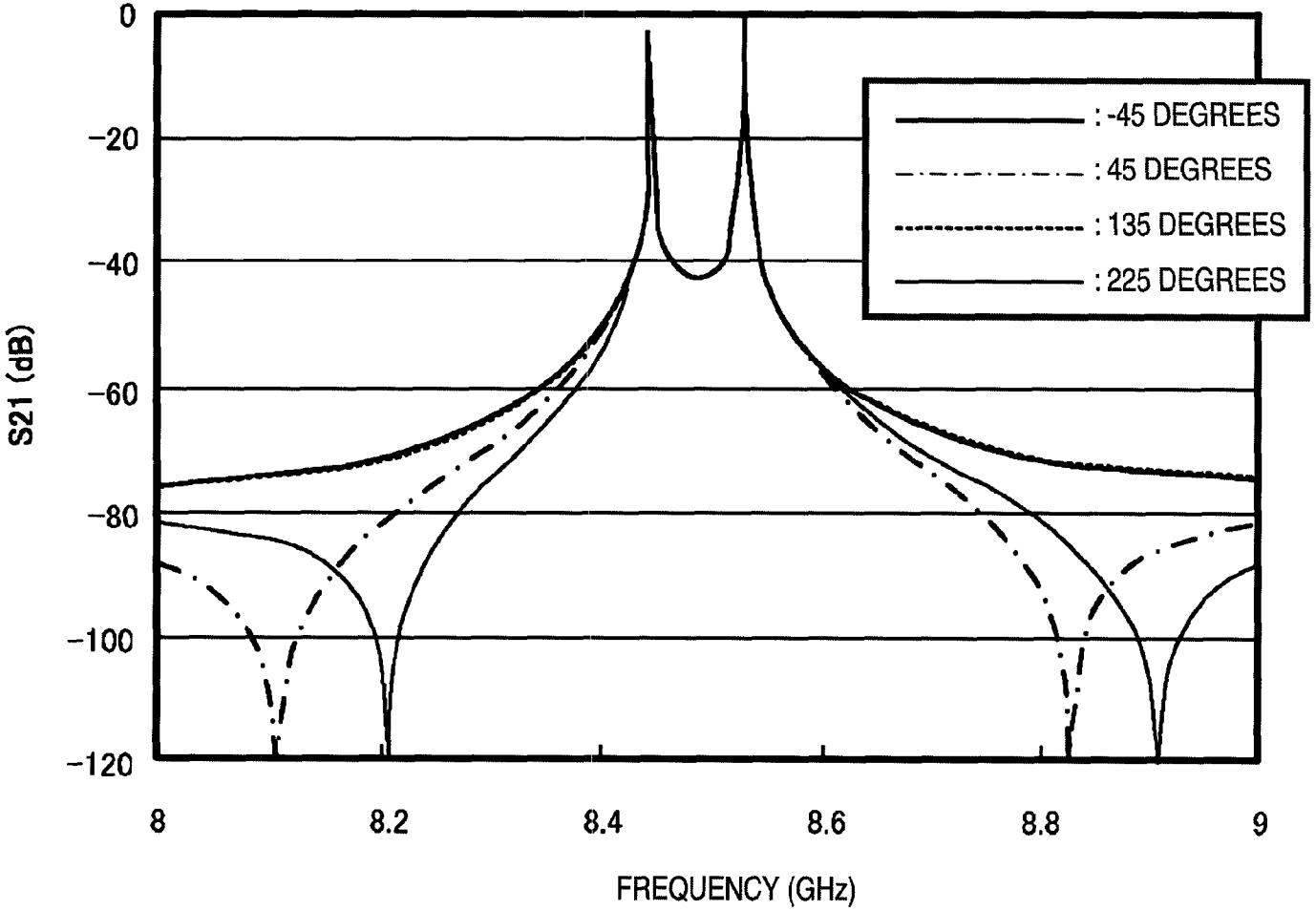
FIG. 4 is a graph showing the attenuation state of an electrical signal in the dielectric resonator according to the first embodiment.

FIG. 4 is a graph showing the attenuation state of an electrical signal depending on the relative positional relationship of the notched portion with respect to electrical signal input section 14 in dielectric resonator 10 of this embodiment. As will be apparent from FIG. 4, it can be seen that, in this embodiment, the attenuation effect is produced at 45 degrees and 225 degrees from electrical signal input section 14 (an attenuation pole is generated in the frequency characteristic).

That is, if notched portion 12A of dielectric resonant element 12 is formed at such positions, the degree of coupling to electrical signal input section 14 and electrical signal output section 15 is lowered. Further, as described above, notched portion 12A is provided so as not to be opposite electrical signal input section 14 and electrical signal output section 15. Therefore, the resonance state (coupling mode) of electrical signals introduced into dielectric resonator 10 can be controlled in a good state. In this embodiment, as shown in FIGS. 1 and 2, notched portion 12A is provided at 225 degrees, so the above-described advantages are obtained.

In this embodiment, as shown in FIG. 1, two EH modes (EH1 and EH2) are coupled so as to realize a dual-mode resonance state.

Second Embodiment

Figure 5:
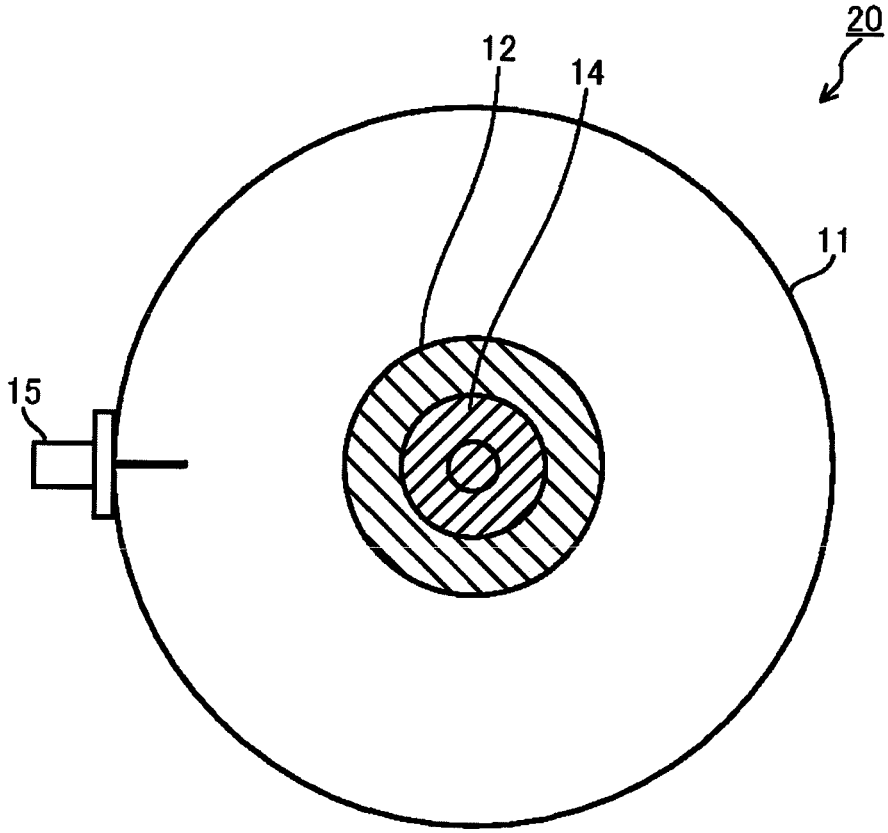
FIG. 5 is a plan view of a dielectric resonator according to the second embodiment.
Figure 6:
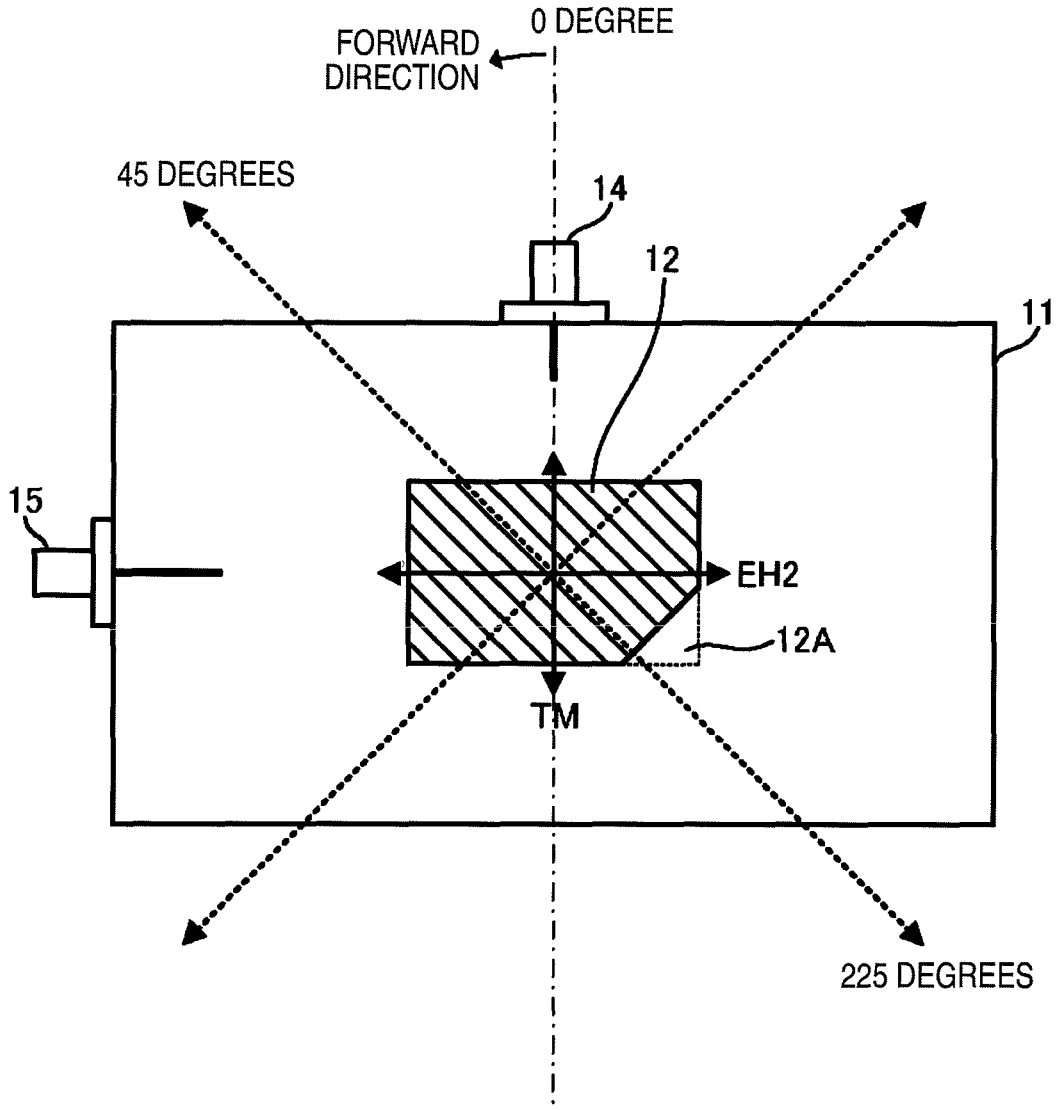
FIG. 6 is a side view of the dielectric resonator shown in FIG. 5.

FIG. 5 is a plan view of a dielectric resonator according to this embodiment. FIG. 6 is a side view of the dielectric resonator shown in FIG. 5. The same elements as those of the dielectric resonator shown in FIGS. 1 and 2 are represented by the same reference numerals.

As shown in FIGS. 5 and 6, dielectric resonator 20 according to this embodiment includes cylindrical external conductor 11, columnar dielectric resonant element 12 arranged at the substantially center of external conductor 11, electrical signal input section 14 provided at the top surface of external conductor 11, and electrical signal output section 15 provided on the circumferential surface of external conductor 11. With this arrangement, electrical signal input section 14 and electrical signal output section 15 are arranged at an angle of 90 degrees. Dielectric resonant element 12 is arranged on a support board (not shown) made of, for example, alumina or the like.

Dielectric resonant element 12 is provided with notched portion 12A which is formed by grinding dielectric resonant element 12 including the lower end thereof at an angle of 45 degrees so as not to be opposite electrical signal input section 14 and electrical signal output section 15 provided in dielectric resonator 20. As a result, dielectric resonant element 12 has a section at an angle of 45 degrees due to notched portion 12A.

Though not particularly shown, in this embodiment, similarly to the foregoing embodiment, the equivalent circuit shown in FIG. 3 is formed.

In this embodiment, as described above, notched portion 12A of dielectric resonant element 12 is formed so as not to be opposite electrical signal input section 14 and electrical signal output section 15. Therefore, it is considered that notched portion 12A is formed in dielectric resonant element 12, so capacitive coupling circuit C2 in the equivalent circuit of FIG. 3 is mainly changed so as to control the resonance state (coupling mode) of dielectric resonator 20.

In this embodiment, as described above, notched portion 12A of dielectric resonant element 12 is formed so as not to be opposite electrical signal input section 14 and electrical signal output section 15. Therefore, it is considered that notched portion 12A is formed in dielectric resonant element 12, so capacitive coupling circuit C2 in the equivalent circuit of FIG. 3 is mainly changed so as to control the resonance state (coupling mode) of dielectric resonator 20.

Figure 7:
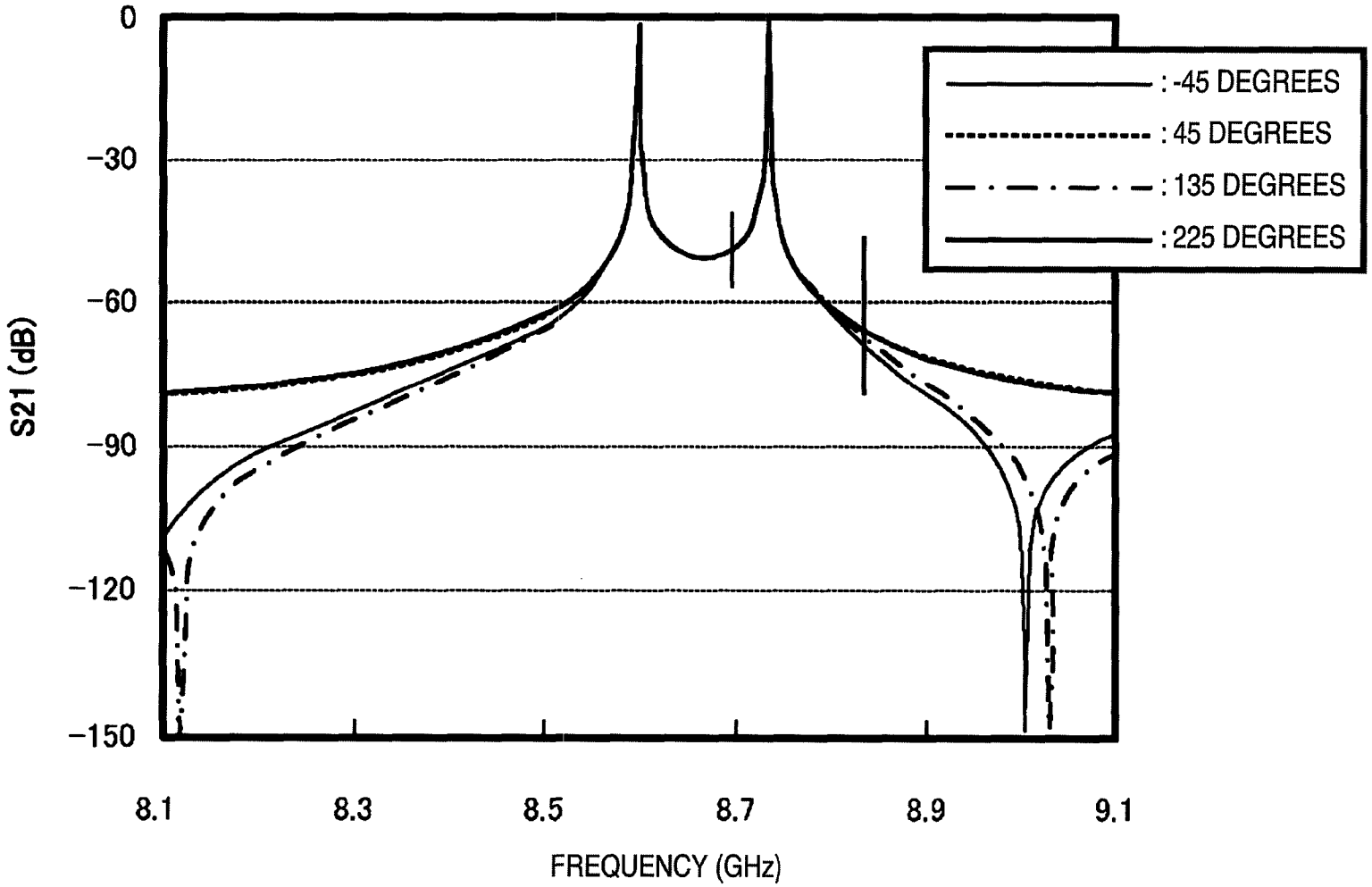
FIG. 7 is a graph showing the attenuation state of an electrical signal in the dielectric resonator according to the second embodiment.

FIG. 7 is a graph showing the attenuation state of an electrical signal depending on the relative positional relationship of the notched portion with respect to electrical signal input section 14 in dielectric resonator 20 of this embodiment. As will be apparent from FIG. 7, it can be seen that, in this embodiment, when the direction from electrical signal input section 14 toward electrical signal output section 15 is a forward direction, the attenuation effect is produced at 45 degrees and 225 degrees (an attenuation pole is generated in the frequency characteristic).

That is, if notched portion 12A of dielectric resonant element 12 is formed at such positions, the degree of coupling to electrical signal input section 14 and electrical signal output section 15 is lowered. Further, as described above, notched portion 12A is provided so as not to be opposite electrical signal input section 14 and electrical signal output section 15. Therefore, the resonance state (coupling mode) of electrical signals introduced into dielectric resonator 20 can be controlled in a good state. In this embodiment, as shown in FIGS. 5 and 6, notched portion 12A is provided at 225 degrees, so the above-described advantages are obtained.

In this embodiment, a TM mode and an EH mode (TM and EH2) are coupled so as to realize a dual-mode resonance state.

Third Embodiment

Figure 8:
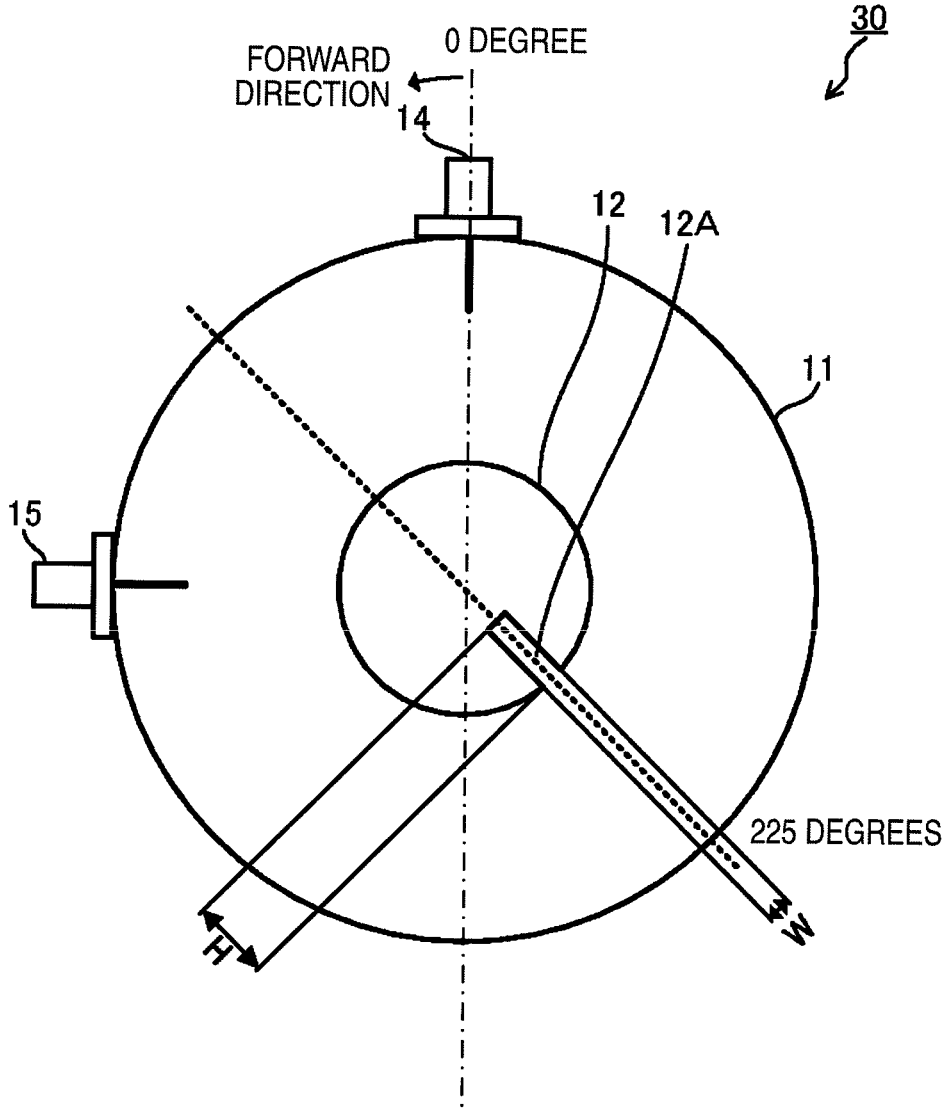
FIG. 8 is a plan view of a dielectric resonator according to a third embodiment.
Figure 9:
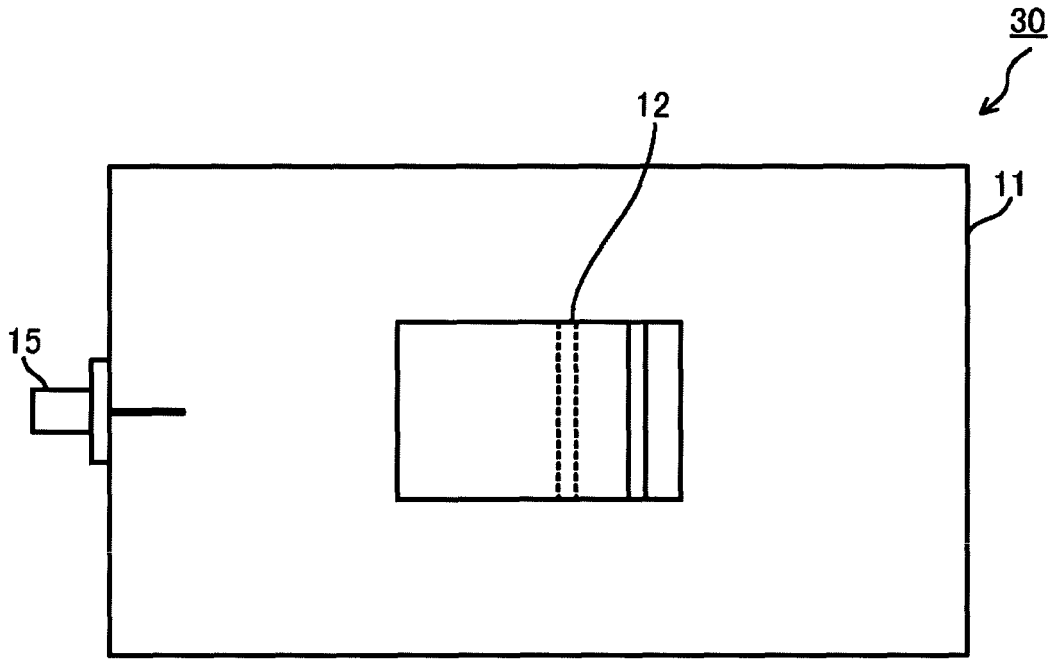
FIG. 9 is a side view of the dielectric resonator shown in FIG. 8.

FIG. 8 is a plan view of a dielectric resonator according to this embodiment. FIG. 9 is a side view of the dielectric resonator shown in FIG. 8. The same elements as those of dielectric resonator shown in FIGS. 1 and 2 are represented by the same reference numerals.

As shown in FIGS. 8 and 9, dielectric resonator 30 according to this embodiment includes cylindrical external conductor 11, columnar dielectric resonant element 12 arranged at the substantially center of external conductor 11, and electrical signal input section 14 and electrical signal output section 15 arranged on the circumferential surface of external conductor 11 at an angle of 90 degrees. Dielectric resonant element 12 is arranged on a support board (not shown) made of, for example, alumina or the like.

Dielectric resonant element 12 is provided with notched portion 12A which is a groove portion formed by grinding dielectric resonant element 12 vertically along a height direction so as not to be opposite electrical signal input section 14 and electrical signal output section 15 provided in dielectric resonator 30. Though not particularly shown, in this embodiment, similarly to the foregoing embodiments, the equivalent circuit shown in FIG. 3 is formed.

In this embodiment, as described above, notched portion 12A of dielectric resonant element 12 is formed so as not to be opposite electrical signal input section 14 and electrical signal output section 15. Therefore, it is considered that notched portion 12A is formed in dielectric resonant element 12, so capacitive coupling circuit C2 in the equivalent circuit of FIG. 3 is mainly changed so as to control the resonance state (coupling mode) of dielectric resonator 30.

In this embodiment, notched portion 12A is formed at 225 degrees from electrical signal input section 14 where the attenuation effect shown in FIG. 4 is produced. Therefore, the degree of coupling to electrical signal input section 14 and electrical signal output section 15 is lowered. As a result, as described above, if notched portion 12A is provided so as not to be opposite electrical signal input section 14 and electrical signal output section 15, the resonance state (coupling mode) of electrical signals introduced into dielectric resonator 30 can be controlled in a good state.

In this embodiment, two EH modes (EH1 and EH2) are coupled so as to realize a dual-mode resonance state.

Next, the correlation between the size of notched portion 12A and the coupling state of two electrical signals (EH1 mode and EH2 mode) introduced into dielectric resonator 10 or 30 according to the first embodiment or the third embodiment has been examined. The examination result is shown in FIGS. 10 and 11.

Figure 10:
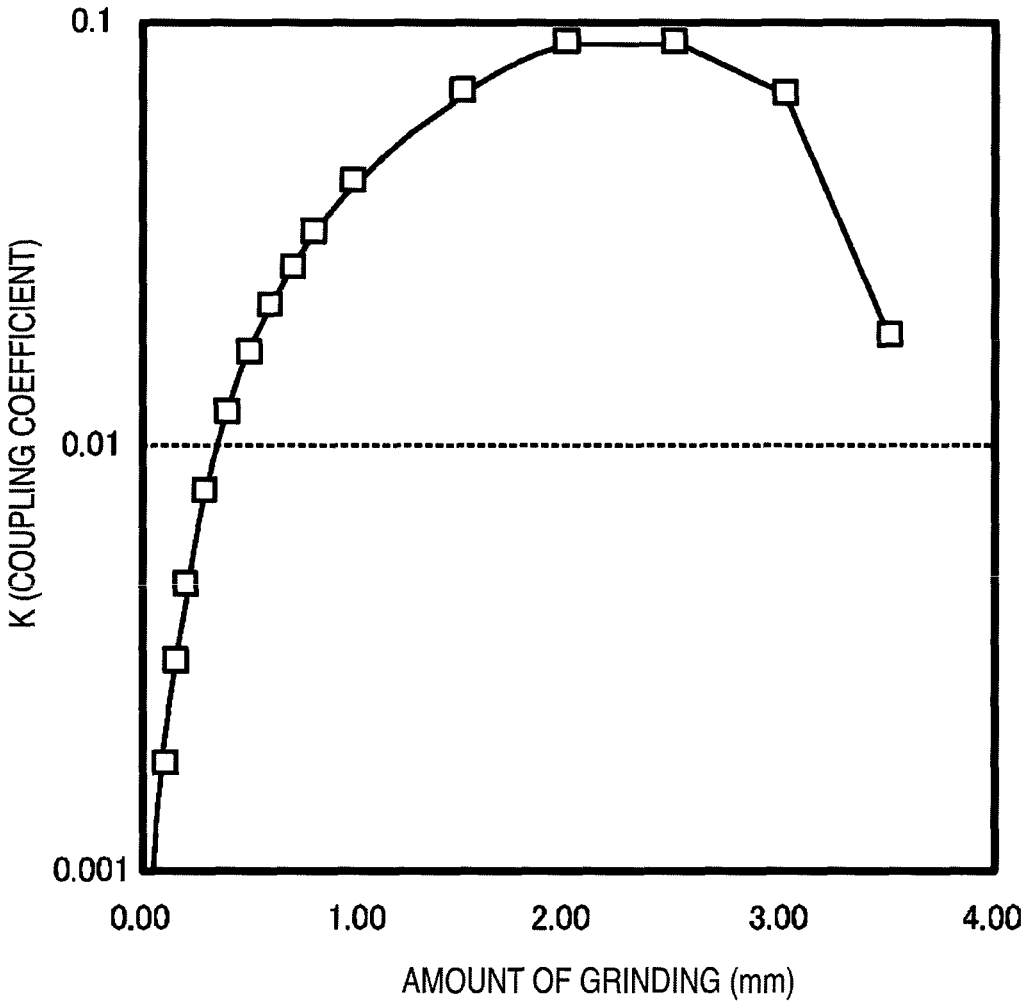
FIG. 10 is a graph showing the notched portion depth dependency of a coupling coefficient in a dielectric resonator according to an embodiment.

As shown in FIG. 10, it can be seen that, according to the first embodiment, as the amount of grinding (depth H) of notched portion 12A increases, the coupling coefficient increases, and the coupling coefficient is stabilized at the depth H of about 1.5 to 3 mm. Therefore, it transpires that, if notched portion 12A is set within the above-describe range, the coupling state of the EH1 mode and the EH2 mode becomes good, so dual-mode resonance can be realized.

Figure 11:
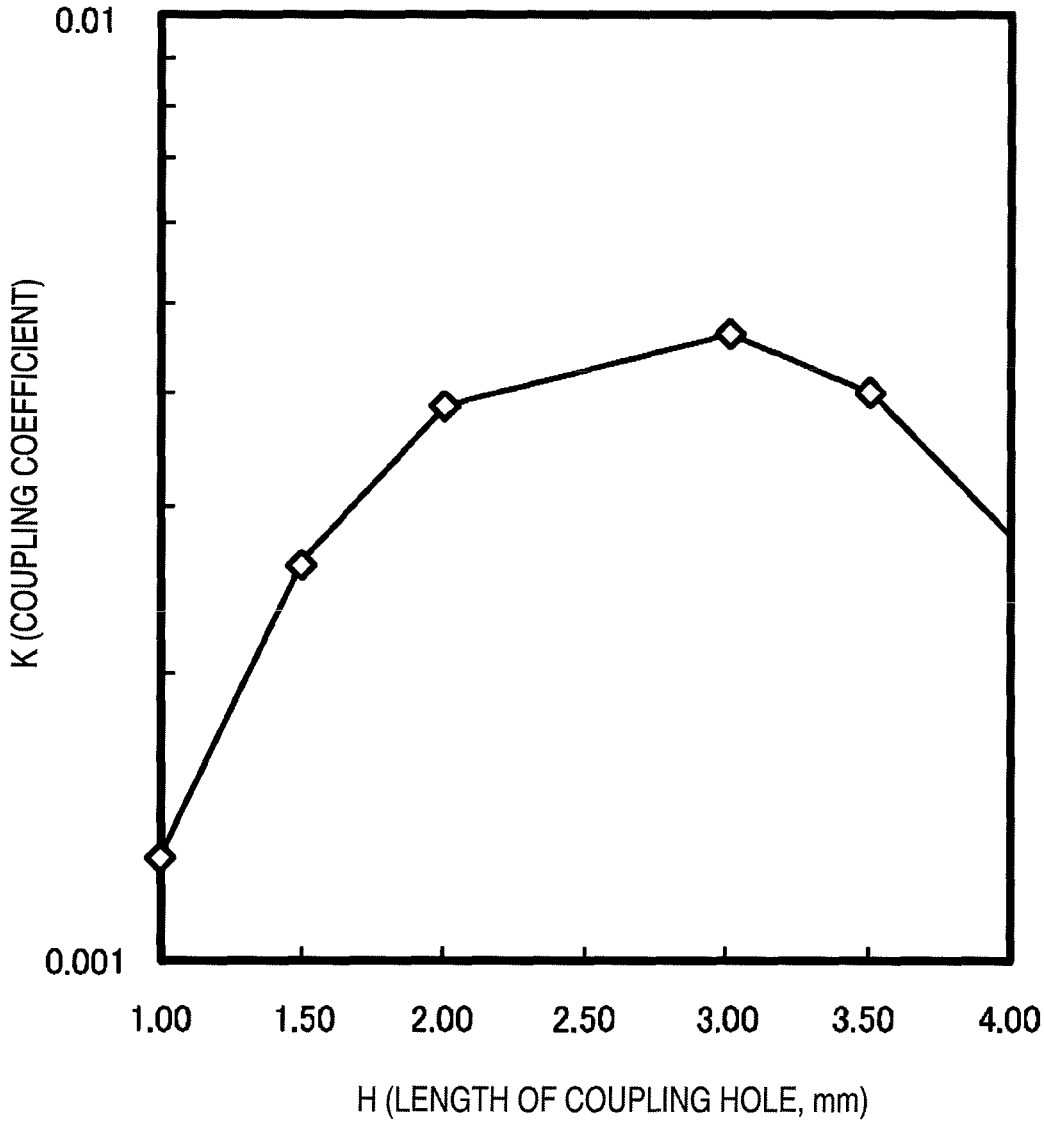
FIG. 11 is a graph showing the notched portion depth dependency of a coupling coefficient in a dielectric resonator according to an embodiment.

As shown in FIG. 11, it can be seen that, according to the third embodiment, as the amount of grinding (depth H) of notched portion 12A increases, the coupling coefficient increases, and the coupling coefficient is stabilized at the depth H of about 2 to 3.5 mm. Therefore, it transpires that, if notched portion 12A is set within the above-described range, a good coupling state of the EH1 mode and the EH2 mode is obtained, so dual-mode resonance can be realized. The width of notched portion 12A was 0.5 mm.

(Modifications)

Hereinafter, modifications will be described in which the shape of the dielectric resonator filter or the notched portion according to the foregoing embodiments is changed. As described below, even though the shape differs, the angle of the notched portion is appropriately defined so as to generate an attenuation pole, so the bands in the characteristics can be narrowed.

A. Modification 1

Figure 12:
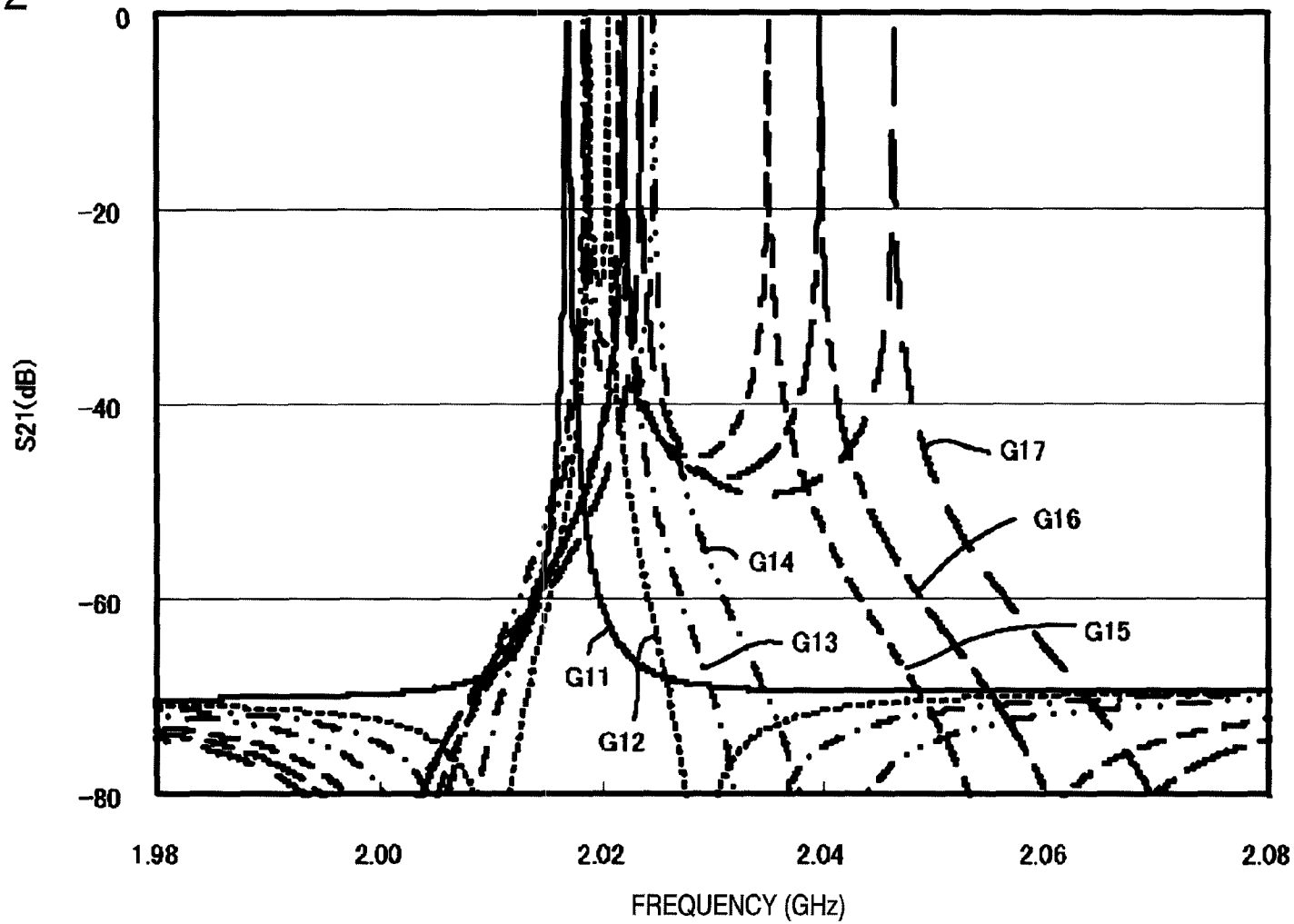
FIG. 12 is a graph showing the attenuation state of an electrical signal in the dielectric resonator according to Modification 1.
Figure 13:
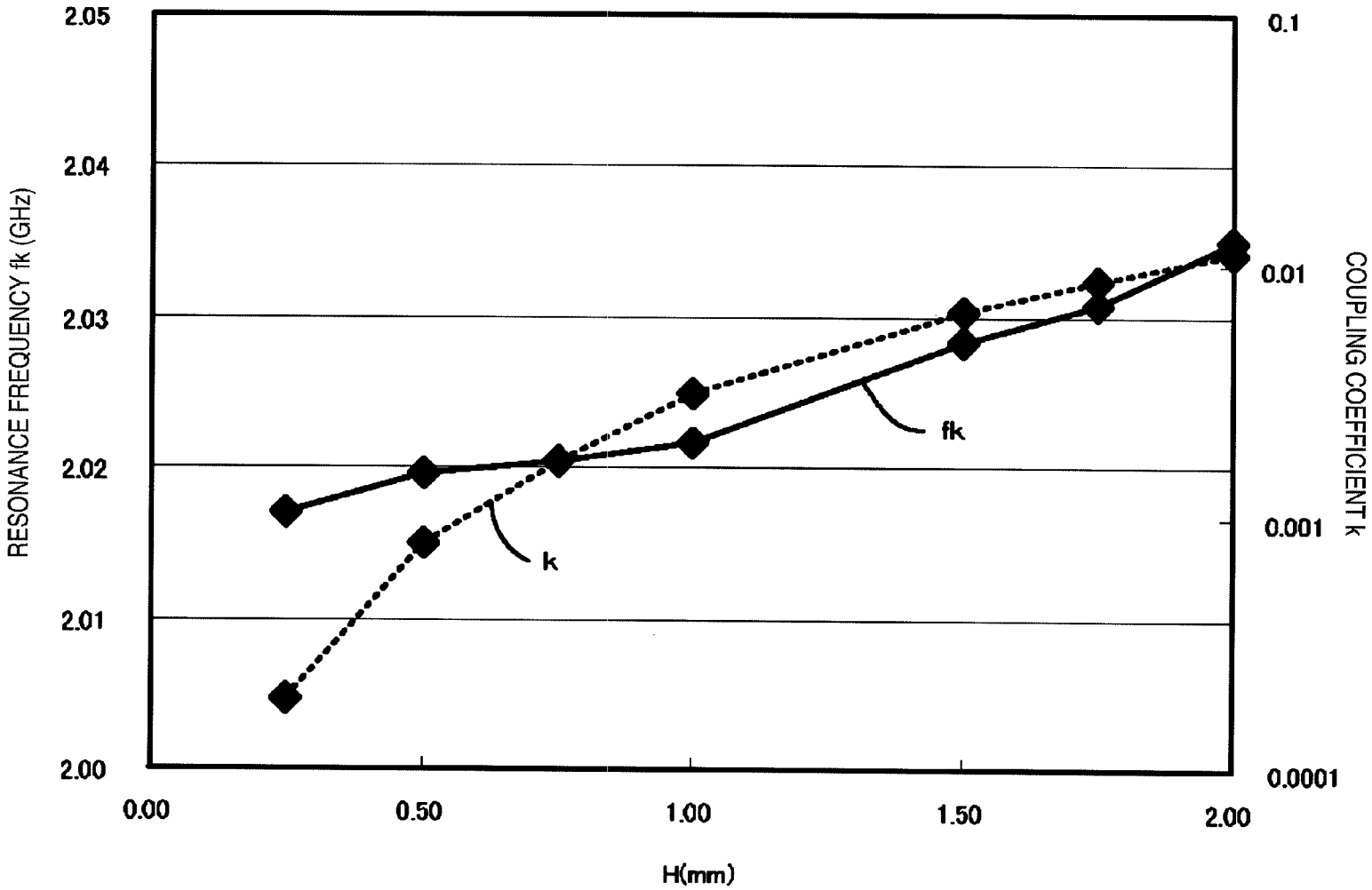
FIG. 13 is a graph showing the notched portion depth dependency of a resonance frequency and a coupling coefficient in the dielectric resonator according to Modification 1.

A case (Modification 1) where, in the first embodiment, the height H of notched portion 12A is changed will be described. FIG. 12 is a graph showing the correspondence relationship between the frequency and the attenuation state of an electrical signal when the height H of notched portion 12A of dielectric resonator 20 is changed. In the graphs G11 to G17, the height H is 0.25, 0.5, 0.75, 1.00, 1.50, 1.75, and 2.00 mm, respectively. FIG. 13 is a graph showing the relationship between the height H, the resonance frequency fk, and the coupling coefficient k. If the height H is changed in the range of 0.25 to 2.0 mm, the resonance frequency fk is changed in the range of 2.015 to 2.035 GHz, and the coupling coefficient k is changed in the range of 0.01 to 0.001.

B. Modification 2

Figure 14:
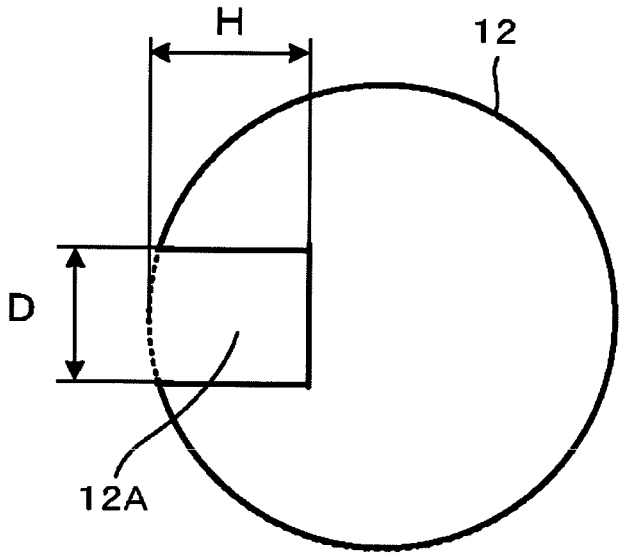
FIG. 14 is a plan view of a dielectric resonator according to Modification 2.
Figure 15:
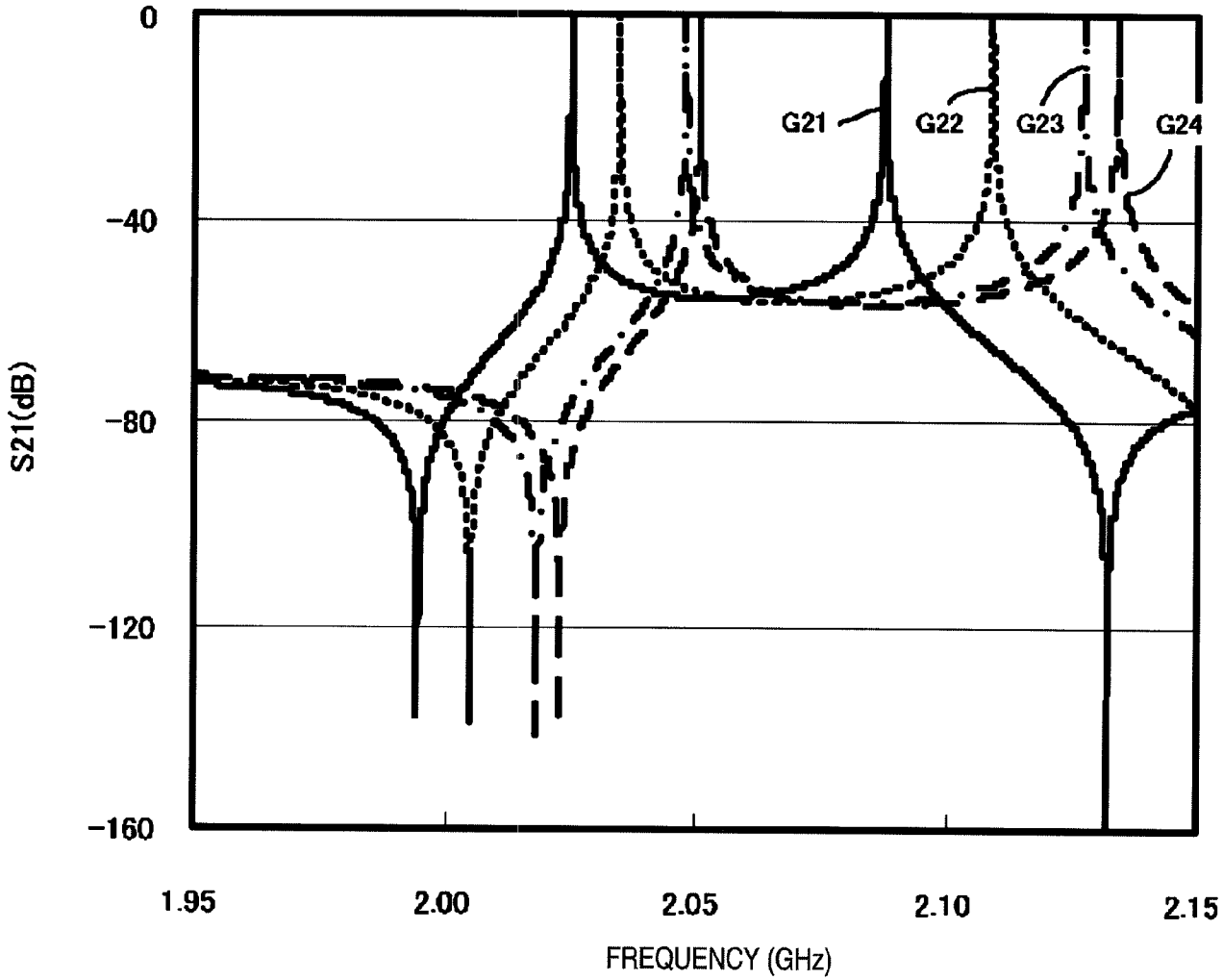
FIG. 15 is a graph showing the attenuation state of an electrical signal in the dielectric resonator according to Modification 2.
Figure 16:
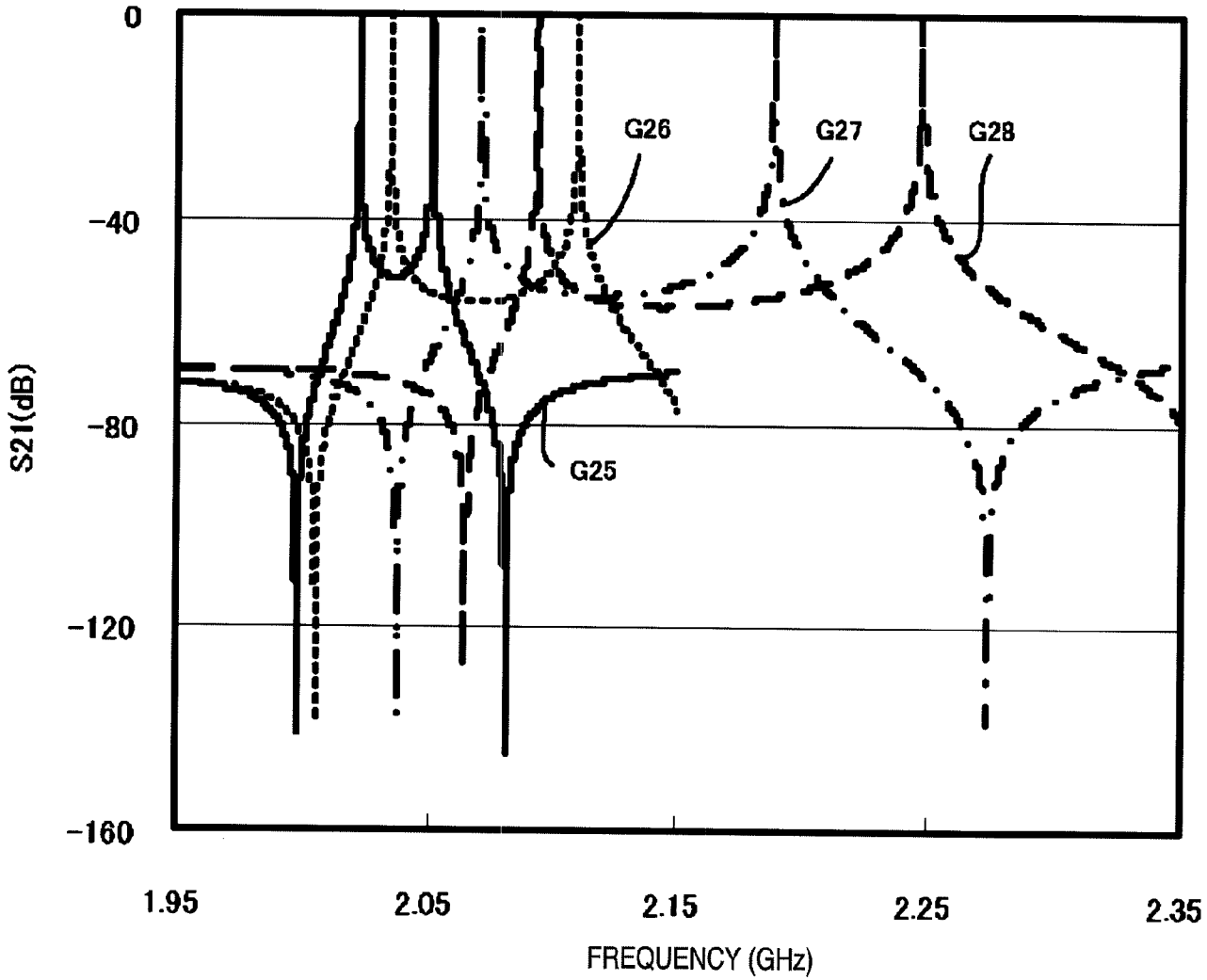
FIG. 16 is a graph showing the attenuation state of an electrical signal in the dielectric resonator according to Modification 2.
Figure 17:
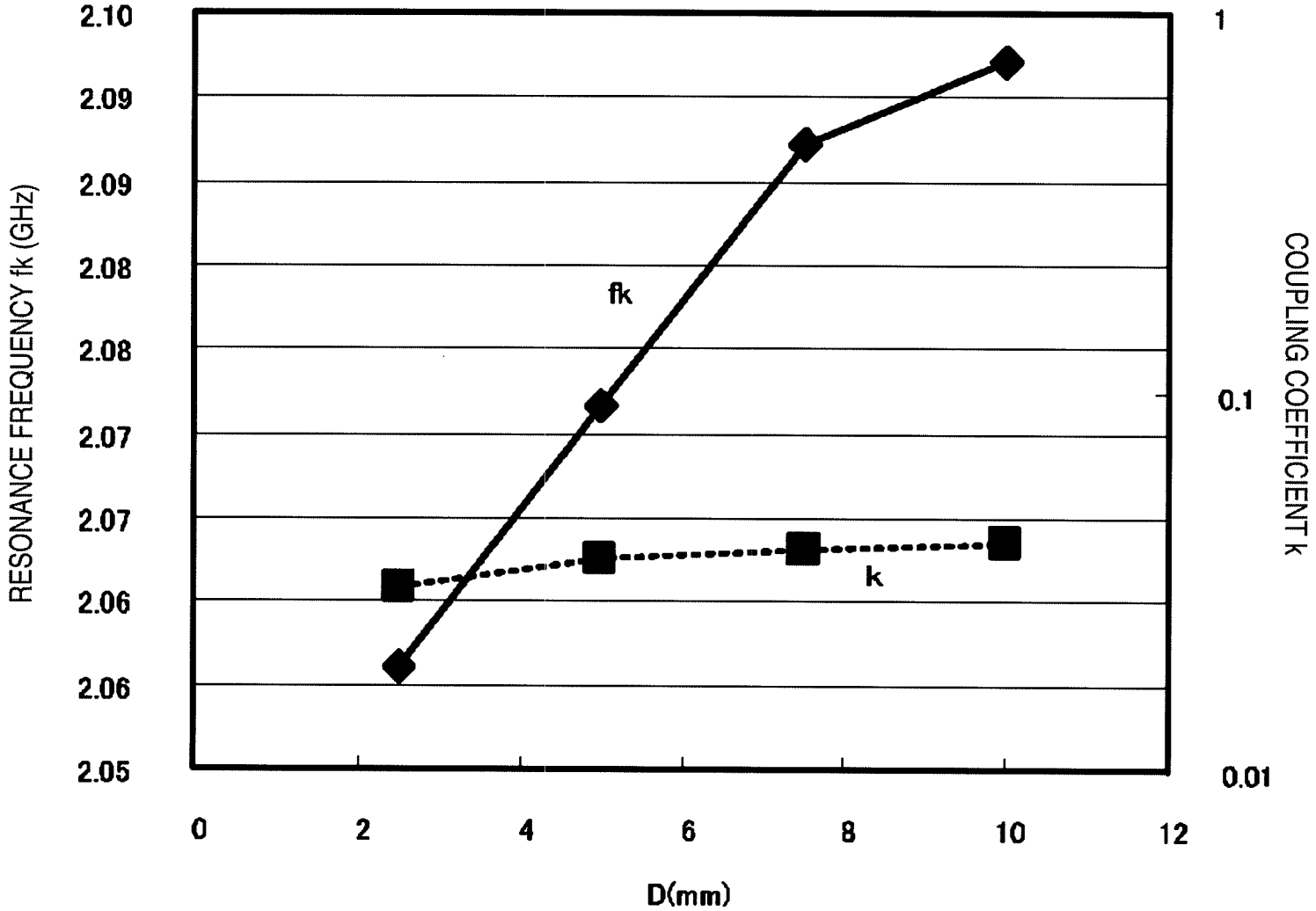
FIG. 17 is a graph showing the width dependency of a resonance frequency and a coupling coefficient in the dielectric resonator according to Modification 2.
Figure 18:
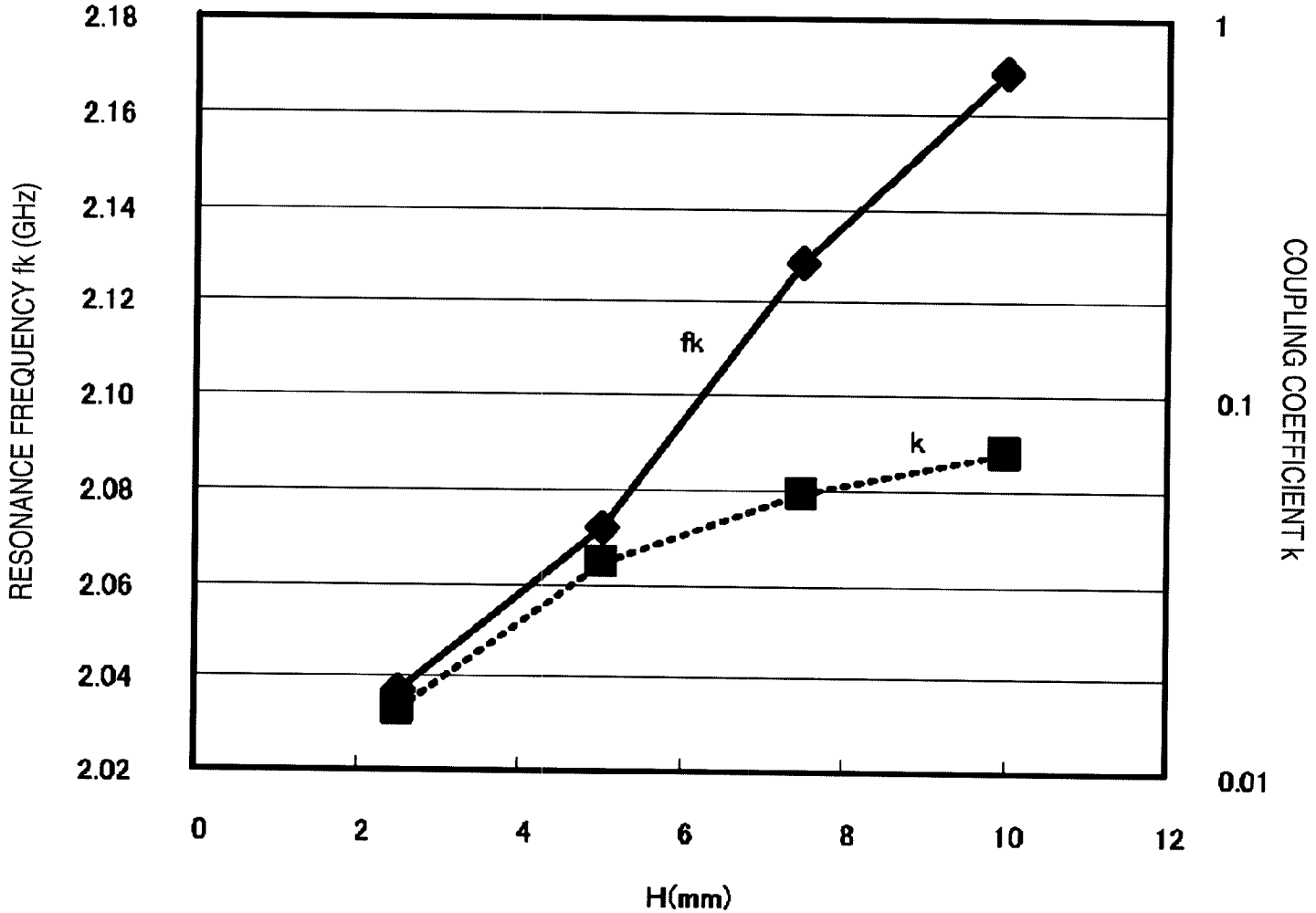
FIG. 18 is a graph showing the notched portion depth dependency of a resonance frequency and a coupling coefficient in the dielectric resonator according to Modification 2.

A case (Modification 2) where, in the first embodiment, notched portion 12A is formed to have a groove shape in the axial direction of dielectric resonant element 12 will be described. FIG. 14 is a plan view of dielectric resonant element 12 according to Modification 2. In Modification 2, notched portion 12A is a substantially cuboid groove having one bottom surface and two side surfaces, and is arranged in the axial direction of dielectric resonant element 12. FIGS. 15 and 16 are graphs showing the correspondence relationship between the frequency and the attenuation state of an electrical signal when the height H and width D of notched portion 12A of dielectric resonator 20 in the Modification 2 are changed. In the graphs G21 to G24, the height H is mm, and the width D is 2.5, 5.0, 7.5, and 10.0 mm, respectively. In the graphs G25 to G28, the width D is 5 mm, and the height H is 2.5, 5.0, 7.5, and 10.0 mm, respectively. FIGS. 17 and 18 are graphs showing the relationship between the width D and height H, the resonance frequency fk, and the coupling coefficient k. As compared with Modification 1, the change in the resonance frequency fk depending on the height H is great, and the coupling coefficient k is changed in the substantially same range. When only the width D is changed, the resonance frequency fk is changed, but the coupling coefficient k is substantially constant.

C. Modification 3

Figure 19:
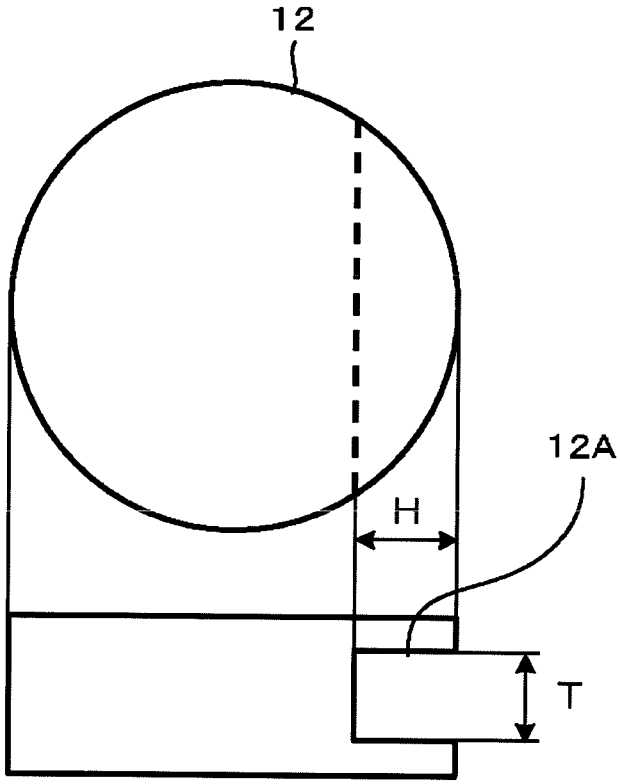
FIG. 19 is a plan view of a dielectric resonator according to Modification 3.
Figure 20:
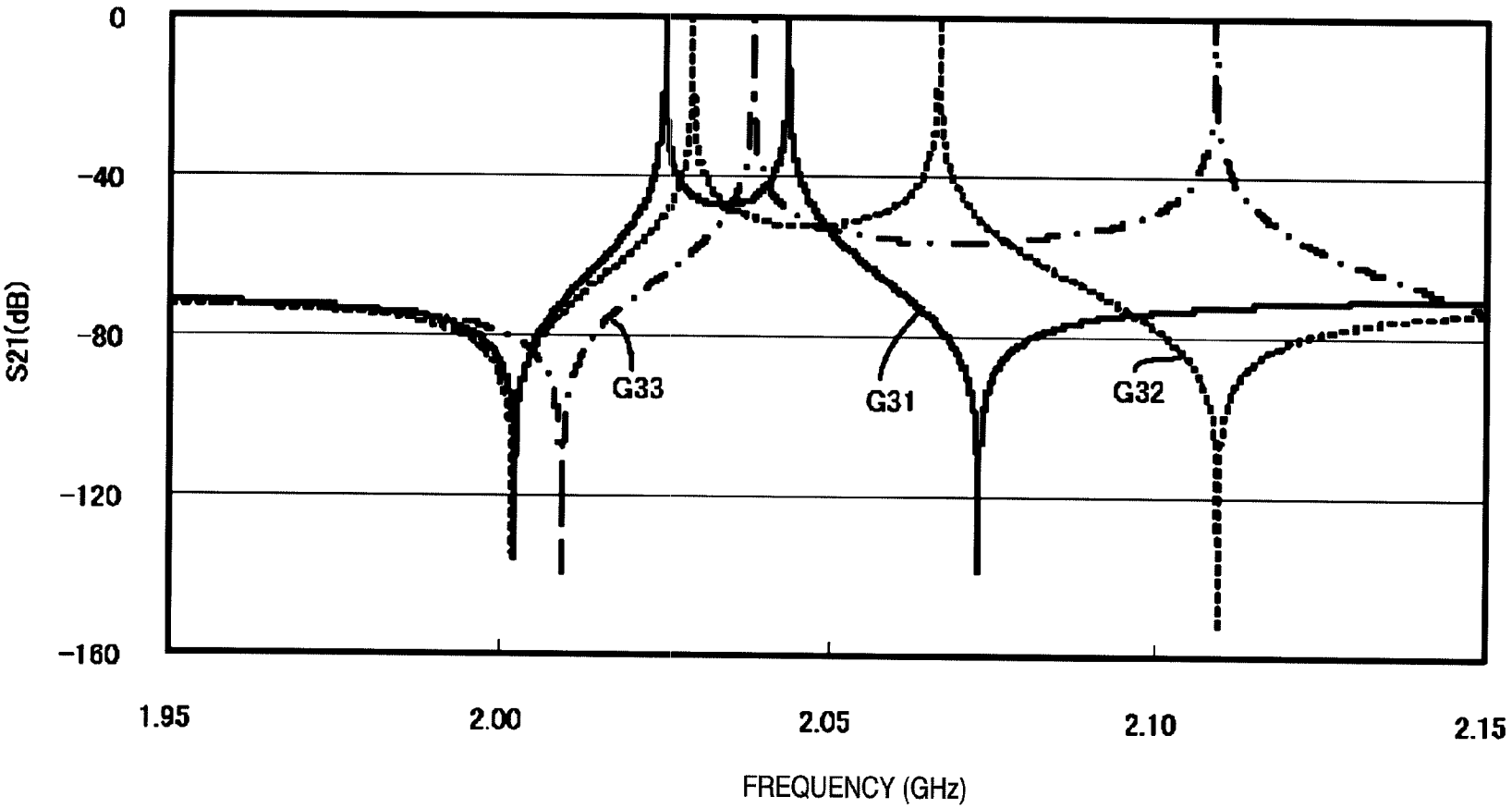
FIG. 20 is a graph showing the attenuation state of an electrical signal in the dielectric resonator according to Modification 3.
Figure 21:
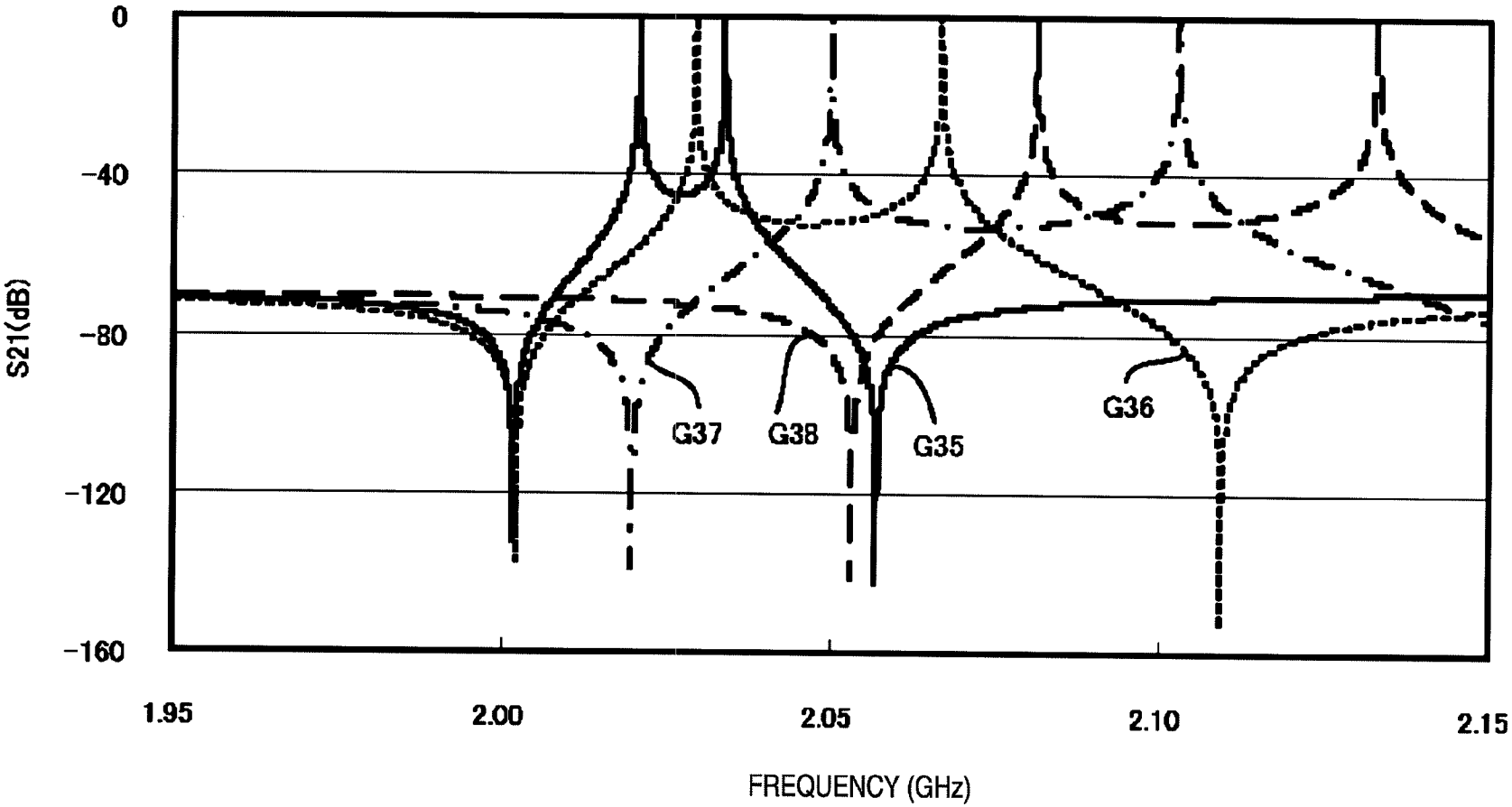
FIG. 21 is a graph showing the attenuation state of an electrical signal in the dielectric resonator according to Modification 3.
Figure 22:
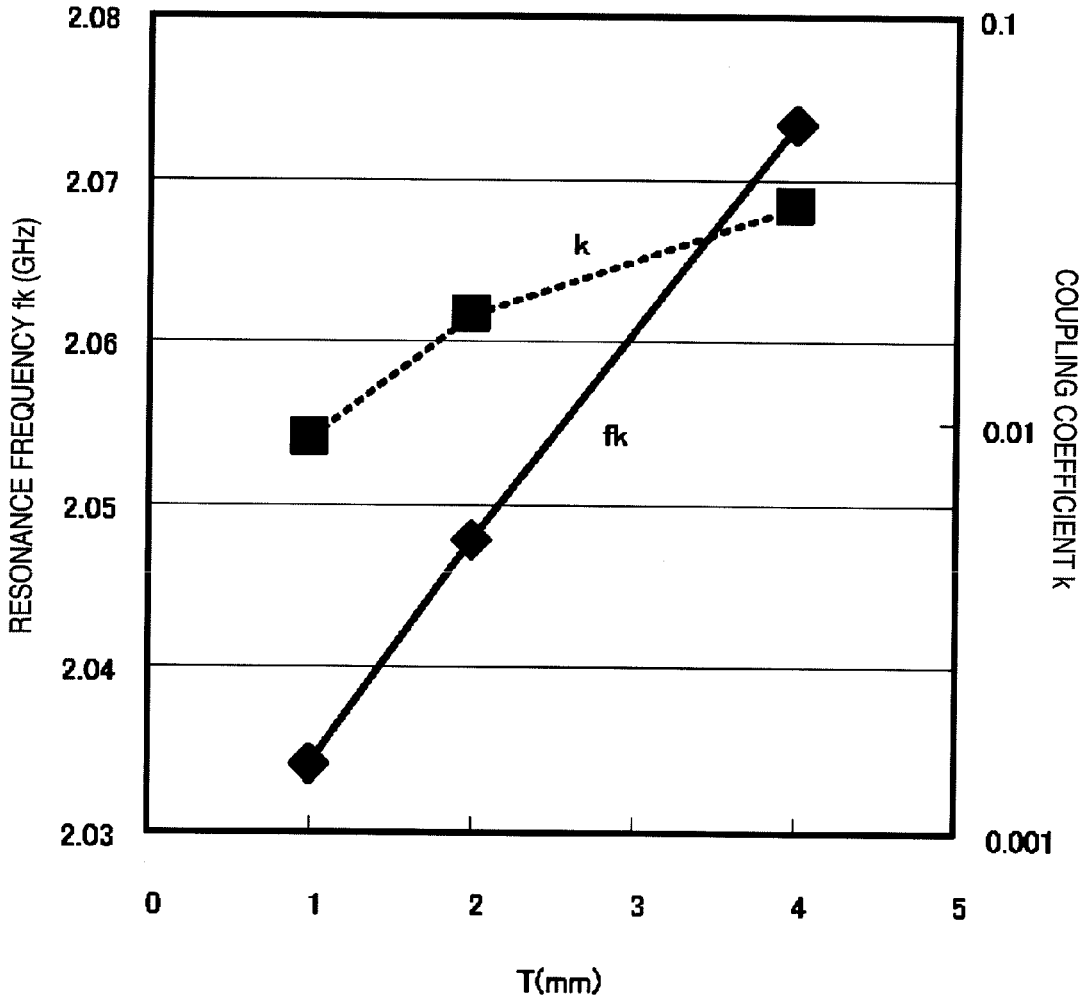
FIG. 22 is a graph showing the thickness dependency of a resonance frequency and a coupling coefficient in the dielectric resonator according to Modification 3.
Figure 23:
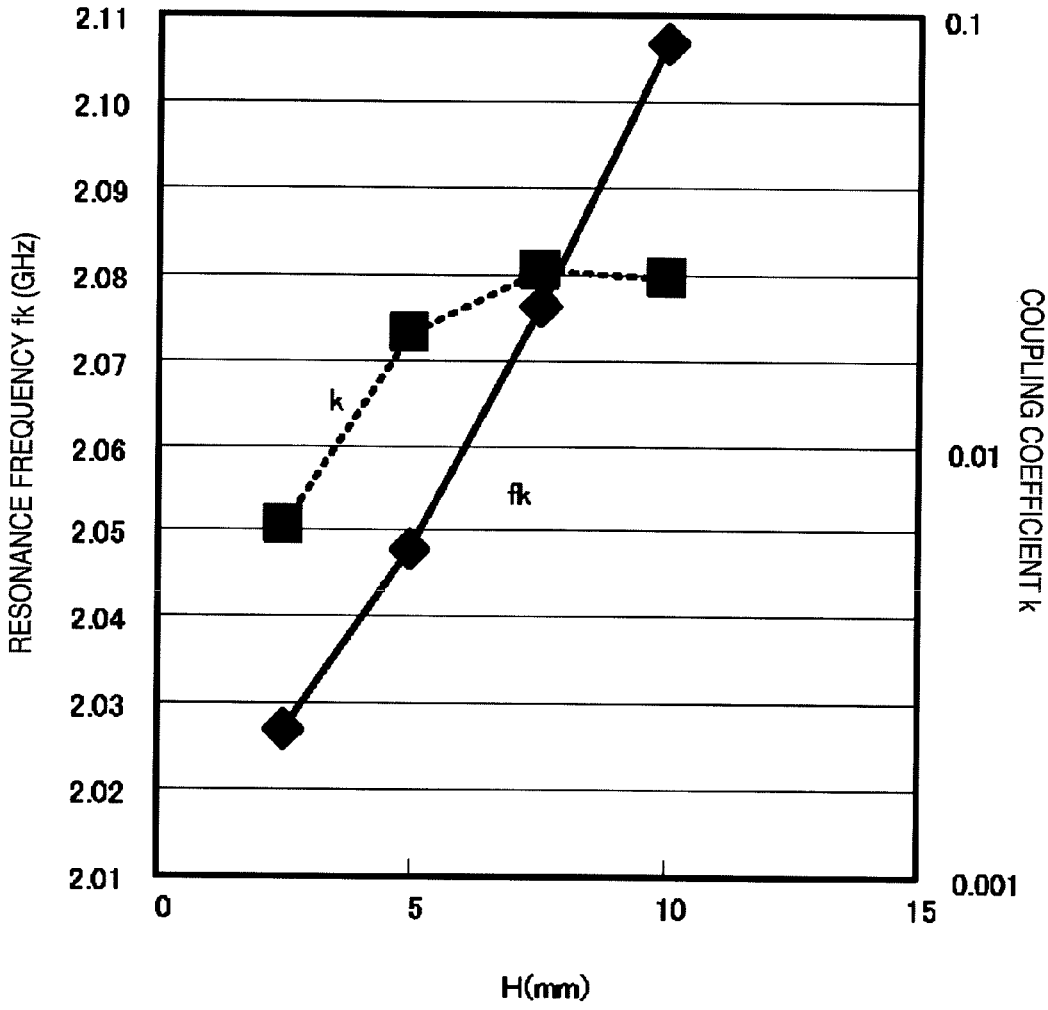
FIG. 23 is a graph showing the notched portion depth dependency of a resonance frequency and a coupling coefficient in the dielectric resonator according to Modification 3.

A case (Modification 3) where, in the first embodiment, notched portion 12A is formed to have a groove shape in the diameter direction of dielectric resonant element 12 will be described. FIG. 19 is a plan view showing dielectric resonant element 12 according to Modification 3. In Modification 3, notched portion 12A is a substantially cuboid groove having one bottom surface and two side surfaces, and is arranged in the diameter direction of dielectric resonant element 12. FIGS. 20 and 21 are graphs showing the correspondence relationship between the frequency and the attenuation state of an electrical signal when the height H and thickness T of notched portion 12A of dielectric resonator 20 in Modification 3 are changed. In the graphs G31 to G33, the height H is 5 mm, and the thickness T is 1, 2, and 4 mm, respectively. In the graphs G35 to G38, the thickness T is 2 mm, and the height H is 2.5, 5.0, 7.5, and 10.0 mm, respectively. FIGS. 22 and 23 are graphs showing the relationship between the thickness T and height H, the resonance frequency fk, and the coupling coefficient k. As compared with Modification 1, the change in the resonance frequency fk depending on the height H is great, and the coupling coefficient k is changed in the substantially same range.

D. Modification 4

Figure 24:
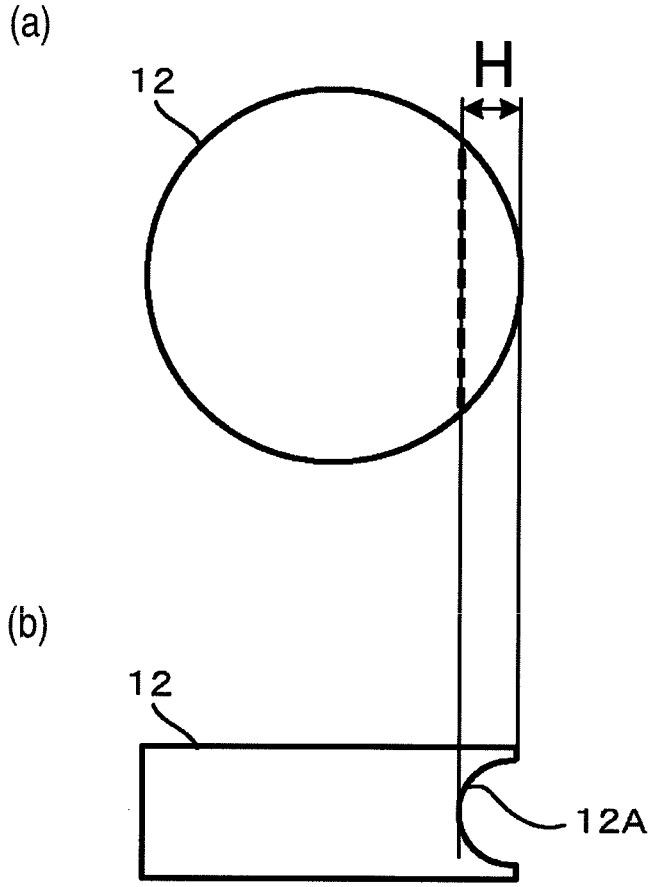
FIG. 24 is a plan view of a dielectric resonator according to Modification 4.
Figure 25:
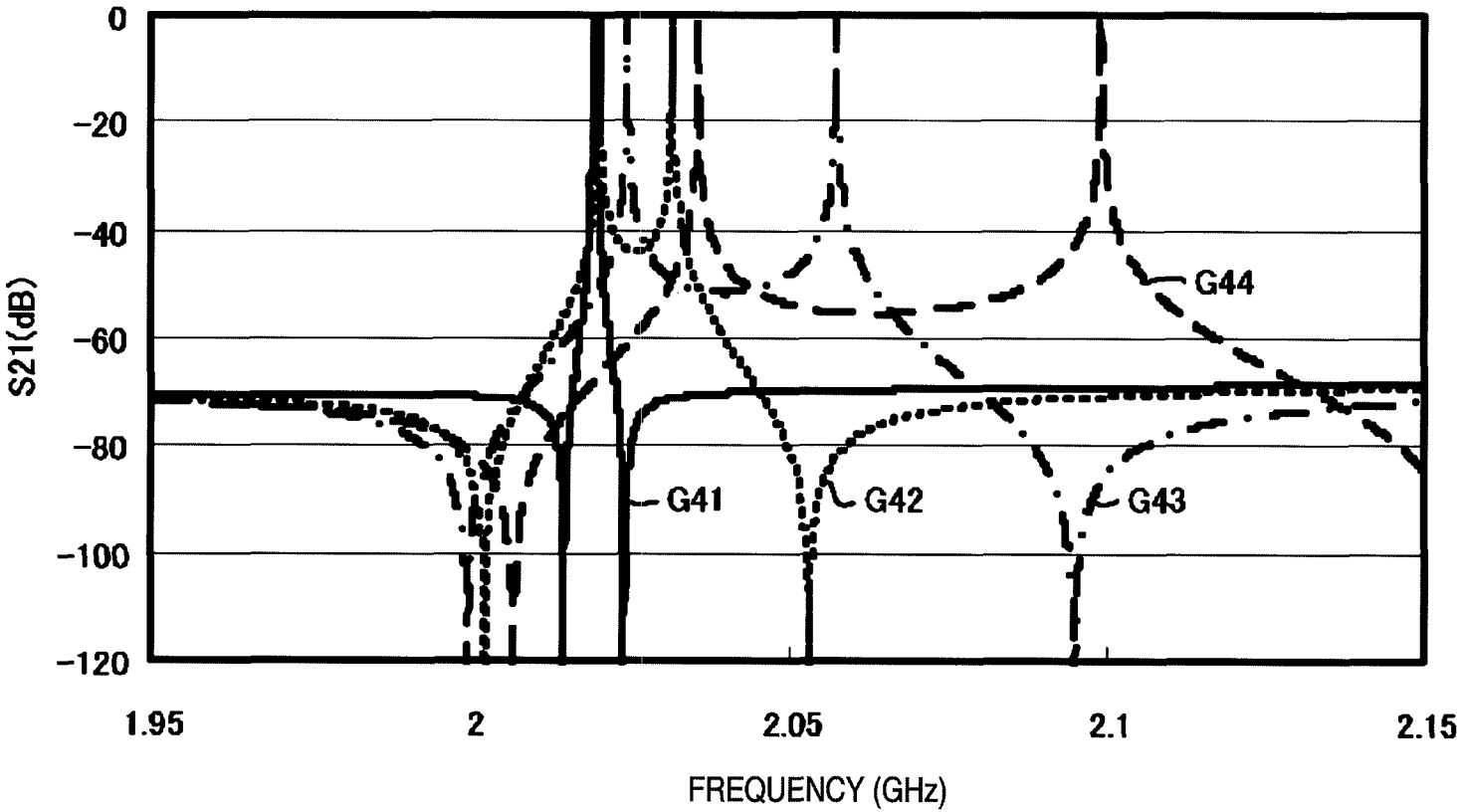
FIG. 25 is a graph showing the attenuation state of an electrical signal in the dielectric resonator according to Modification 4.
Figure 26:
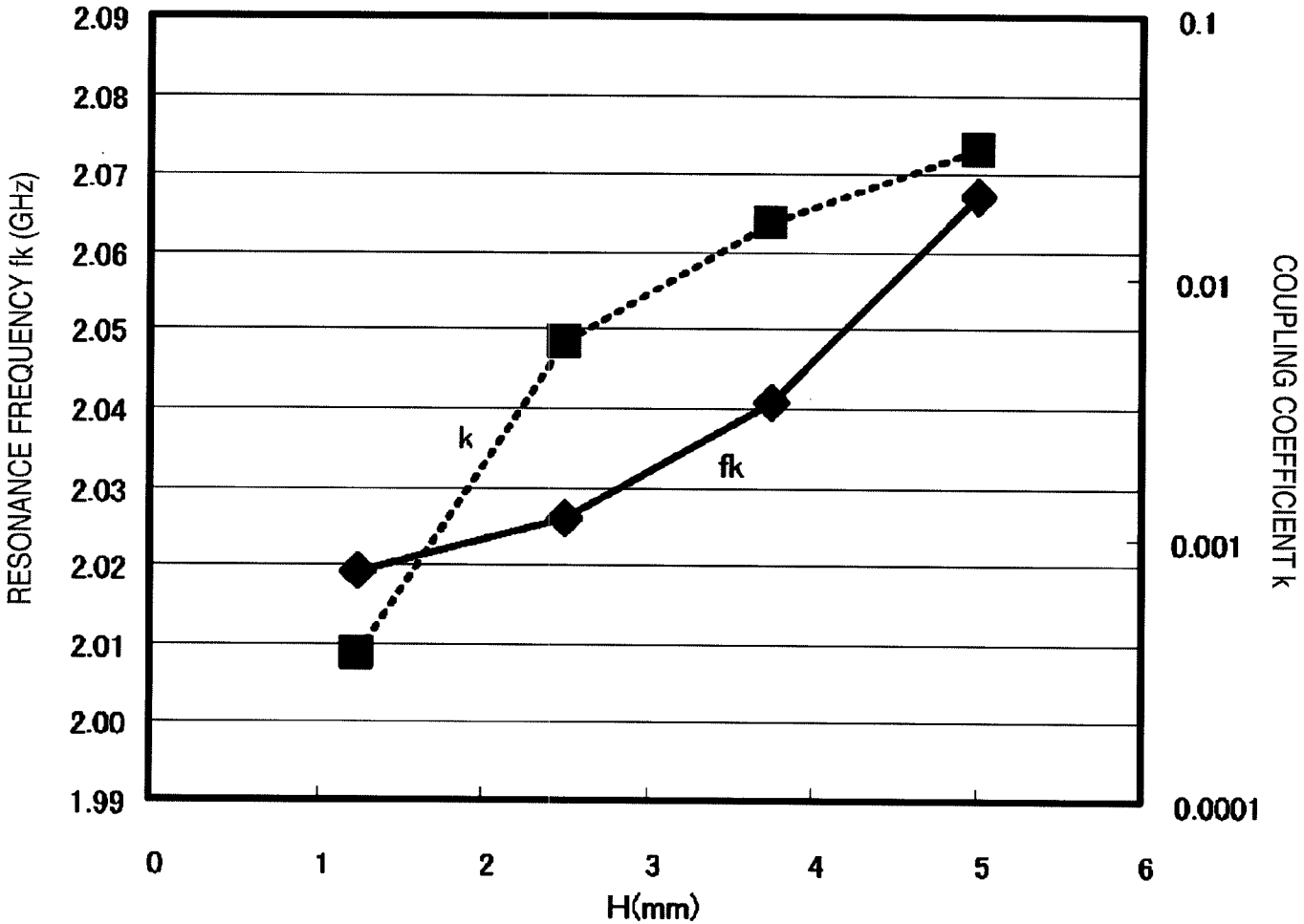
FIG. 26 is a graph showing the notched portion depth dependency of a resonance frequency and a coupling coefficient in the dielectric resonator according to Modification 4.

A case (Modification 4) where, in the first embodiment, notched portion 12A is formed to have a groove shape (semicolumnar shape) in the diameter direction of dielectric resonant element 12 will be described. FIG. 24 is a plan view showing dielectric resonant element 12 according to Modification 4. In Modification 4, notched portion 12A is a groove having a semicircular side surface and is arranged in the diameter direction of dielectric resonant element 12. FIG. 25 is a graph showing the correspondence relationship between the frequency and the attenuation state of an electrical signal when the height H of notched portion 12A of dielectric resonator 20 is changed according to Modification 4. In the graphs G41 to G44, the height H is 1.25, 2.50, 3.75, and 5.00 mm, respectively. FIG. 26 is a graph showing the relationship between the height H, the resonance frequency fk, and the coupling coefficient k. As compared with Modification 1, the change in the resonance frequency fk depending on the height H is large, and the coupling coefficient k is changed in the substantially same range.

E. Modification 5

Figure 27:
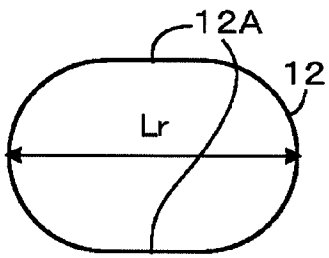
FIG. 27 is a plan view of a dielectric resonator according to Modification 5.
Figure 28:
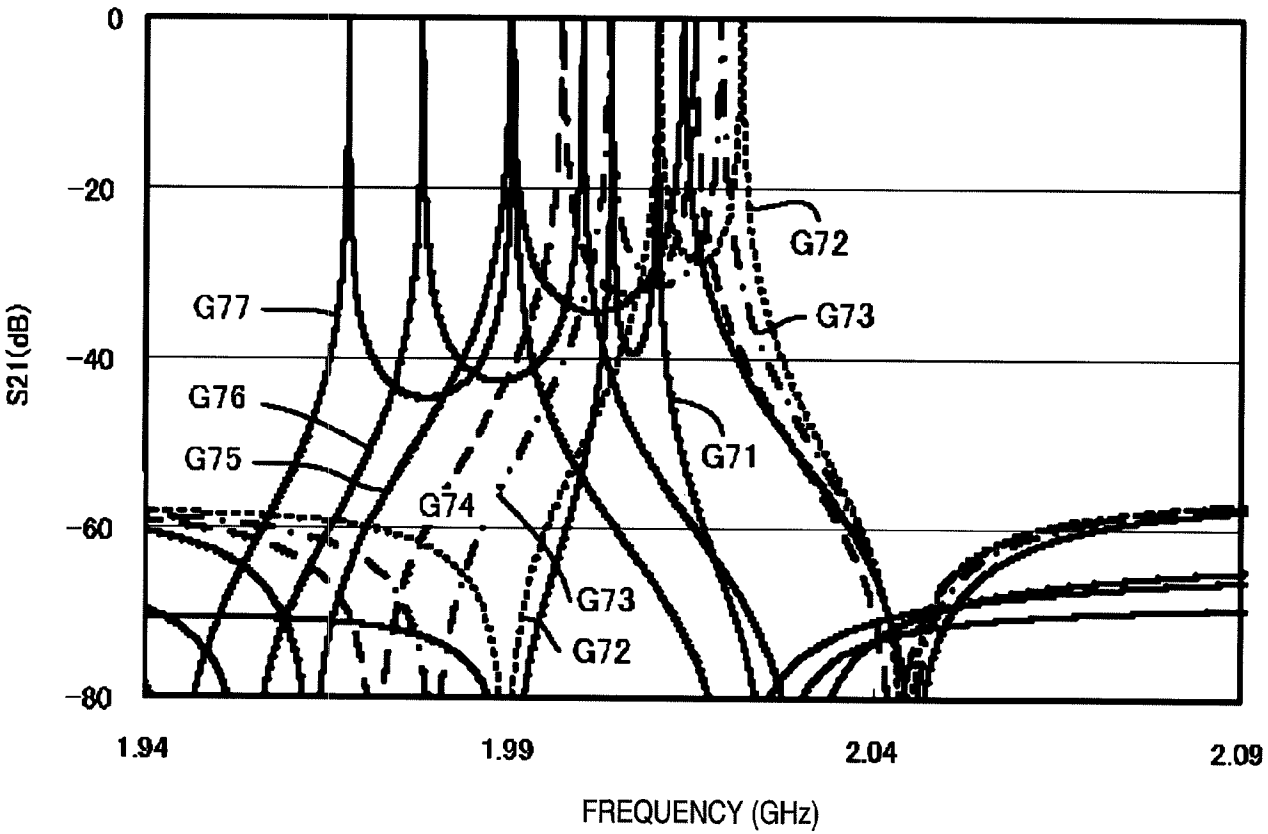
FIG. 28 is a graph showing the attenuation state of an electrical signal in the dielectric resonator according to Modification 5.
Figure 29:
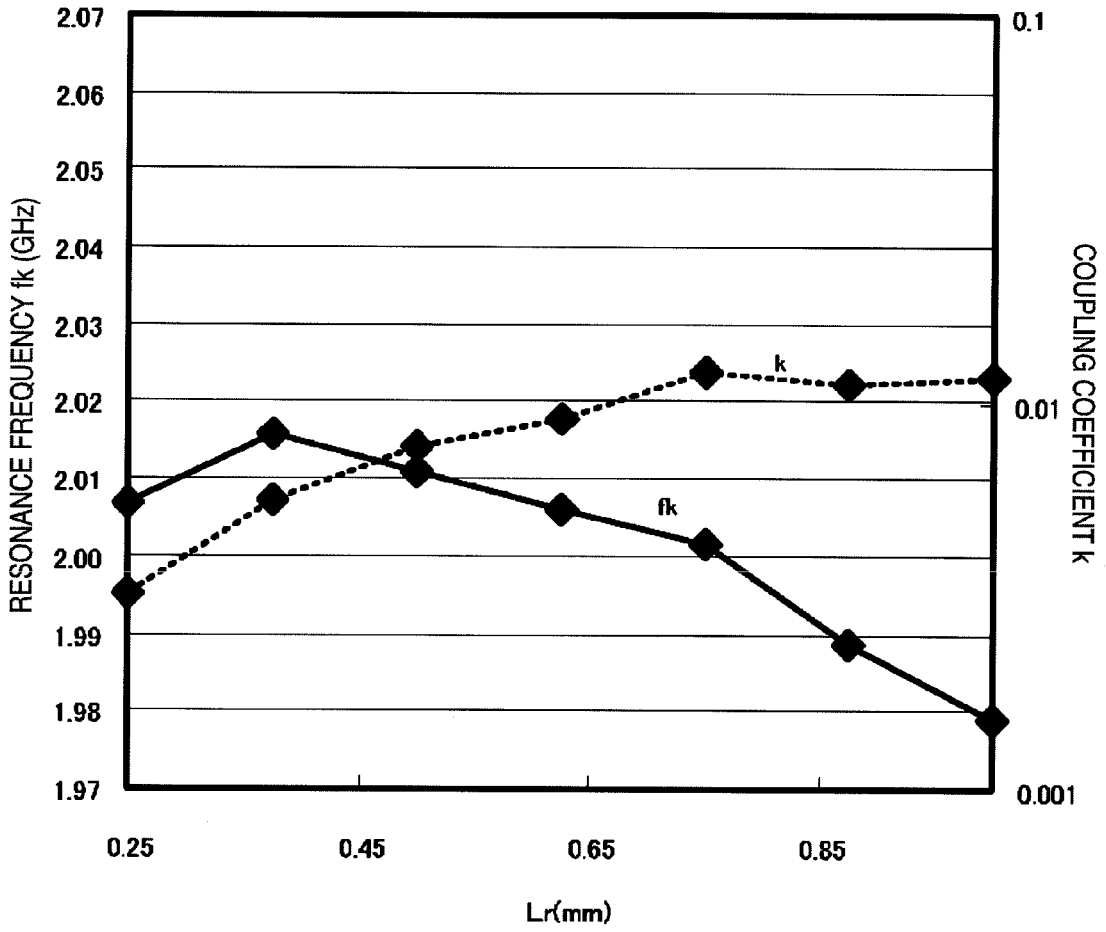
FIG. 29 is a graph showing the length dependency of a resonance frequency and a coupling coefficient in the dielectric resonator according to Modification 5.

A case (Modification 5) where, in the first embodiment, dielectric resonant element 12 is formed to have an elliptical shape will be described. FIG. 27 is a top view showing dielectric resonant element 12 according to Modification 5. In Modification 5, dielectric resonant element 12 has an elliptical prism shape, and notched portions 12A are arranged on both side surfaces of dielectric resonant element 12 in the longitudinal direction. FIG. 28 is a graph showing the correspondence relationship between the frequency and the attenuation state of an electrical signal when the length Lr of the ellipse of dielectric resonator 20 in Modification 5 is changed. In the graphs G71 to G77, the length Lr is 0.25, 0.375, 0.5, 0.625, 0.75, 0.875, and 1.0 mm, respectively. FIG. 29 is a graph showing the correspondence relationship between the length Lr, the resonance frequency fk, and the coupling coefficient k. As compared with Modification 1, the resonance frequency fk is shifted to a low frequency, and the amount of change in the coupling coefficient k is reduced.

F. Modification 6

Figure 30:
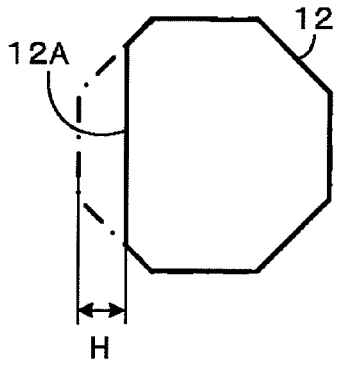
FIG. 30 is a plan view of a dielectric resonator according to Modification 6.
Figure 31:
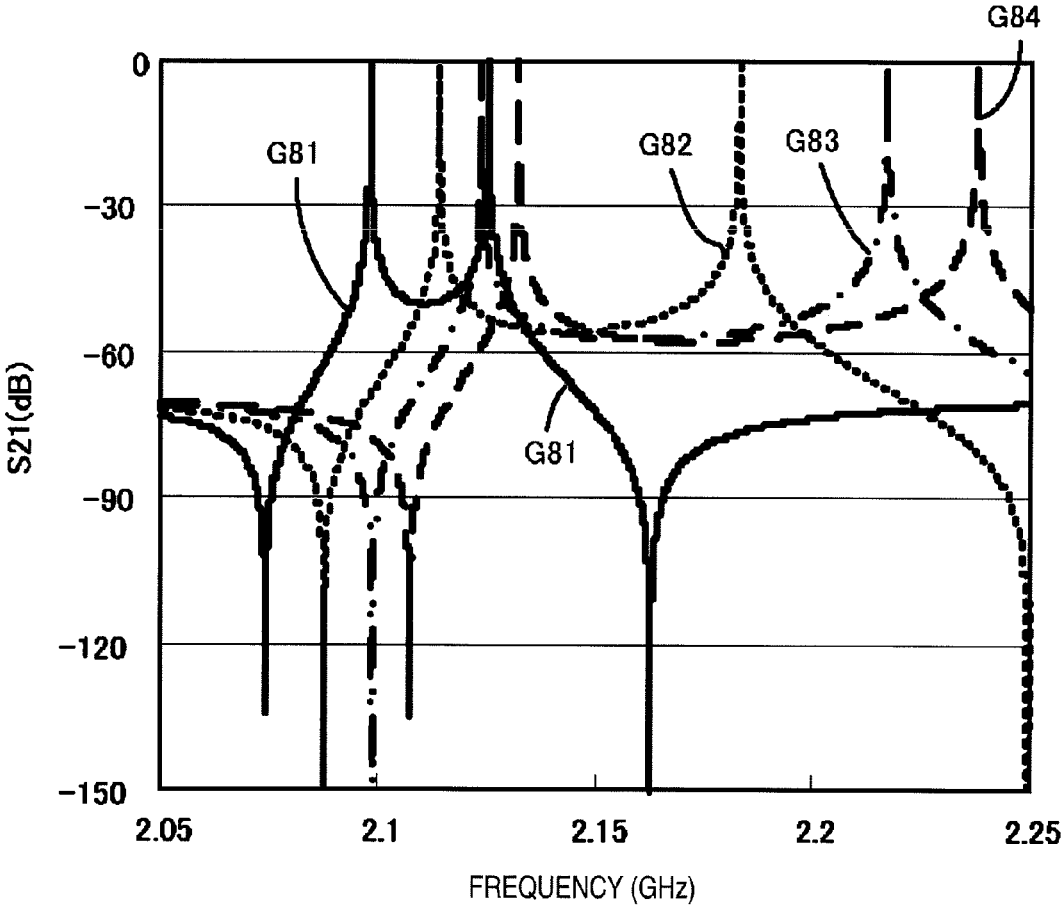
FIG. 31 is a graph showing the attenuation state of an electrical signal in the dielectric resonator according to Modification 6.
Figure 32:
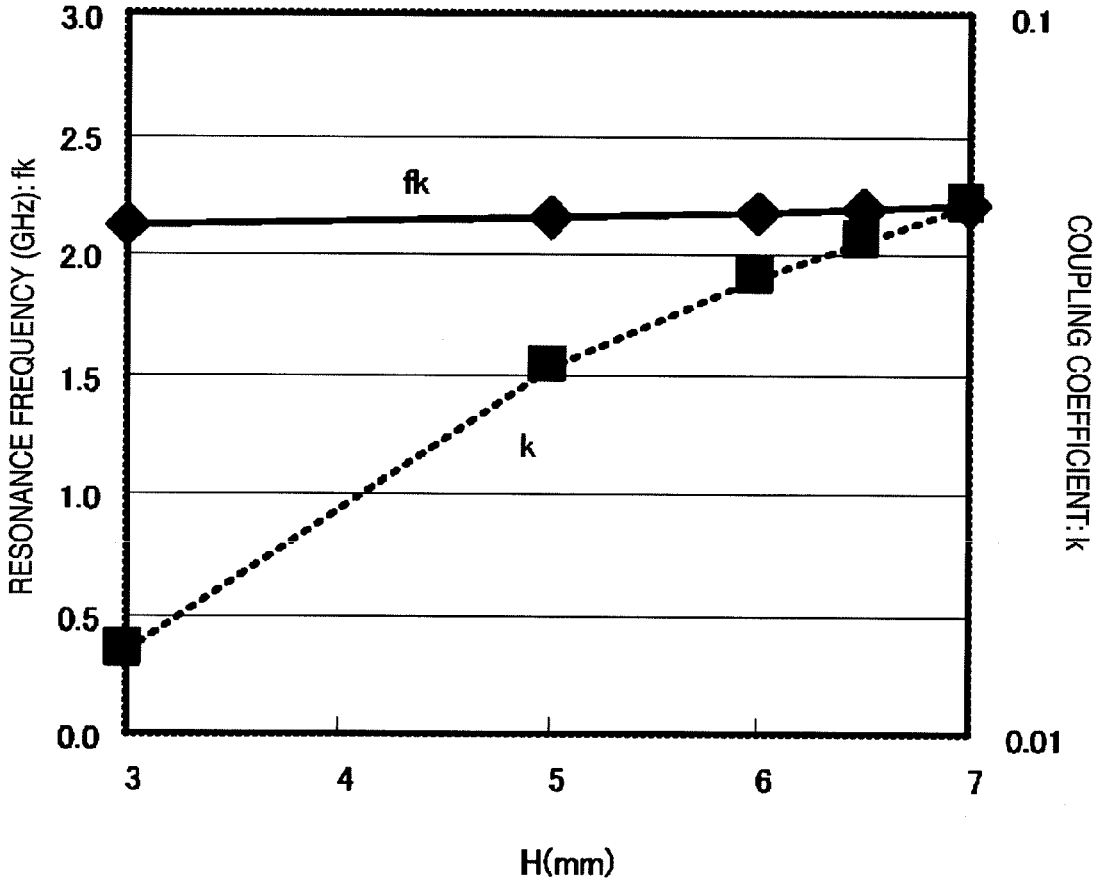
FIG. 32 is a graph showing the notched portion depth dependency of a resonance frequency and a coupling coefficient in the dielectric resonator according to Modification 6.

A case (Modification 6) where, in the first embodiment, dielectric resonant element 12 is formed to have a regular octagonal shape will be described. FIG. 30 is a top view showing dielectric resonant element 12 according to Modification 6. In Modification 6, dielectric resonant element 12 has a regular octagonal prism shape, and notched portion 12A is arranged along one side of dielectric resonant element 12. FIG. 31 is a graph showing the correspondence relationship between the frequency and the attenuation state of an electrical signal when the height H of notched portion 12A in Modification 6 is changed. In the graphs G81 to G84, the height H is 3, 5, 6, and 6.5 mm, respectively. FIG. 32 is a graph showing the relationship between the height H, the resonance frequency fk, and the coupling coefficient k. If the height H is changed in the range of 3 to 6.5 mm, the resonance frequency fk is changed in the range of 2.015 to 2.035 GHz, and the coupling coefficient k is changed in the range of 0.01 to 0.1.

Although the invention has been described in detail with reference to the specific examples, the invention is not limited to the above-described contents, and various modifications or changes may be made without departing from the scope of the invention.

As described above, the dielectric resonator and the notched portion may have various shapes. As described in the embodiments, the dielectric resonator may be a column, an elliptical column, or a regular octagonal prism. An intermediate shape, for example, a rectangular prism may be used. A plate, instead of a column, may be used. As described in the foregoing embodiments, the notched portion may have various shapes, such as a flat plate, a groove, and the like.

Although in the foregoing specific examples, the dielectric resonant element piece is arranged at a location where the attenuation effect of the external conductor is produced, even if the dielectric resonant element piece is arranged at a location where the attenuation effect is not necessarily produced, the resonance state (coupling mode) can be sufficiently controlled by appropriately controlling the position and size of the notched portion in the dielectric resonant element. Meanwhile, as described above, if the dielectric resonant element piece is arranged at a location where the attenuation effect is produced, the resonance state (coupling mode) can be more easily and effectively controlled.

The specific examples are based on several simulations or the experiment results based on the simulations. Actually, the specific guideline regarding how much the size of the notched portion of the dielectric resonant element is adjusted differs depending on the configuration of the dielectric resonator. For example, in the dielectric resonator having the electrical signal input section and the electrical signal output section arranged as in the first embodiment and the dielectric resonator having the electrical signal input section and the electrical signal output section arranged as in the second embodiment, the dependency of the resonance state (coupling mode) on the sizes of the dielectric resonant element and the notched portion entirely differs.

Therefore, specific setting should be carried out uniquely for an individual dielectric resonator having specific configuration. Meanwhile, similarly to the related art, the selection of the size (height and diameter) of the dielectric resonant element with respect to the external conductor forms the basis.

Although in the foregoing specific examples, only a case where a dielectric resonator has a cylindrical external conductor has been described, a dielectric resonator having a polygonal external conductor can obtain the same advantages.

The invention is not intended to exclude the configuration in which a metal screw or a resin screw is provided in an external conductor toward a dielectric resonant element without hampering the advantages according to the notched portion of the invention.

The electrical signal input section or the electrical signal output section and the dielectric resonator may not be capacitively coupled, but may be inductively coupled. In any cases, the advantages of the invention can be obtained insofar as the above-described requirements of the invention are satisfied.

Fourth Embodiment

Hereinafter, a fourth embodiment of the invention will be described.

Figure 33:
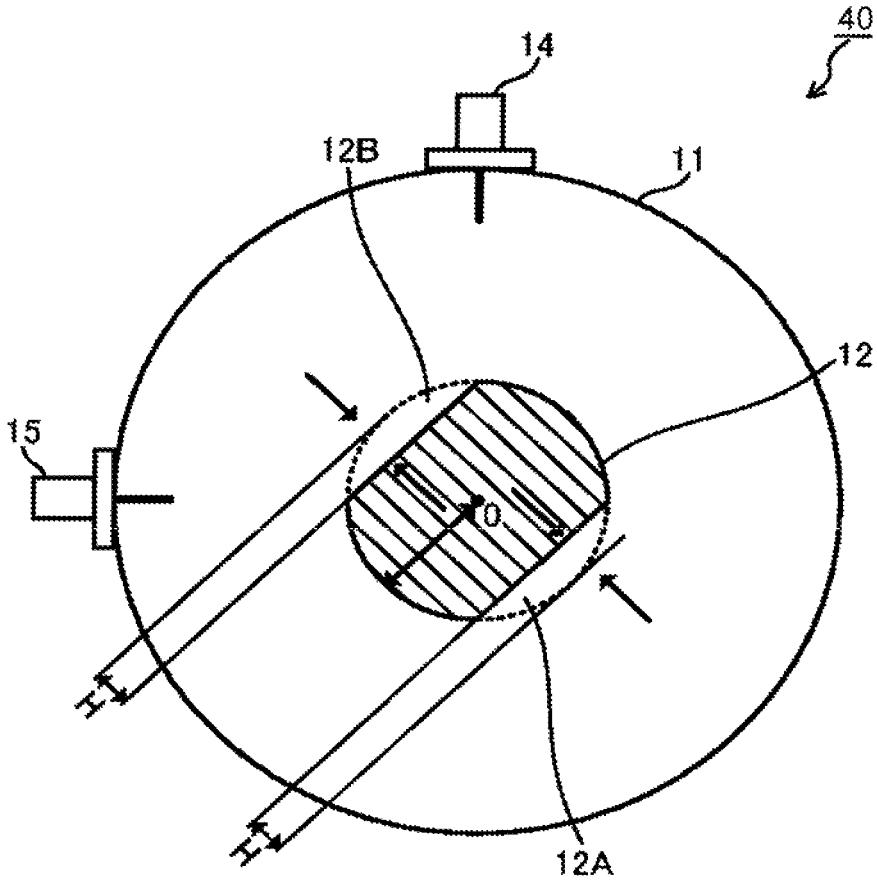
FIG. 33 is a plan view of a dielectric resonator according to an embodiment of the invention.
Figure 34:
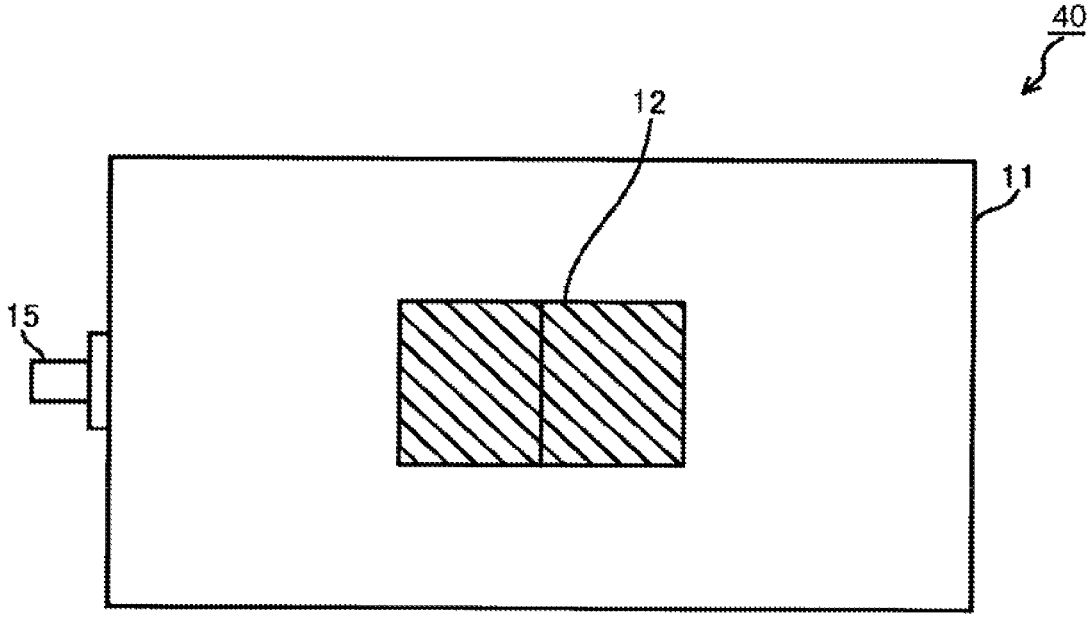
FIG. 34 is a side view of the dielectric resonator shown in FIG. 33.
Figure 35:
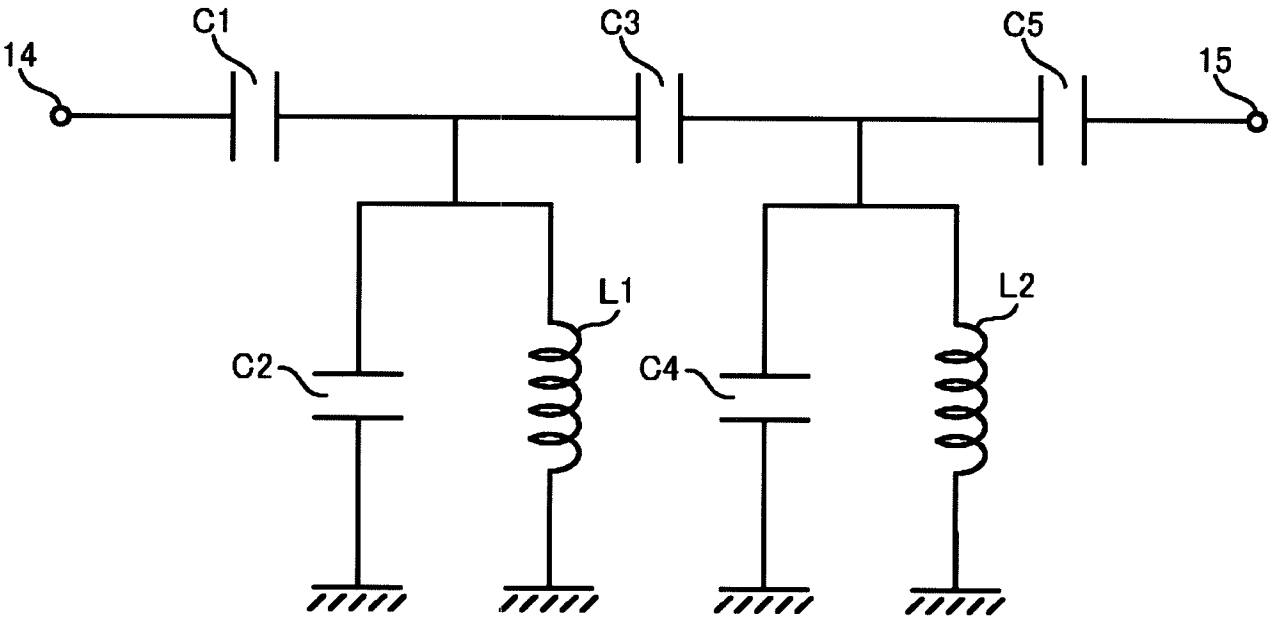
FIG. 35 is an equivalent circuit of the dielectric resonator shown in FIGS. 33 and 34.

FIG. 33 is a plan view of a dielectric resonator according to this embodiment. FIG. 34 is a side view of the dielectric resonator shown in FIG. 33. FIG. 35 is an equivalent circuit of the dielectric resonator shown in FIGS. 33 and 34.

As shown in FIGS. 33 and 34, dielectric resonator 40 according to this embodiment includes cylindrical external conductor 11, columnar dielectric resonant element 12 arranged at the substantially center O of external conductor 11, and electrical signal input section 14 and electrical signal output section 15 arranged on the circumferential surface of external conductor 11 at an angle of 90 degrees. Dielectric resonant element 12 is arranged on a support board (not shown) made of, for example; alumina or the like. Dielectric resonant element 12 is arranged at the substantially center O of external conductor 11, so the substantially center O is in common with the center of dielectric resonant element 12.

Dielectric resonant element 12 is provided with a pair of notched portions 12A and 12B which are formed by grinding dielectric resonant element 12 vertically along a height direction so as not to be opposite electrical signal input section 14 and electrical signal output section 15 provided in dielectric resonator 40. As a result, dielectric resonant element 12 has two sections perpendicular to the height direction and parallel to each other due to two notched portions 12A and 12B.

In FIG. 35, reference numeral C1 denotes a capacitive coupling circuit which is capacitively coupled to the resonance circuit of electrical signal input section 14 and dielectric resonator 40. Reference numeral C5 is a capacitive coupling circuit which is capacitively coupled to the resonance circuit of electrical signal output section 15 and dielectric resonator 40. Reference numerals C2 and L1, and reference numerals C4 and L2 respectively denote a capacitive coupling circuit and inductance constituting the resonance circuit of dielectric resonator 40. Reference numeral C3 denotes interstage coupling capacitance formed by notched portions 12A and 12B.

In FIG. 35, capacitive coupling circuits C1 and C5 are changed depending on the materials and sizes of electrical signal input section 14 and electrical signal output section 15. In FIG. 35, capacitive coupling circuits C2 and C4 and inductance L1 and L2 are changed depending on the materials and the like of notched portions 12A and 12B and external conductor 11.

According to this embodiment, it is considered that notched portions 12A and 12B are particularly provided so as to cause changes in the values of capacitive coupling circuits C2 and C4 and the value of C3, and to cause changes in the values of inductance L1 and L2, which leads to a change in the resonance state (coupling mode).

Figure 36:
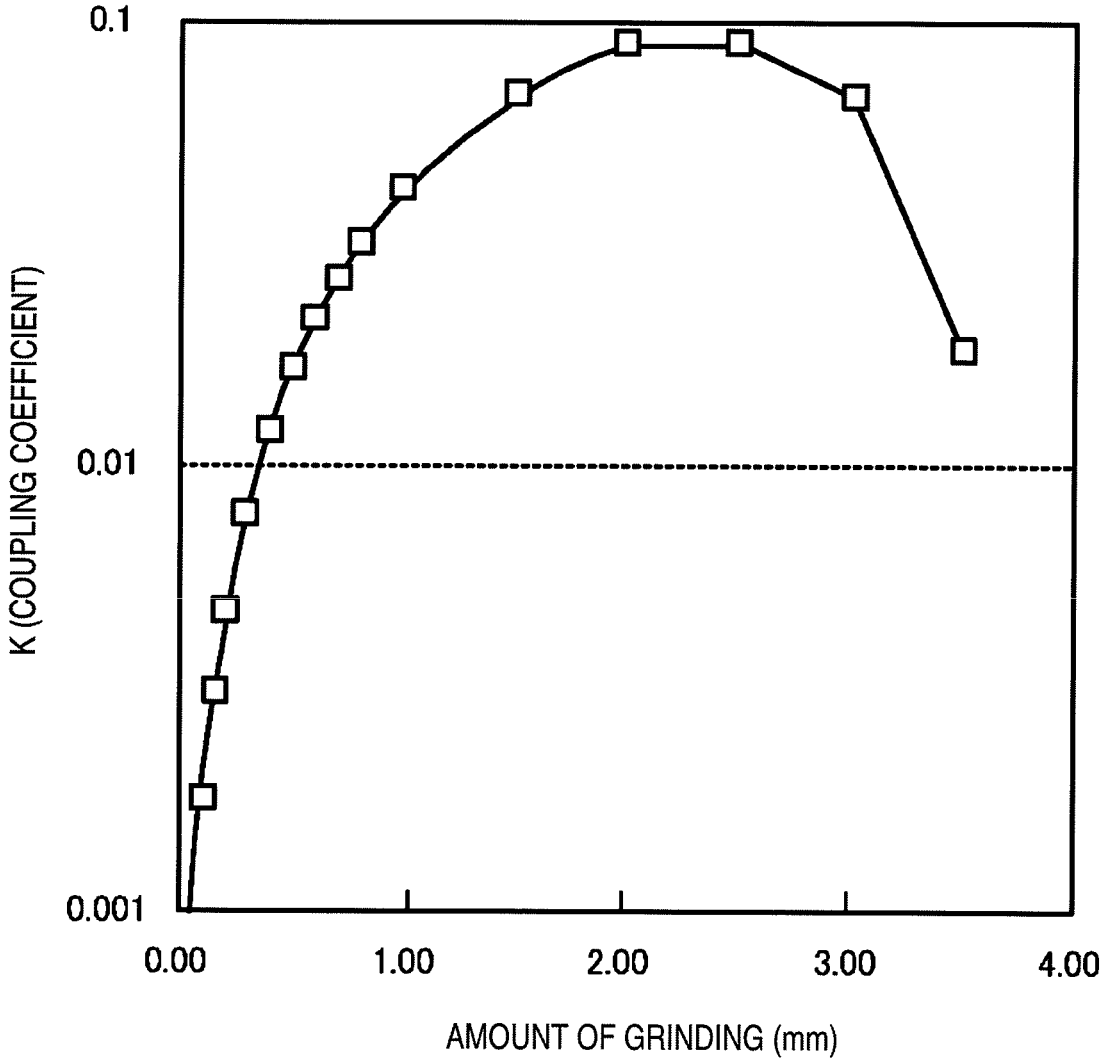
FIG. 36 is a diagram showing the examination result of the correlation between the depth of a notched portion of a dielectric resonator and a coupling coefficient of two EH modes (EH1 and EH2) introduced into the dielectric resonator according to an embodiment of the invention.

FIG. 36 is a diagram showing the examination result of the correlation between the sizes (depth H) of notched portion 12A and 12B of dielectric resonator 40 and two EH modes (EH1 and EH2) introduced into dielectric resonator 40 according to this embodiment. As will be apparent from FIG. 36, it can be seen that, when the depth H of notched portions 12A and 12B, that is, the amount of grinding is in the range of 1.5 to 3 mm, the coupling coefficient indicates a peak. That is, in dielectric resonator 40 shown in FIG. 33, it can be seen that, if the depth H of notched portions 12A and 12B is in the range of 1.5 to 3 mm, the coupling coefficient of the two EH modes (EH1 and EH2) introduced into dielectric resonator 40 is approximately maximized, and thus a predetermined resonance state is realized.

On the assumption that the graph shown in FIG. 36 is obtained, the diameter of dielectric resonant element 12 was 37 mm.

A. Modification 1

Figure 37:
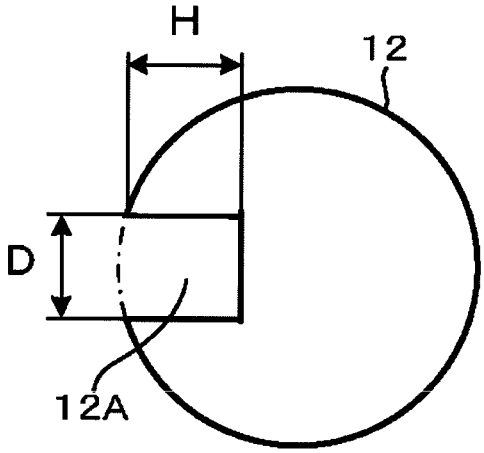
FIG. 37 is a plan view of a dielectric resonator according to Modification 1.
Figure 38:
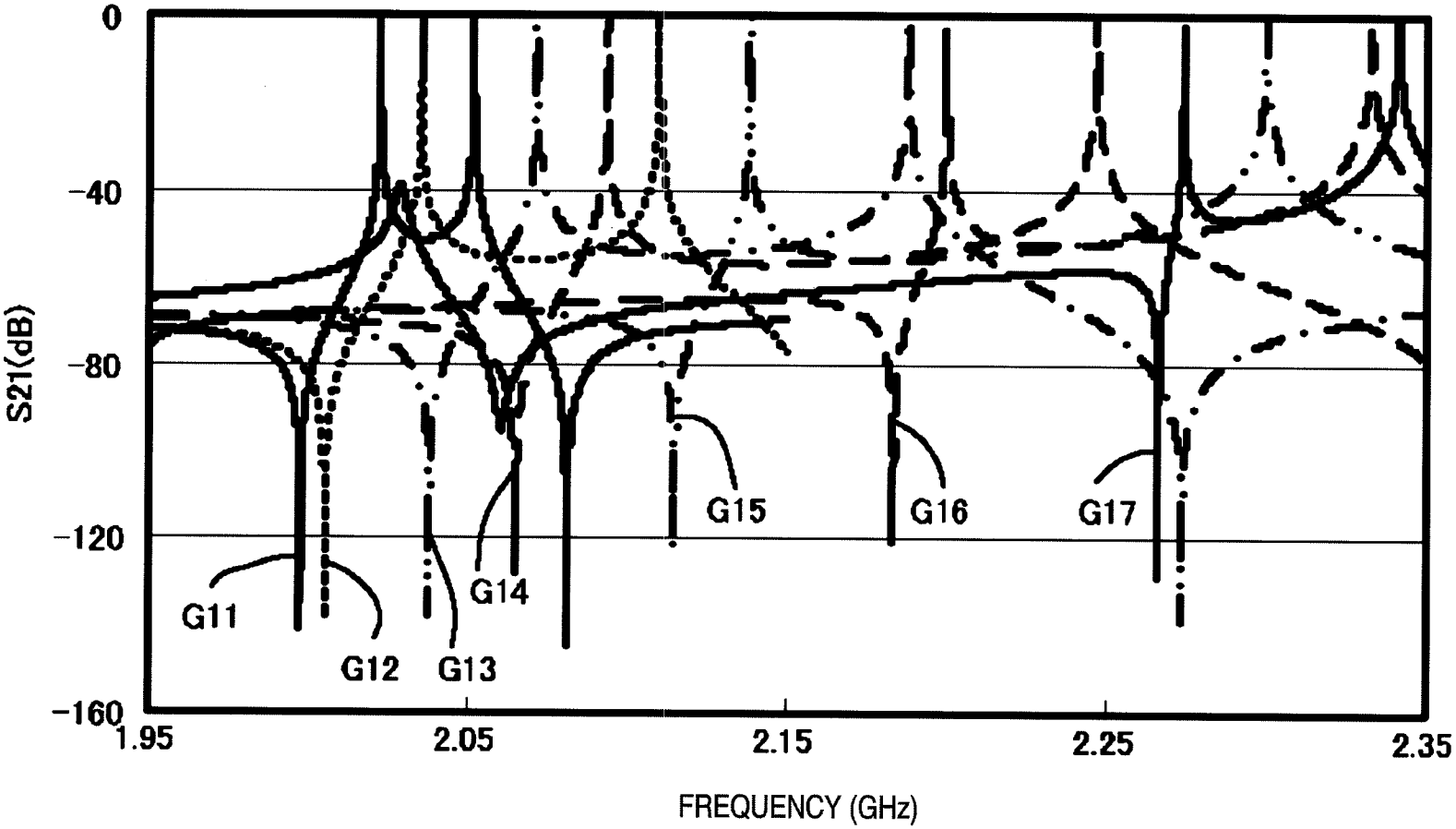
FIG. 38 is a graph showing the attenuation state of an electrical signal in the dielectric resonator according to Modification 1.
Figure 39:
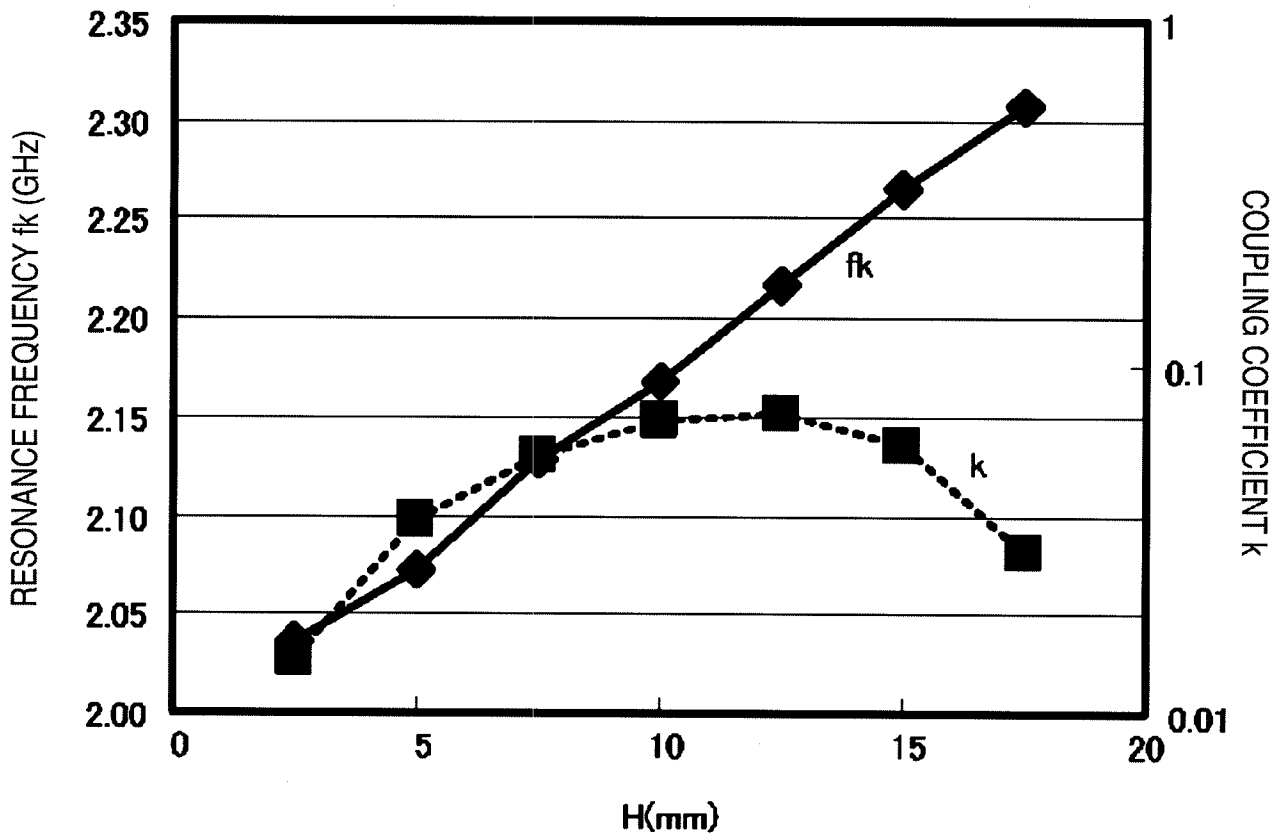
FIG. 39 is a graph showing the notched portion depth dependency of a resonance frequency and a coupling coefficient in the dielectric resonator according to Modification 1.

A case (Modification 1) where, in the fourth embodiment, notched portion 12A is formed to have a groove shape in the axial direction of dielectric resonant element 12 will be described. FIG. 37 is a plan view showing dielectric resonant element 12 according to Modification 1. In Modification 1, notched portion 12A is a substantially cuboid groove having one bottom surface and two side surfaces, and is arranged in the axial direction of dielectric resonant element 12. FIG. 38 is a graph showing the correspondence relationship between the frequency and the attenuation state of an electrical signal when the height H of notched portion 12A of dielectric resonator 20 in Modification 1 is changed. In the graphs G11 to G17, the width D is 5 mm, and the height H is 2.5, 5.0, 7.5, 10.0, 12.5, 15.0, and 17.5 mm, respectively. FIG. 39 is a graph showing the relationship between the height H, the resonance frequency fk, and the coupling coefficient k. If the height H increases, the resonance frequency fk increases, and the coupling coefficient k has a peak (is saturated).

B. Modification 2

Figure 40:
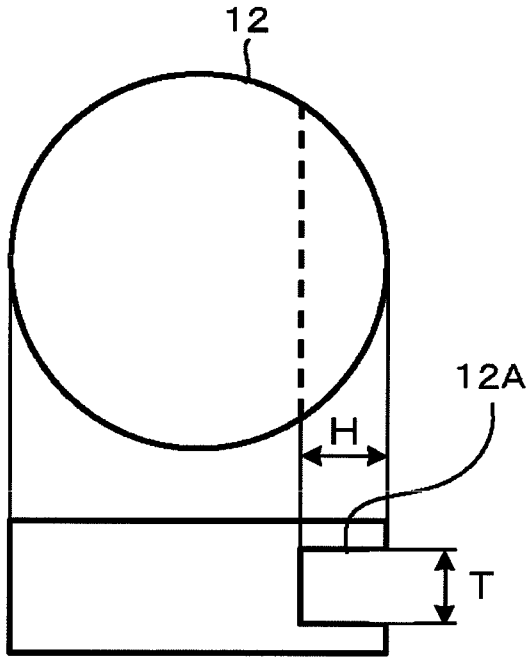
FIG. 40 is a plan view of a dielectric resonator according to Modification 2.
Figure 41:
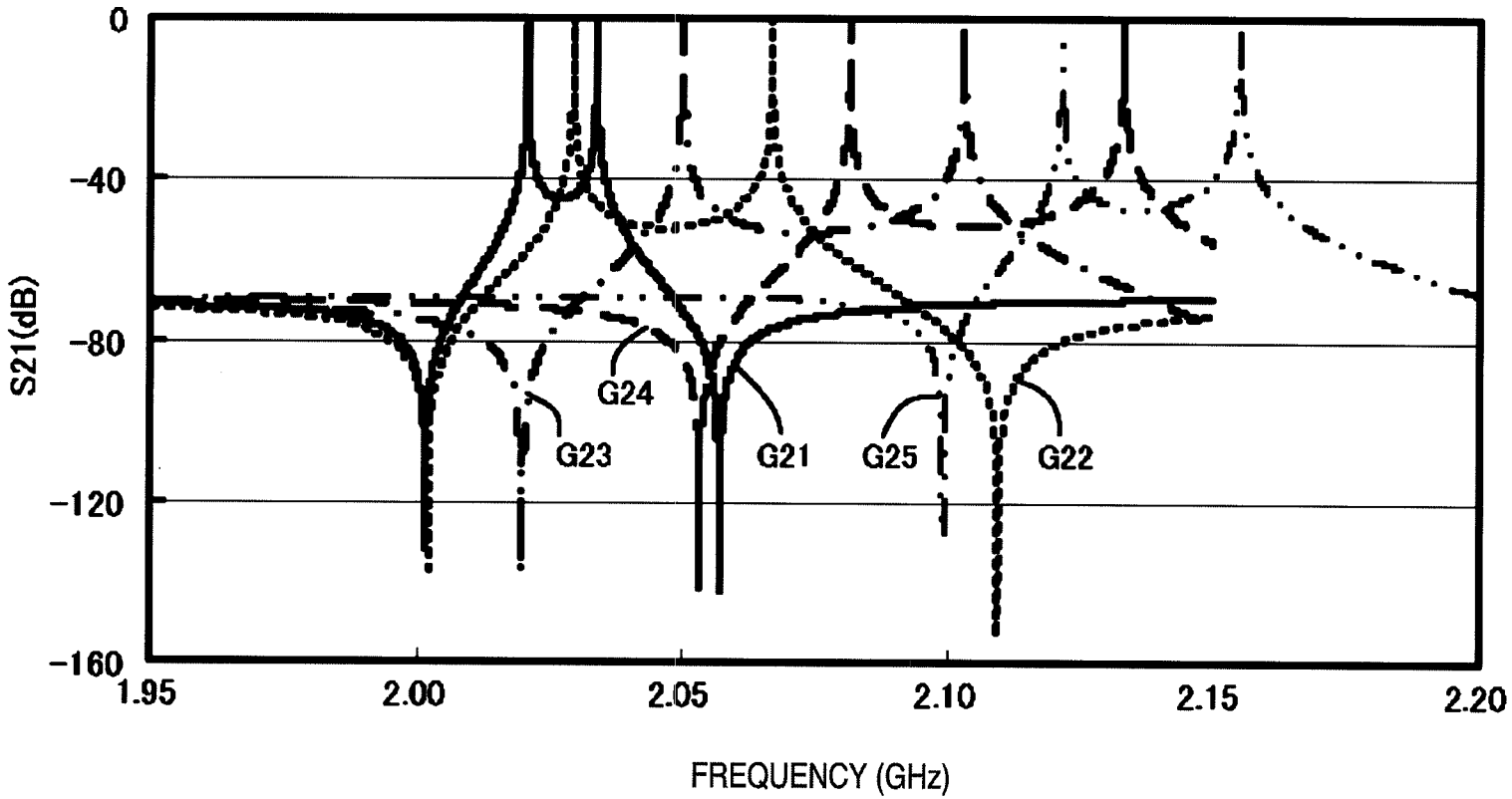
FIG. 41 is a graph showing the attenuation state of an electrical signal in the dielectric resonator according to Modification 2.
Figure 42:
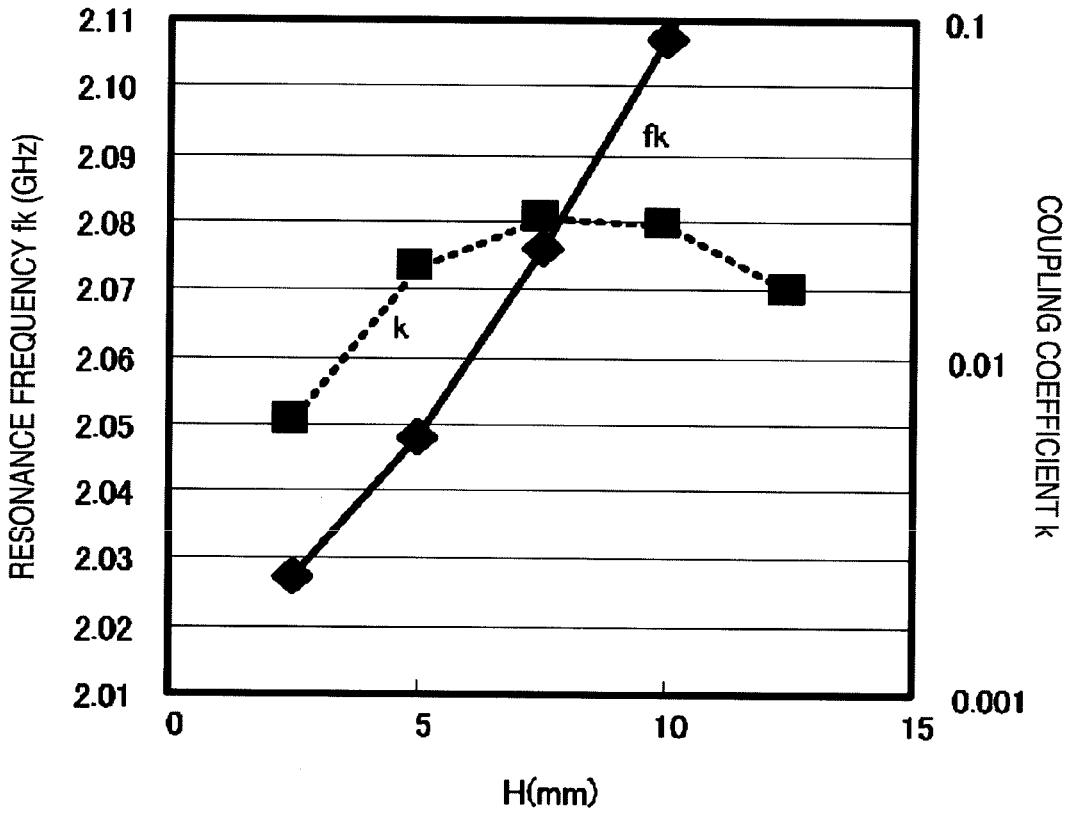
FIG. 42 is a graph showing the notched portion depth dependency of a resonance frequency and a coupling coefficient in the dielectric resonator according to Modification 2.

A case (Modification 2) where, in the fourth embodiment, notched portion 12A is formed to have a groove shape in the axial direction of dielectric resonant element 12 will be described. FIG. 40 is a plan view showing dielectric resonant element 12 according to Modification 3. In Modification 2, notched portion 12A is a substantially cuboid groove having one bottom surface and two side surfaces, and is arranged in the diameter direction of dielectric resonant element 12. FIG. 41 is a graph showing the correspondence relationship between the frequency and the attenuation state of an electrical signal when the height H of notched portion 12A of dielectric resonator 20 in Modification 2 is changed. In the graphs G21 to G25, the thickness T is 2 mm, and the height H is 2.5, 5.0, 7.5, 10.0, and 12.5 mm, respectively. FIG. 42 is a graph showing the relationship between the height H, the resonance frequency fk, and the coupling coefficient k. If the height H increases, the resonance frequency fk increases, and the coupling coefficient k has a peak (is saturated).

C. Modification 3

Figure 43:
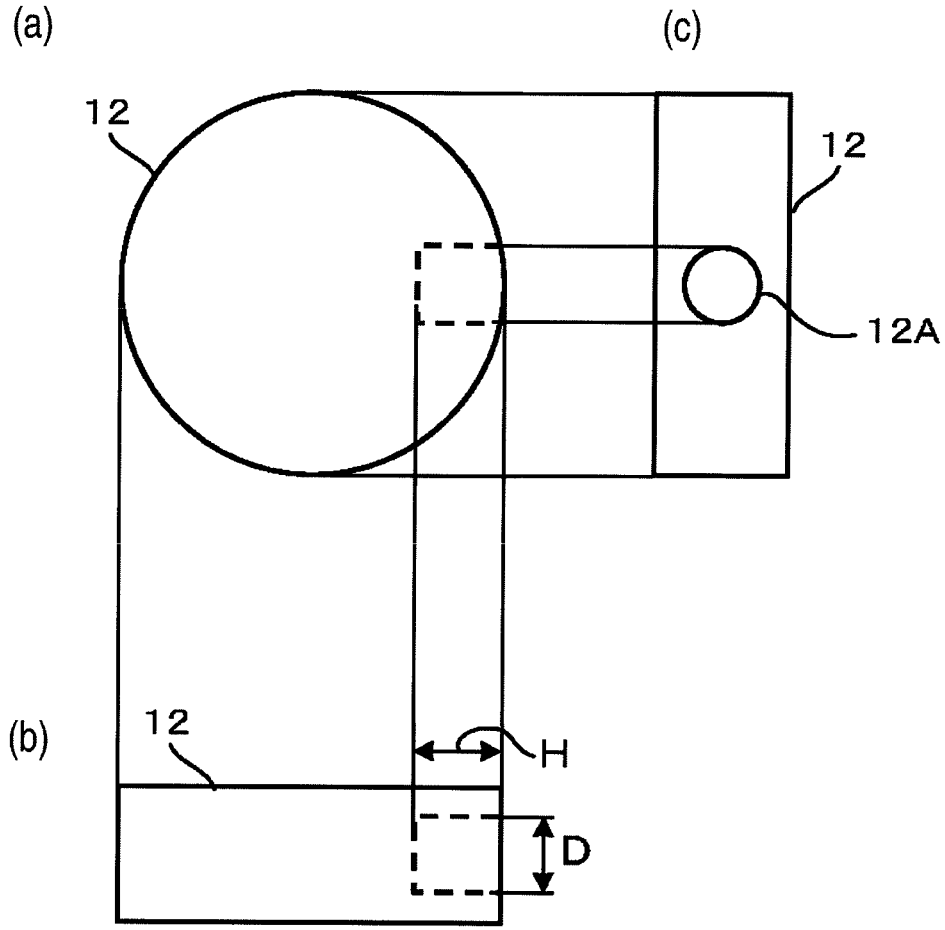
FIG. 43 is a plan view of a dielectric resonator according to Modification 3.
Figure 44:
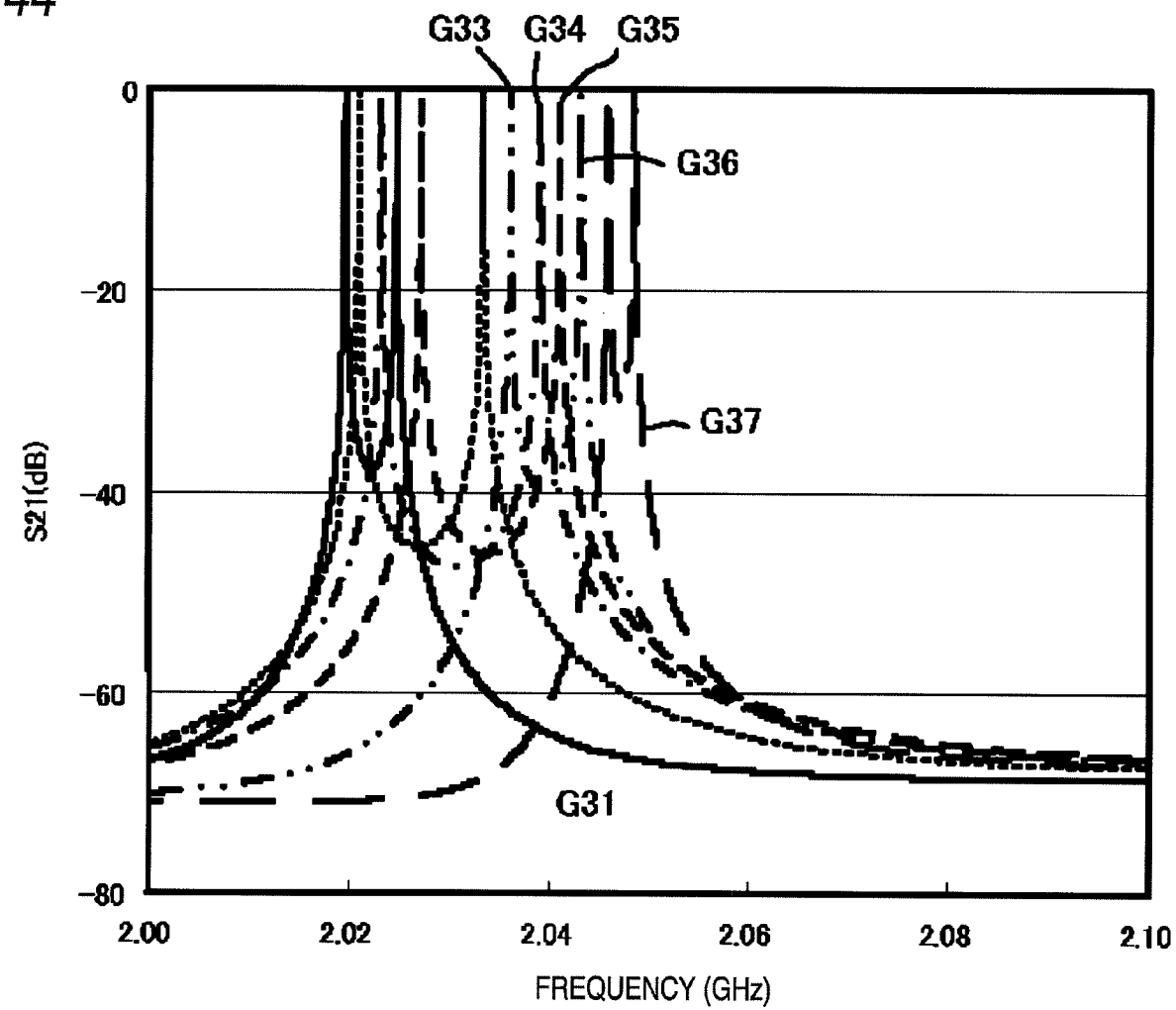
FIG. 44 is a graph showing the attenuation state of an electrical signal in the dielectric resonator according to Modification 3.
Figure 45:
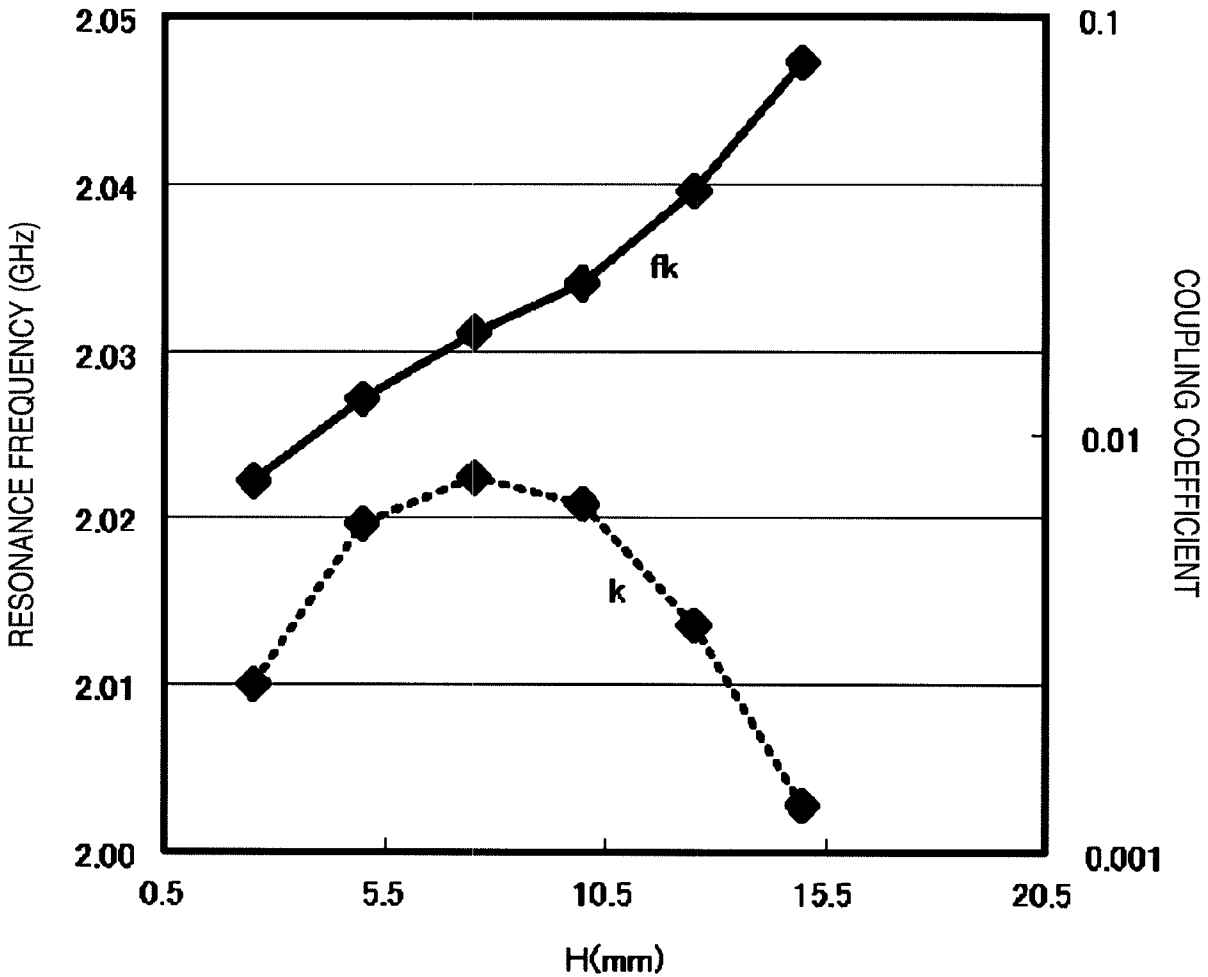
FIG. 45 is a graph showing the notched portion depth dependency of a resonance frequency and a coupling coefficient in the dielectric resonator according to Modification 3.

A case (Modification 3) where, in the fourth embodiment, notched portion 12A is formed to have a groove shape (columnar) on the side surface of dielectric resonant element 12 and to have a groove shape in the diameter direction toward the center of dielectric resonant element 12 will be described. FIG. 43 is a top view and a side view showing dielectric resonant element 12 according to Modification 3. In Modification 3, notched portion 12A is a columnar groove having a circular side surface, and is arranged in the diameter direction toward the center of dielectric resonant element 12. FIG. 44 is a graph showing the correspondence relationship between the frequency and the attenuation state of an electrical signal when the height H and diameter D of notched portion 12A of dielectric resonator 40 in Modification 3 are changed. In the graphs G31 to G37, the diameter D is 2 mm, and the height H is 2.5, 5.0, 7.5, 10.0, and 12.5 mm, respectively. FIG. 45 is a graph showing the relationship between the height H, the resonance frequency fk, and the coupling coefficient k. If the height H increases, the resonance frequency fk increases, and the coupling coefficient k has a peak (is saturated).

D. Modification 4

Figure 46:
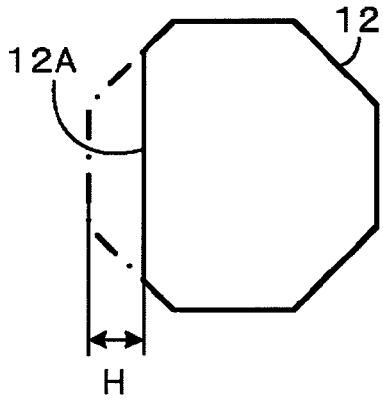
FIG. 46 is a plan view of a dielectric resonator according to Modification 4.
Figure 47:
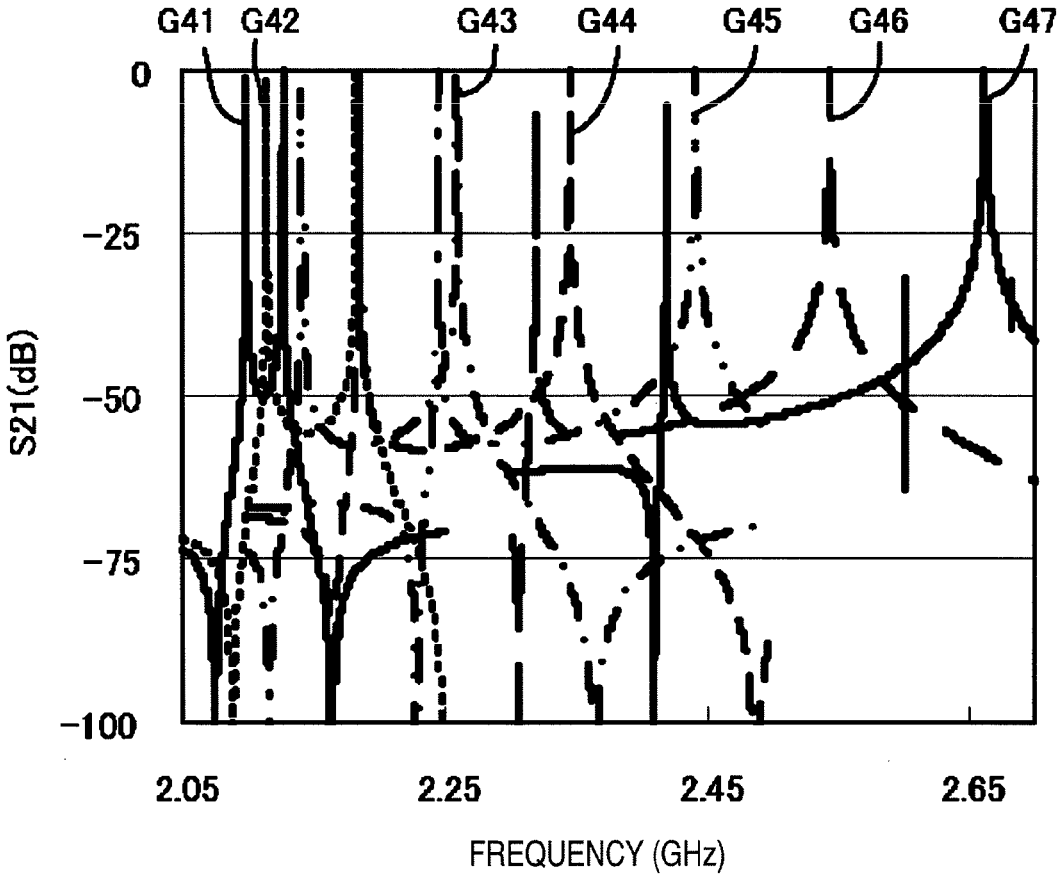
FIG. 47 is a graph showing the attenuation state of an electrical signal in the dielectric resonator according to Modification 4.
Figure 48:
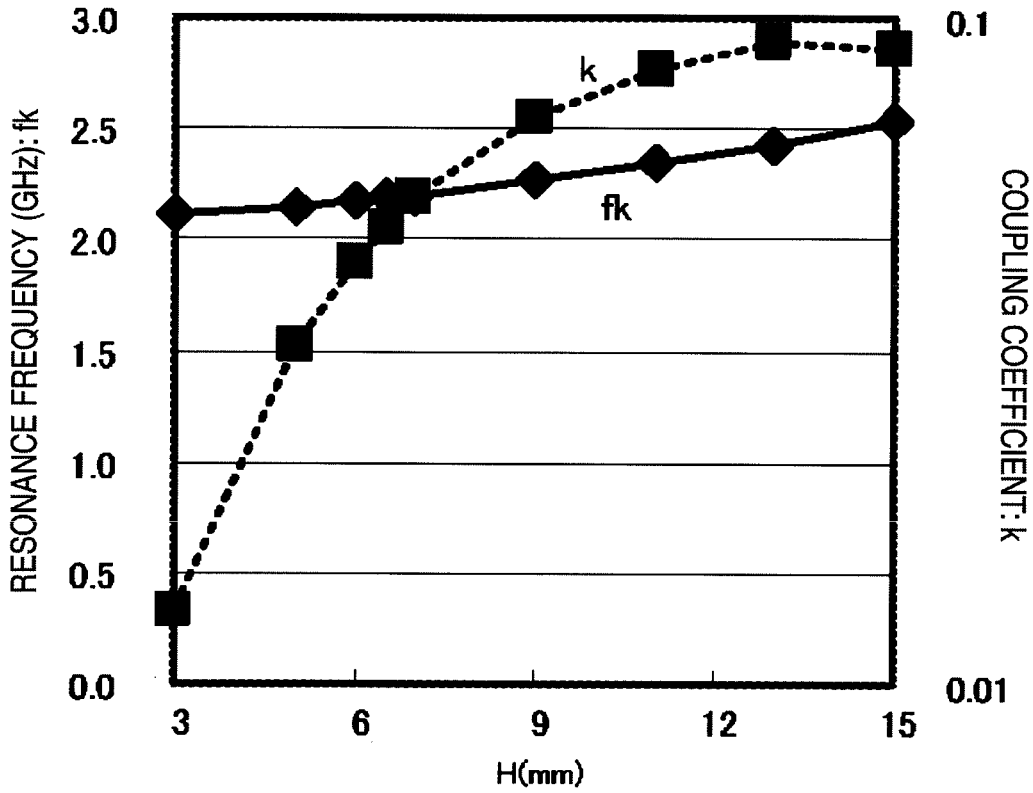
FIG. 48 is a graph showing the notched portion depth dependency of a resonance frequency and a coupling coefficient in the dielectric resonator according to Modification 4.

A case (Modification 8) where, in the fourth embodiment, dielectric resonant element 12 is formed to have a regular octagonal shape will be described. FIG. 46 is a top view showing dielectric resonant element 12 according to Modification 8. In Modification 8, dielectric resonant element 12 has a regular octagonal prism shape, and notched portion 12A is arranged along one side of dielectric resonant element 12. FIG. 47 is a graph showing the correspondence relationship between the frequency and the attenuation state of an electrical signal when the height H of notched portion 12A in Modification 4 is changed. In the graphs G41 to G47, the height H is 3, 5, 7, 9, 11, 13, and 15 mm, respectively. FIG. 48 is a graph showing the relationship between the height H, the resonance frequency fk, and the coupling coefficient k. If the height H increases, the resonance frequency fk increases, and the coupling coefficient k has a peak (is saturated).

(Cause of Peak Occurrence)

Figure 49:
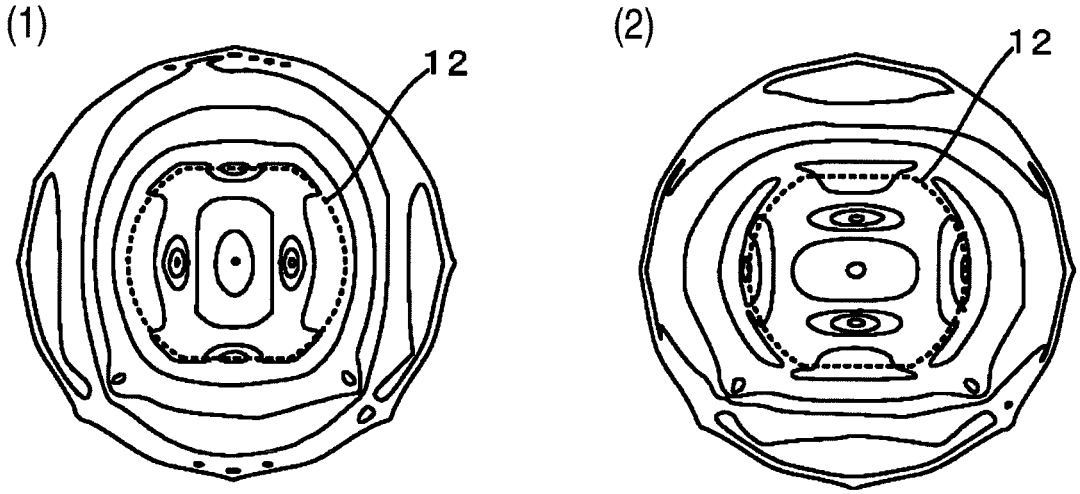
FIG. 49 is a schematic view showing the electric field distribution in the dielectric resonator.
Figure 50:
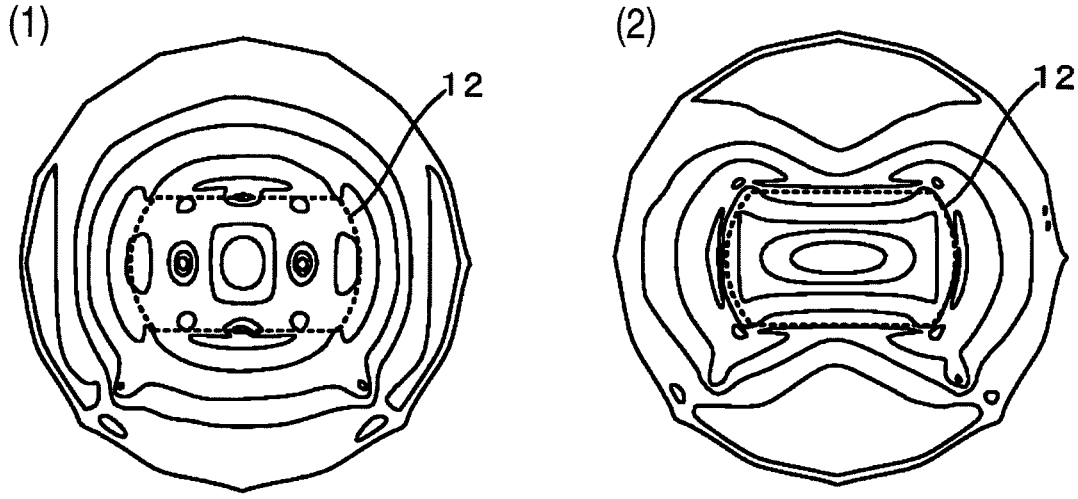
FIG. 50 is a schematic view showing the electric field distribution in the dielectric resonator.

The reason why the coupling coefficient k has a peak will be described. FIGS. 49 and 50 are schematic views showing the electric field distribution in dielectric resonator 40 at H=2.5 and 5.0, respectively. In FIGS. 49 and 50, (1) and (2) indicate the electric distribution of two modes in the diameter direction of dielectric resonant element 12. It transpires that an increase in the height H (amount of grinding) causes a change in the electric field distribution, that is, a change in the resonance mode. It is considered that the change causes the peak of the coupling coefficient k.

Although the invention has been described in detail with reference to the specific examples, the invention is not limited to the above-described contents, and various modifications or changes may be made without departing from the scope of the invention.

As described above, the dielectric resonator and the notched portion may have various shapes. As described in the embodiments, the dielectric resonator may be a column or a regular octagonal prism. An intermediate shape, for example, elliptic cylinder and a rectangular prism may be used. A plate, instead of a column, may be used. As described in the foregoing embodiments, the notched portion may have various shapes, such as a flat plate, a groove, and the like.

Although in the foregoing specific examples, a pair of notched portions 12A and 12B are formed in dielectric resonant element 12, even if at least one notched portion, for example, one of notched portions 12A and 12B may be formed, the advantages of the invention can be obtained. Meanwhile, like the specific examples, if notched portion 12A and 12B are provided at the opposing positions of dielectric resonant element 12, the coupling coefficient of two EH modes in dielectric resonator 10 can be more easily controlled so as to obtain the peak value.

Of course, three or more notched portions may be provided, and the notched portions may have various shapes.

The specific examples are based on several simulations or the experiment results based on the simulations. Actually, the specific guideline regarding how much the position and size of the notched portion of the dielectric resonant element are adjusted differs depending on the configuration of the dielectric resonator. For example, the depth of the notched portion at which the coupling coefficient has a peak and the relationship between the coupling coefficient and the depth of the notched portion differ depending on the positional relationship between the electrical signal input section and the electrical signal output section of the dielectric resonator, or the positional relationship between the electrical signal input section or the electrical signal output section and the notched portion.

Similarly to the related art, the selection of the size (height and diameter) of the dielectric resonant element with respect to the external conductor forms the basis of the coupling coefficient in the dielectric resonator.

Although in the foregoing specific examples, only a case where a dielectric resonator has a cylindrical external conductor has been described, a dielectric resonator having a polygonal external conductor can obtain the same advantages.

The invention is not intended to exclude the configuration in which a metal screw or a resin screw is provided in an external conductor toward a dielectric resonant element without hampering the advantages according to the notched portion of the invention.

A resonator filter is used as a band pass filter for defining the band of a radio frequency transmitted/received at a base station or the like of a mobile phone. For the reduction in the size of the base station, the reduction in the size of the resonator filter is demanded, and thus a dielectric resonator filter having a resonator made of a dielectric material is used. For further reduction in the size of the dielectric resonator filter, a multiple-mode dielectric resonator (a plurality of resonance modes exist together in a single dielectric resonator) is used. For example, a filter is known in which a plurality of multiple-mode dielectric resonators are coupled (for example, see Japanese Patent Unexamined Publication No. 2002-33605-A).

For the effective use of the frequency range of wireless communication, there is a demand for narrowing the bands in the dielectric resonator filter.

It is another object of the invention to provide a dielectric resonator filter capable of narrowing the bands.

A dielectric resonator filter according to yet another embodiment of the invention includes an external conductor having a cavity, a prism or plate-shaped first dielectric resonant element arranged in the cavity, the first dielectric resonant element having a first bottom surface and a first axis, a prism or plate-shaped second dielectric resonant element arranged in the cavity, the second dielectric resonant element having a second bottom surface opposite the first bottom surface and a second axis, a first notched portion arranged on the first dielectric resonant element in a first direction when viewed from the first axis, a second notched portion arranged on the second dielectric resonant element in a second direction at an angle corresponding to substantially an integer multiple of a right angle with respect to the first direction when viewed from the second axis, an electrical signal input section having an end opposite to the side surface of the first dielectric resonator, and an electrical signal output section having an end opposite the side surface of the second dielectric resonator.

According to the embodiment of the invention, a dielectric resonator filter capable of narrowing the bands can be provided.

Hereinafter, embodiments of the invention will be described.

Fifth Embodiment

Figure 51:
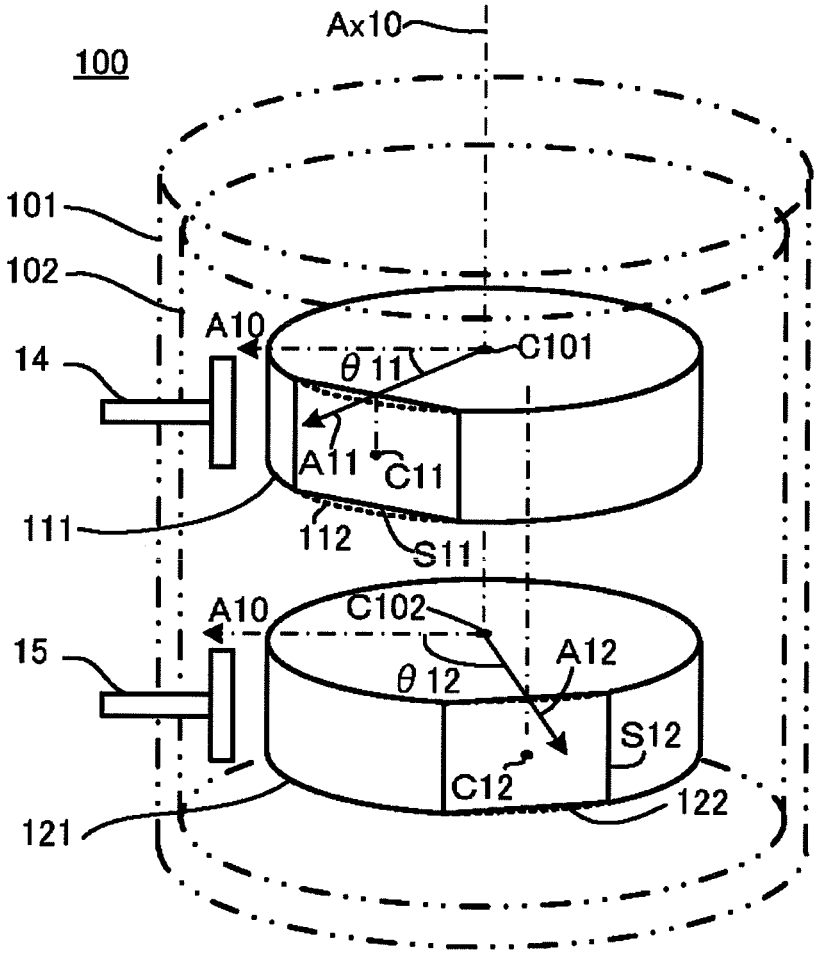
FIG. 51 is a perspective view of a dielectric resonator filter according to a fifth embodiment of the invention.
Figure 52:
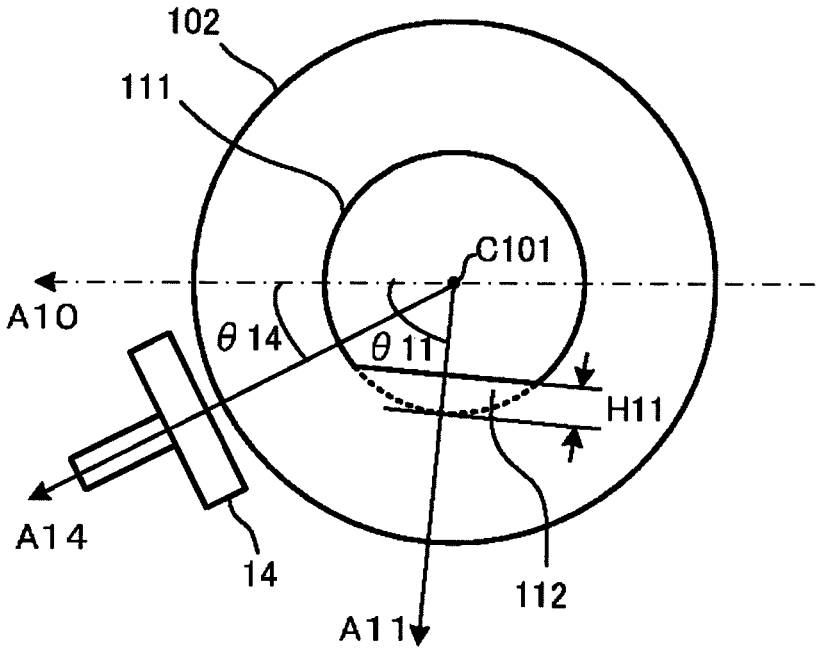
FIG. 52 is a plan view showing an upper-stage dielectric resonator.
Figure 53:
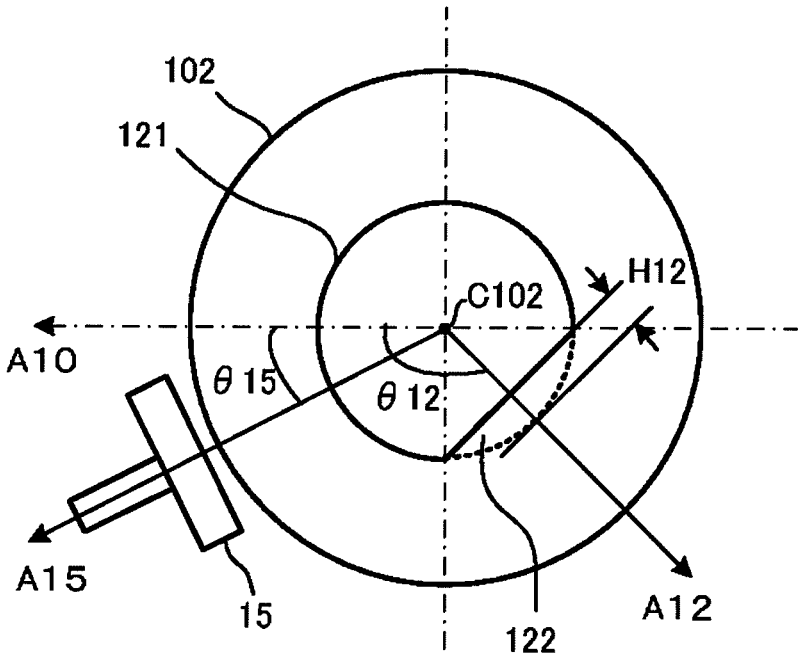
FIG. 53 is a plan view showing a lower-stage dielectric resonator.

FIG. 51 is a perspective view of dielectric resonator filter 100 according to a fifth embodiment of the invention. FIGS.

52 and 53 are plan views of upper-stage and lower-stage dielectric resonators 111 and 121 when viewed from the direction of an axis Ax10.

Dielectric resonator filter 100 functions as a band pass filter which transmits a signal in a desired frequency band, and has external conductor 101, dielectric resonators (also referred to as dielectric resonant element) 111 and 121, and signal terminals 14 and 15.

External conductor 101 is formed to have a substantially cylindrical shape, and has cavity 102. For ease of understanding, external conductor 101 is indicated by a virtual line (two-dot-chain line).

In this embodiment, cavity 102 is formed to have a columnar shape. Alternatively, cavity 102 may have other shapes, for example, a prismatic shape. It is preferable that the central axis of cavity 102 matches the axis Ax10 described below.

External conductor 101 is conductive, so an electric field can be trapped in cavity 102. That is, a leak electric field from dielectric resonators 111 and 121 is trapped in cavity 102. As a result, an external influence is cut off, and the characteristic of dielectric resonator filter 100 is stabilized.

Dielectric resonators 111 and 121 are made of a prism or plate-shaped dielectric material, and are arranged on the substantially same axis (axis Ax10) in cavity 102. That is, the centers C101 and C102 of the bottom surfaces (in this case, a circular shape) of dielectric resonators 111 and 121 substantially match the axis Ax10.

In this embodiment, dielectric resonators 111 and 121 are formed to have a columnar shape. Meanwhile, instead of the columnar shape, an elliptical columnar shape or a prismatic shape may be used. Dielectric resonators 111 and 121 are fixed to a support board (not shown) made of, for example, alumina or the like.

Dielectric resonators 111 and 121 have such a dimension as to resonate in a dual EH mode in a desired frequency band. That is, two resonance modes (EH1 and EH2 modes) whose electric field and magnetic field are perpendicular to each other can exist together in dielectric resonators 111 and 121. For the whole of dielectric resonators 111 and 121, four resonances can exist together.

Dielectric resonators 111 and 121 have the substantially same radius and height. As a result, the resonance modes in the dielectric resonators 111 and 121 have commonality (the substantially same resonance frequency). With dielectric resonators 111 and 121, four resonances (substantially, four resonators) at the substantially same resonance frequency can be used, so the reduction in the size of dielectric resonator filter 100 and band narrowing can be easily achieved.

Dielectric resonators 111 and 121 are arranged such that the bottom surfaces thereof are opposite each other, and are then electrically coupled to each other. That is, part of the components of the resonance of one of dielectric resonators 111 and 121 is transferred so as to contribute to the resonance of the other one of dielectric resonators 111 and 121. The intensity of coupling between dielectric resonators 111 and 121 can be adjusted in accordance with the distance between dielectric resonators 111 and 121. A stud or a slot may be arranged between dielectric resonators 111 and 121 so as to adjust the intensity of coupling. A stud is a rod-shaped member (for example, a column or a prism) made of a conductive material. A slot is a groove arranged at a conductive plate-shaped member. That is, the arrangement of a slot between dielectric resonators 111 and 121 means that a plate-shaped member having a slot is arranged.

Dielectric resonators 111 and 121 respectively have notched portions 112 and 122, respectively. Notched portions are respectively used to couple two resonance modes (EH1 and EH2 modes) in dielectric resonators 111 and 121. If no notched portions 112 and 122 are provided, the EH1 and EH2 modes in dielectric resonators 111 and 121 are independent from each other. For example, even though the EH1 mode is excited in dielectric resonator 111, the EH2 mode is not excited. If notched portion 112 is provided, the EH1 and EH2 modes are coupled in dielectric resonator 111, so if the EH1 mode is excited in dielectric resonator 111, the EH2 mode is excited. Notched portions 112 and 122 enable conversion from the component of one resonance mode (EH1 or EH2 mode) to the component of the other resonance mode (mode coupling).

Notched portions 112 and 122 are respectively arranged on dielectric resonators 111 and 121 in the directions A11 and A12 perpendicular to the axis Ax10 when viewed from the axis Ax10. The directions A11 and A12 can be respectively defined with the centers C11 and C12 (center of gravity) of surfaces S11 and S12 of notched portions 112 and 122 (the cut surfaces of dielectric resonators 111 and 121) as reference. The directions A11 and A12 can be respectively defined in accordance with the angles θ11 and θ12 from the direction A10 perpendicular to the axis Ax10.

It transpires that the angle θ16 (=θ12−θ11) between the directions A11 and A12 when viewed from the axis Ax10 is an important factor to narrow the bands in dielectric resonator filter 100. Specifically, if the angle θ16 is substantially an integer multiple of a right angle, the bands in dielectric resonator filter 100 can be narrowed. Details will be described below.

In this embodiment, surfaces S11 and S12 of notched portions 112 and 122 respectively have a planar shape (rectangular shape) having parallel left and right sides of FIG. 51. Surfaces S11 and S12 may have other shapes. This is because, even though the shapes of notched portions 112 and 122 (surfaces S11 and S12) are not specified, mode coupling occurs in dielectric resonators 111 and 121. For example, surfaces S11 and S12 may be curved. If dielectric resonators 111 and 121 have the same shape and dimension, and notched portions 112 and 122 have the same shape and dimension, dielectric resonators 111 and 121 can have the same magnitude of mode coupling.

Notched portions 112 and 122 may be respectively formed by grinding dielectric resonators 111 and 121 along the axis Ax10 at the depths H11 and H12 toward the axis Ax10.

Signal terminals 14 and 15 are terminals for signal input/output. In this case, signal terminals 14 and 15 are respectively referred to as a signal input terminal (also referred to as electrical signal input section) and a signal output terminal (also referred to as electrical signal output section).

Signal terminals 14 and 15 respectively have ends opposite the side surfaces of dielectric resonators 111 and 121. Signal terminals 14 and 15 are respectively coupled to dielectric resonators 111 and 121 by an electric field. An electric field may be applied from signal terminal 14 to dielectric resonator 111 (signal input from signal terminal 14 to dielectric resonator filter 100). Further, an electric field may be applied from dielectric resonator 121 to signal terminal 15 (signal output from dielectric resonator filter 100 to signal terminal 15).

Signal terminals 14 and 15 are arranged in the directions A14 and A15 perpendicular to the axis Ax10 from the axis Ax10 so as to be opposite the side surfaces of dielectric resonators 111 and 121. The directions A14 and A15 may be defined with the centers of the ends of signal terminals 14 and 15 as reference. The directions A14 and A15 may be defined in accordance with the angles θ14 and θ15 from the direction A10 perpendicular to the axis Ax10.

It is preferable that the angles θ18 and θ19 (θ18=θ14−θ11 and θ19=θ15−θ12) between the directions A14 and A15 of signal terminals 14 and 15 and the directions A11 and A12 of notched portions 112 and 122 are substantially "45°±90°×n" (where n is an integer). In other words, it is preferable that the directions A14 and A15 of signal terminals 14 and 15 and the directions A11 and A12 of notched portions 112 and 122 are not parallel or perpendicular to each other. This is because, if the directions A14 and A15 are respectively inclined with respect to the directions A11 and A12, mode coupling in dielectric resonators 111 and 121 can be increased. If the directions A14 and A15 are respectively parallel or perpendicular to the directions A11 and A12, the resonance mode EH1 which is excited in dielectric resonators 111 and 121 by the electric field from signal terminals 14 and 15 is not actually coupled to the resonance mode EH2 which is orthogonal to the resonance mode EH1.

Signal terminals 14 and 15 are arranged at an angle θ (=θ15−θ14) corresponding to substantially an integer multiple of 90° with the axis Ax10 as reference. For example, because of wiring routing for signal input/output, signal terminals 14 and 15 are arranged so as to be in the substantially same direction (substantially parallel to each other). Because of resonance of dielectric resonators 111 and 121 in the E-H mode, the angle θ19 substantially becomes an integer multiple of 90°.

Figure 54:
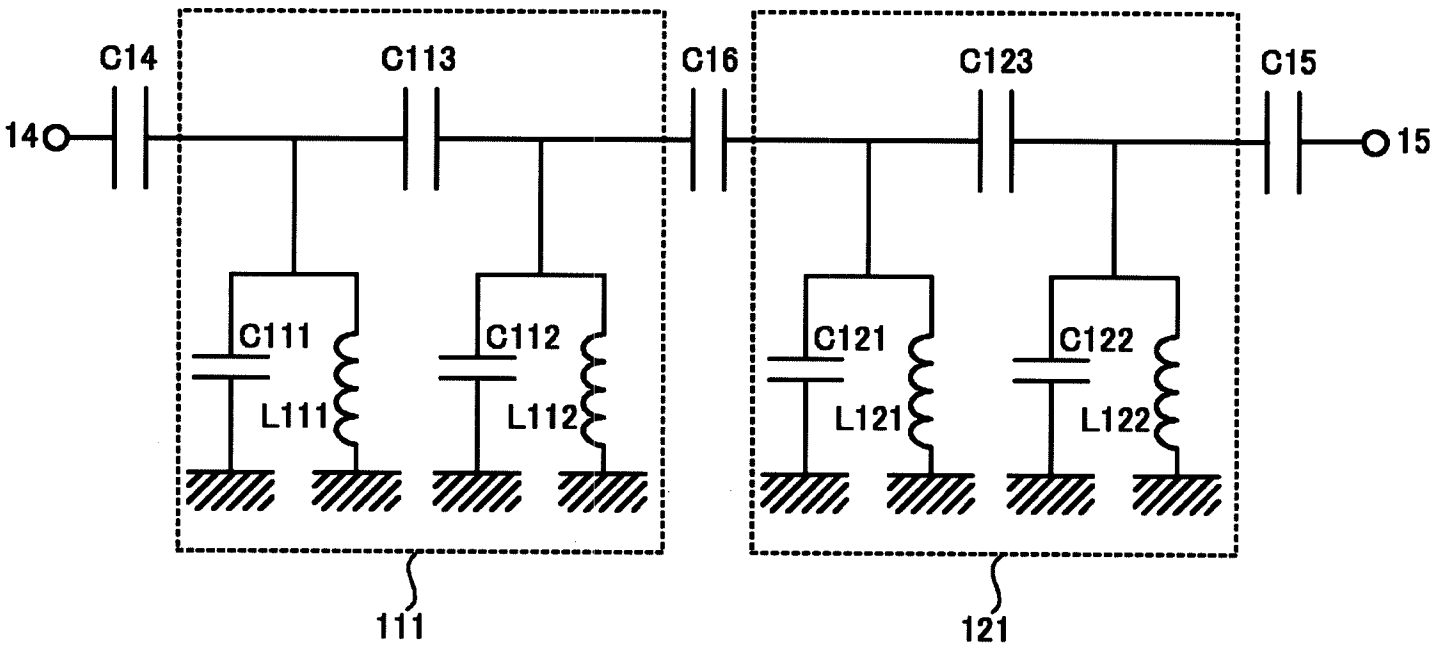
FIG. 54 is a circuit diagram showing an example of the equivalent circuit of the dielectric resonator filter shown in FIG. 51.
Figure 55:
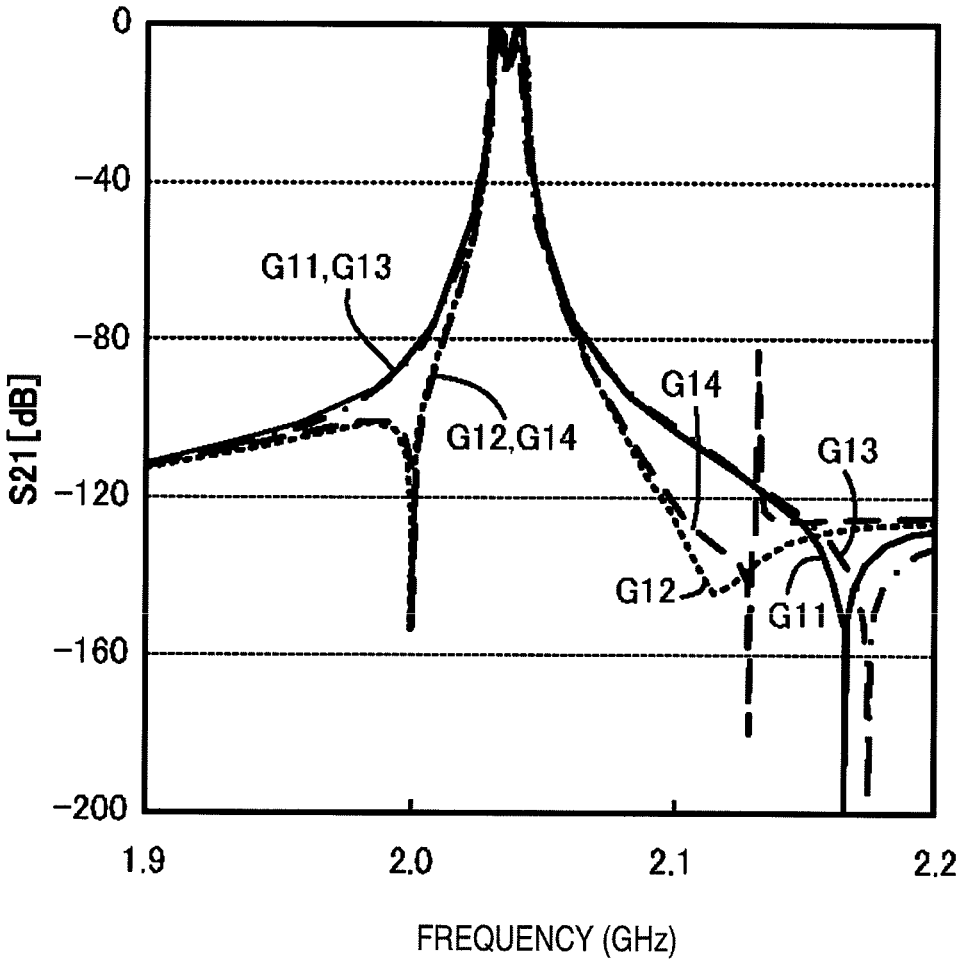
FIG. 55 is a graph showing an example of the electrical characteristic of the dielectric resonator filter.
Figure 56:
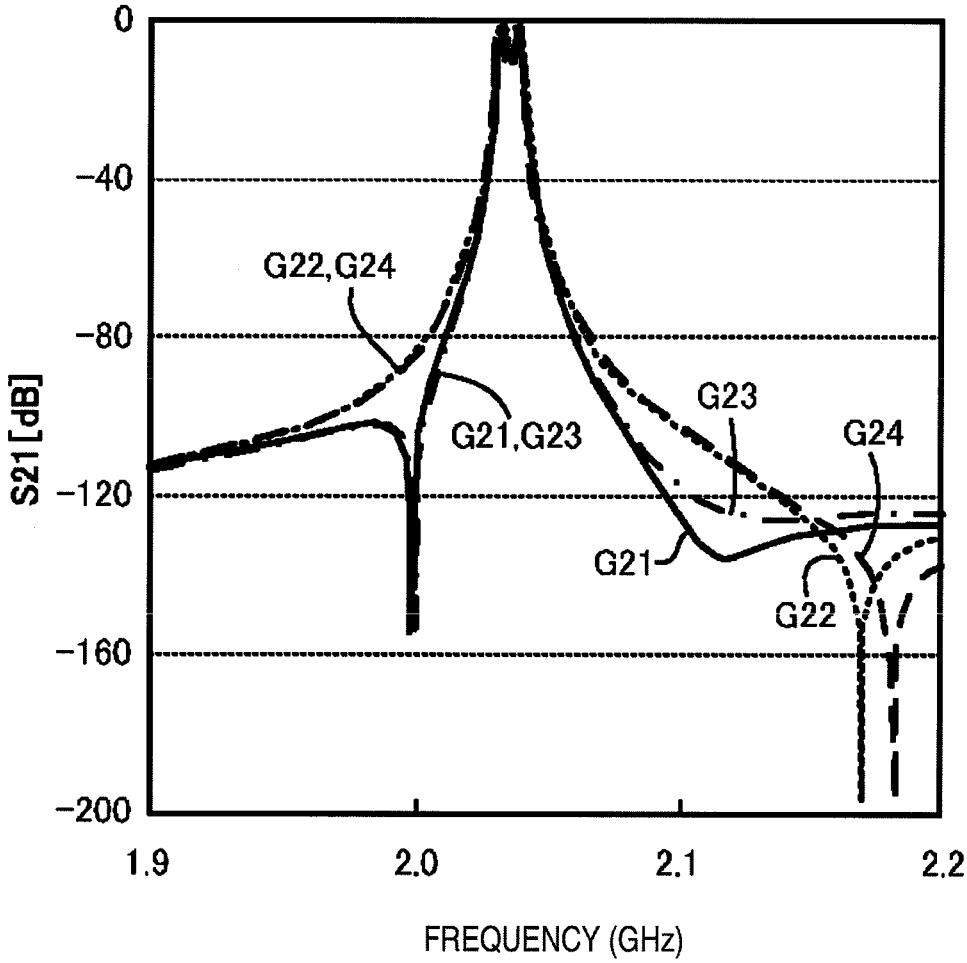
FIG. 56 is a graph showing an example of the electrical characteristic of the dielectric resonator filter.
Figure 57:
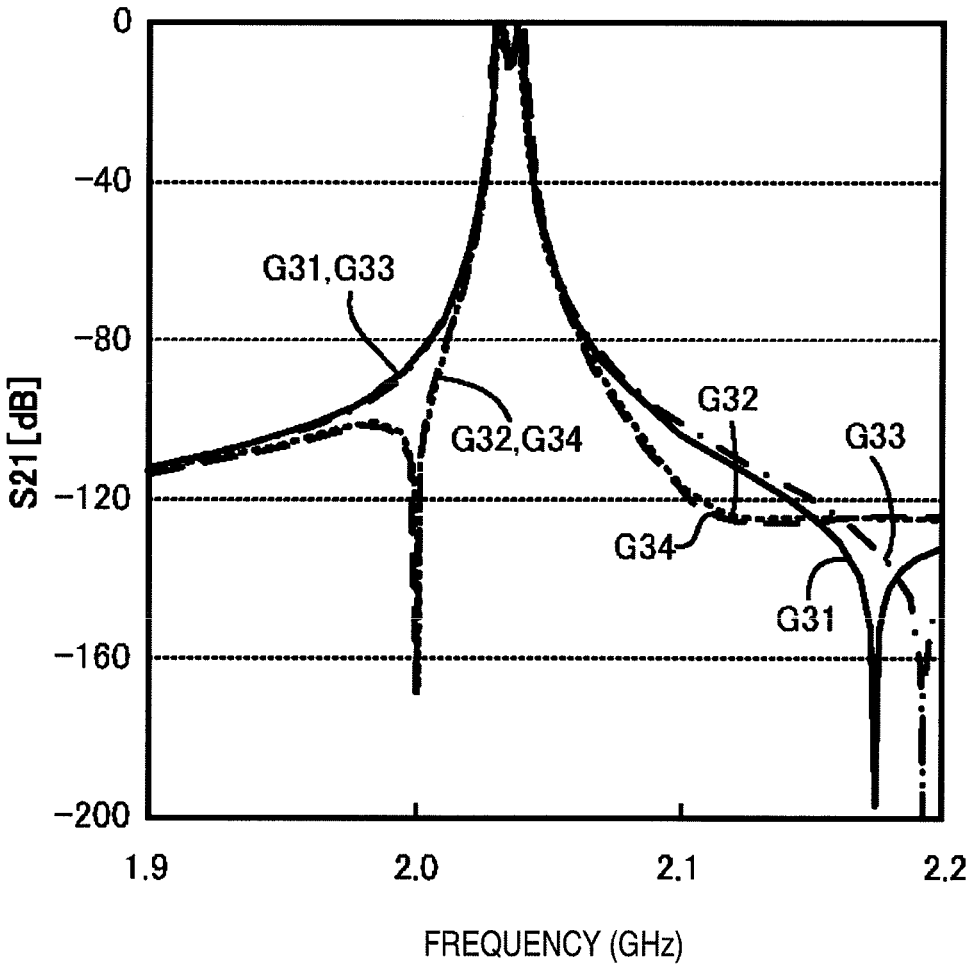
FIG. 57 is a graph showing an example of the electrical characteristic of the dielectric resonator filter.
Figure 58:
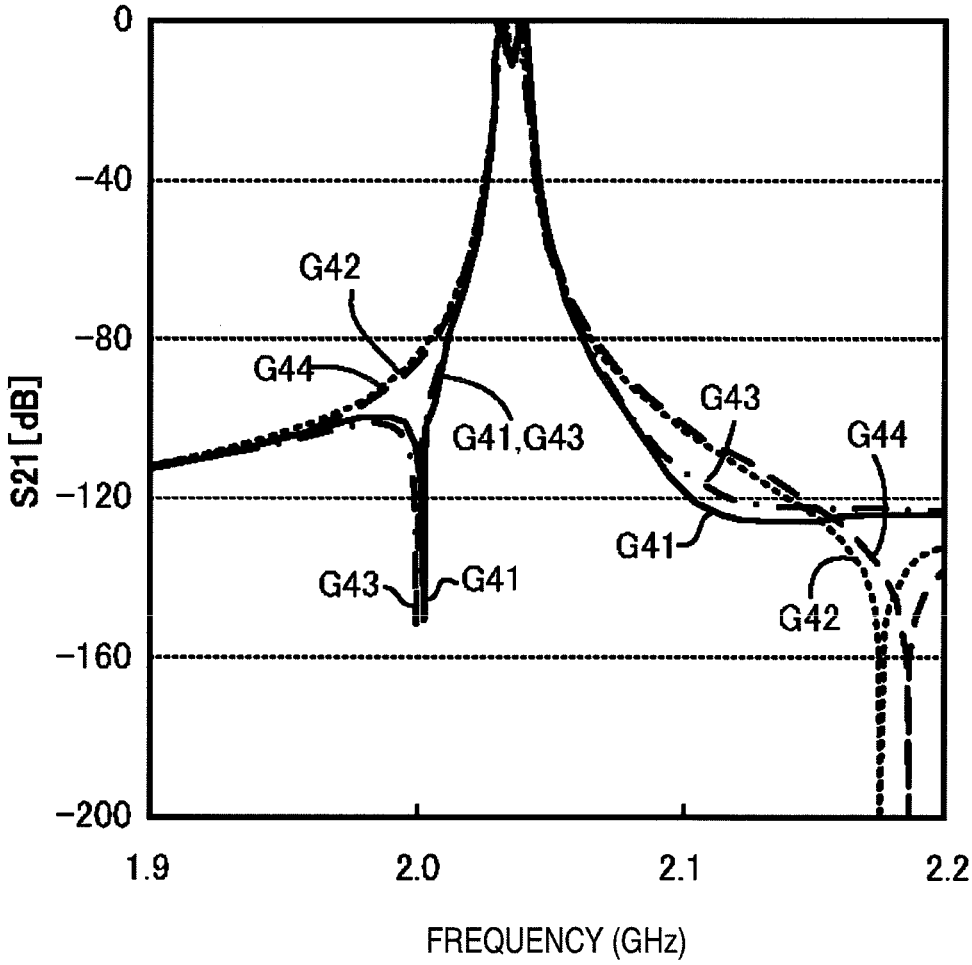
FIG. 58 is a graph showing an example of the electrical characteristic of the dielectric resonator filter.

FIG. 54 is a circuit diagram showing the equivalent circuit of dielectric resonator filter 100. For the dual EH modes in respective dielectric resonators 111 and 121, capacitive elements (capacitors) C111, C112, C121, and C122, inductance elements (coils) L111, L112, L121, and L122 are four resonators (C111-L111, C112-L112, C121-L121, and C122-L122). The resonators in respective dielectric resonators 111 and 121 are respectively coupled by capacitive elements C113 and C123. Capacitive elements C113 and C123 correspond to notched portions 112 and 122.

Capacitive element C14 copes with capacitive coupling between signal terminal 14 and dielectric resonator 111. Capacitive element C15 copes with capacitive coupling between signal terminal 15 and dielectric resonator 121. Capacitive element C16 copes with capacitive coupling between dielectric resonators 111 and 121. That is, dielectric resonators 111 and 121 are capacitively coupled. If a slit is arranged between dielectric resonators 111 and 121, resonators 111 and 121 are inductively coupled, and capacitive element C16 is substituted with inductance element L16.

Examples

The experiment result in dielectric resonator filter 100 of the foregoing embodiment will be described. In this experiment, dielectric resonators 111 and 121 and notched portions 112 and 122 are defined as follows.

Materials for dielectric resonators 111 and 121: calcium titanate (relative dielectric constant ∈r=44)

Diameters D11 and D12 of dielectric resonators 111 and 121: 37 mm Lengths L11 and L12 of dielectric resonators 111 and 121: 10 mm Depths H11 and H12 of notched portions 112 and 122: 1.75 mm The correspondence relationship between the angles (θ11, θ12, θ14, and θ15) of notched portions 112 and 122 and signal terminals 14 and 15, and the characteristic of dielectric resonator filter 100 was examined.

Table 1, Table 2, and FIGS. 55 to 58 show the characteristic of dielectric resonator filter 100 when the angles (θ14 and θ15) of signal terminals 14 and 15 are maintained constant, and the angles (θ11 and θ12) of the notched portions 112 and 122 are changed. In the graphs of FIGS. 55 to 58, the vertical axis represents intensity [dB] of a transmitted signal, and the horizontal axis represents a frequency [GHz].

TABLE 1

| | Sample Number | | | | | | | |
|---|---|---|---|---|---|---|---|---|
| | G11 | G12 | G13 | G14 | G21 | G22 | G23 | G24 |
| θ11 (notched portion) [°] | 0 | 0 | 0 | 0 | 90 | 90 | 90 | 90 |
| θ12 (notched portion) [°] | 0 | 90 | 180 | 270 | 0 | 90 | 180 | 270 |
| θ14 (terminal) [°] | 45 | 45 | 45 | 45 | 45 | 45 | 45 | 45 |
| θ15 (terminal) [°] | 45 | 45 | 45 | 45 | 45 | 45 | 45 | 45 |
| Steep waveform | Δ | ○ | Δ | ○ | ○ | Δ | ○ | Δ |

TABLE 2

| | Sample Number | | | | | | | |
|---|---|---|---|---|---|---|---|---|
| | G31 | G32 | G33 | G34 | G41 | G42 | G43 | G44 |
| θ11 (notched portion) [°] | 180 | 180 | 180 | 180 | 270 | 270 | 270 | 270 |
| θ12 (notched portion) [°] | 0 | 90 | 180 | 270 | 0 | 90 | 180 | 270 |
| θ14 (terminal) [°] | 45 | 45 | 45 | 45 | 45 | 45 | 45 | 45 |
| θ15 (terminal) [°] | 45 | 45 | 45 | 45 | 45 | 45 | 45 | 45 |
| Steep waveform | Δ | ○ | Δ | ○ | ○ | Δ | ○ | Δ |

As shown in Tables 1 and 2, the samples G12, G14, G21, G23, G32, G34, G41, and G43 have waveforms steeper than those of other samples (the samples G11, G13, G22, G24, G31, G33, G42, and G44), and the bands were narrowed due to an attenuation pole. At this time, the absolute value of the difference 816 (θ12-θ11) between the angles θ11 and θ12 was 90°.

As described above, if notched portions 112 and 122 are respectively arranged in dielectric resonators 111 and 121, and the absolute values of the directions A11 and A12 from the axis Ax10 toward notched portions 112 and 122, respectively, are substantially set to 90°, the bands in dielectric resonator filter 100 can be narrowed.

Sixth Embodiment

Figure 59:
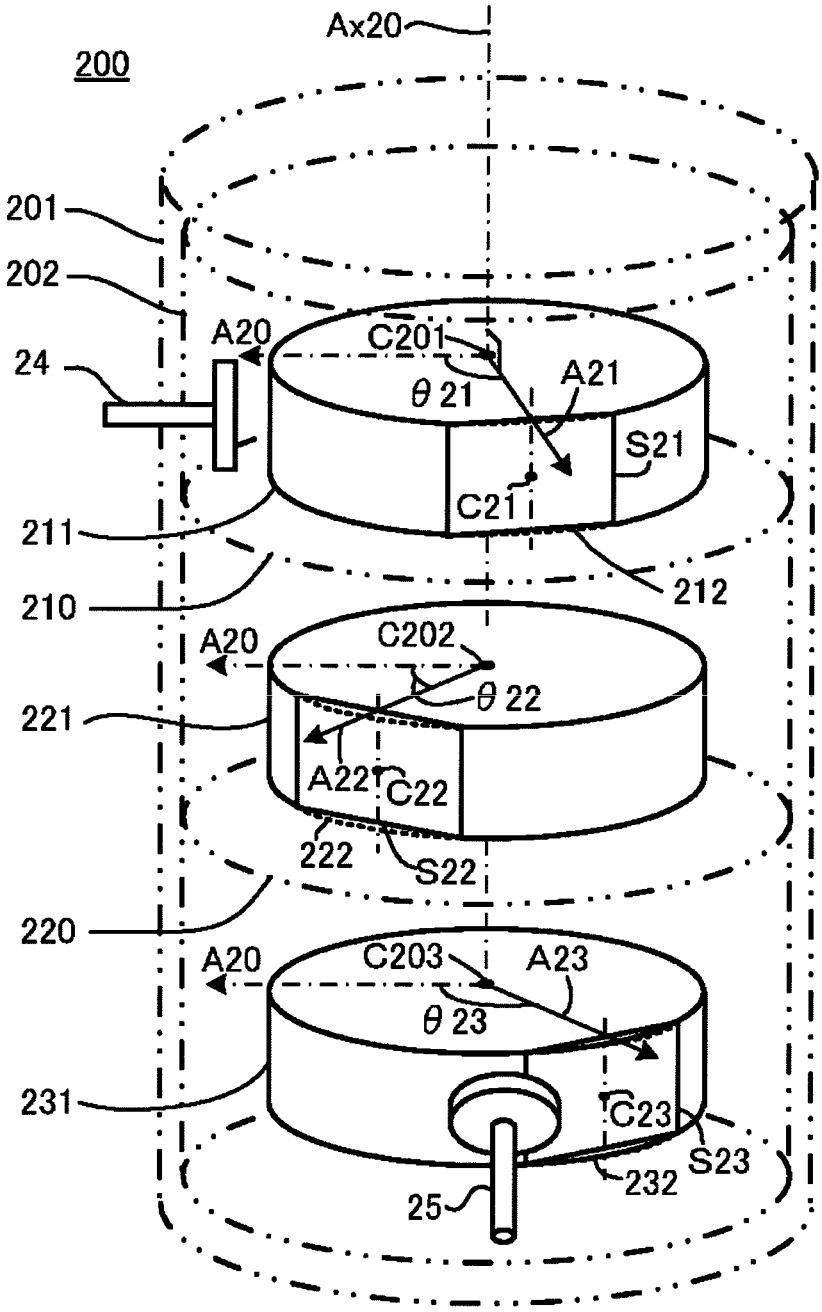
FIG. 59 is a perspective view of a dielectric resonator filter according to a sixth embodiment of the invention.
Figure 60:
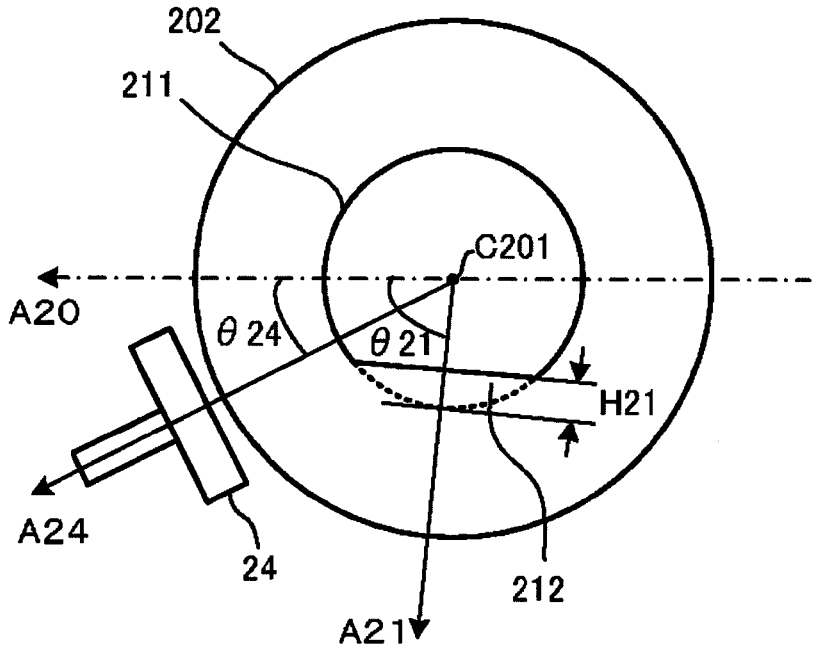
FIG. 60 is a plan view showing an upper-stage dielectric resonator.
Figure 61:
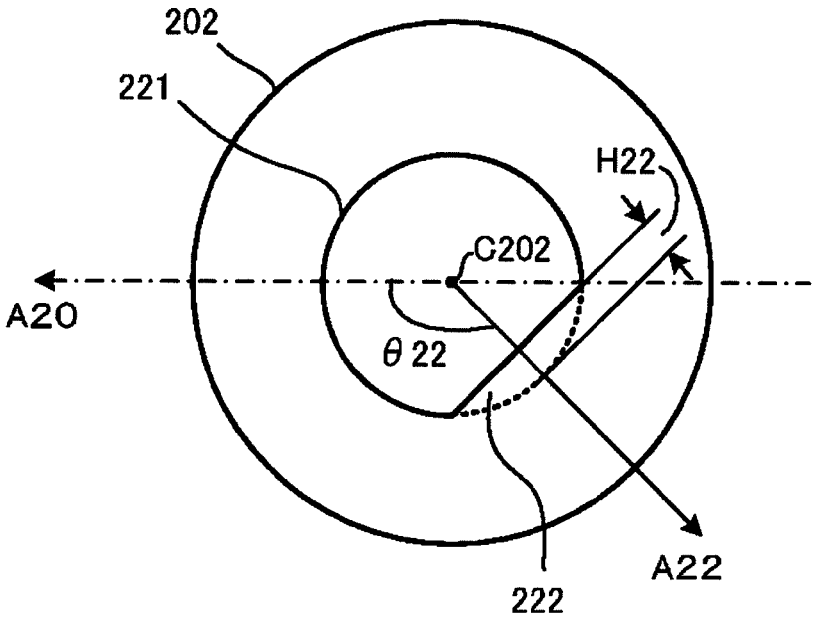
FIG. 61 is a plan view showing a middle-stage dielectric resonator.
Figure 62:
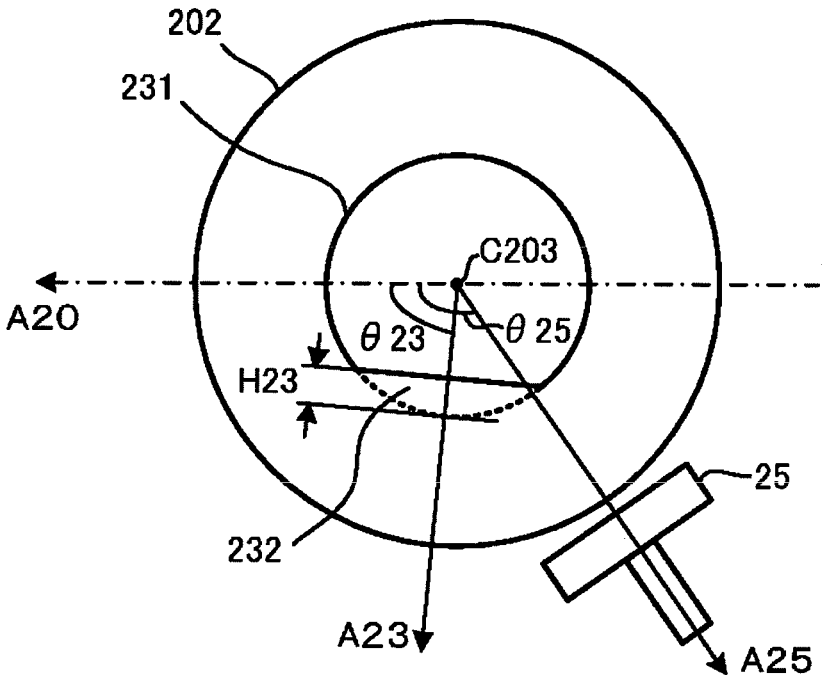
FIG. 62 is a plan view showing a lower-stage dielectric resonator.

FIG. 59 is a perspective view of dielectric resonator filter 200 according to a sixth embodiment of the invention. FIGS. 60 to 62 are plan views of upper-stage, middle-stage, and lower-stage dielectric resonators 211 to 231 when viewed from the direction of an axis Ax20.

Dielectric resonator filter 200 functions as a band pass filter which transmits a signal in a desired frequency band, and has external conductor 201, partition walls 210 and 220, dielectric resonators 211 to 231, and signal terminals 24 and 25.

External conductor 201 is formed to have a substantially cylindrical shape, and has cavity 202. For ease of understanding, external conductor 101 is indicated by a virtual line (two-dot-chain line).

In this embodiment, cavity 202 is formed to have a columnar shape. Alternatively, cavity 202 may have other shapes, for example, a prismatic shape. It is preferable that the central axis of cavity 202 matches the axis Ax20 described below.

Partition walls 210 and 220 partition cavity 202 into three partitions, and dielectric resonators 211 to 231 are individually arranged in the partitions. Partition walls 210 and 220 are provided with slots (not shown) for electrically coupling dielectric resonators 211 to 231 to each other.

Dielectric resonators 211 to 231 are made of a prism or plate-shaped dielectric material, and are arranged on the substantially same axis (axis Ax20) in cavity 102. That is, the centers C201 to C203 of the bottom surfaces (in this case, a circular shape) of dielectric resonators 211 to 231 substantially match the axis Ax10. In this embodiment, dielectric resonators 211 and 231 respectively have a columnar shape. Alternatively, instead of the columnar shape, an elliptical columnar shape or a prismatic shape may be used. Dielectric resonators 211 to 231 are fixed to a support board (not shown) made of alumina or the like.

Dielectric resonators 211 to 231 have such a dimension as to resonate in a dual EH mode in a desired frequency band. That is, two resonance modes (EH1 and EH2 modes) whose electric field and magnetic field are perpendicular to each other can exist together in dielectric resonators 211 to 231. As the whole of dielectric resonators 211 and 231, six resonances can exist together.

Dielectric resonators 211 to 231 are arranged such that the bottom surfaces thereof are opposite each other, and then electrically coupled through the slots of partition walls 210 and 220.

Dielectric resonators 211 to 231 respectively have notched portions 212 to 232. Notched portions are respectively used to couple two resonance modes (EH1 and EH2 modes) in dielectric resonators 211 to 231 (mode coupling).

Notched portions 212 to 232 are respectively arranged on dielectric resonators 211 to 231 in the directions A21 to A23 perpendicular to the axis Ax20 when viewed from the axis Ax20. The directions A21 to A23 may be respectively defined with the centers C21 to C23 (center of gravity) of surfaces S21 to S23 of notched portions 212 to 232 (the cut surfaces of dielectric resonator 211 to 231) as reference. The directions A21 to A23 may be respectively defined in accordance with the angles θ21 to θ23 from the direction A20 perpendicular to the axis Ax20.

Figure 63:
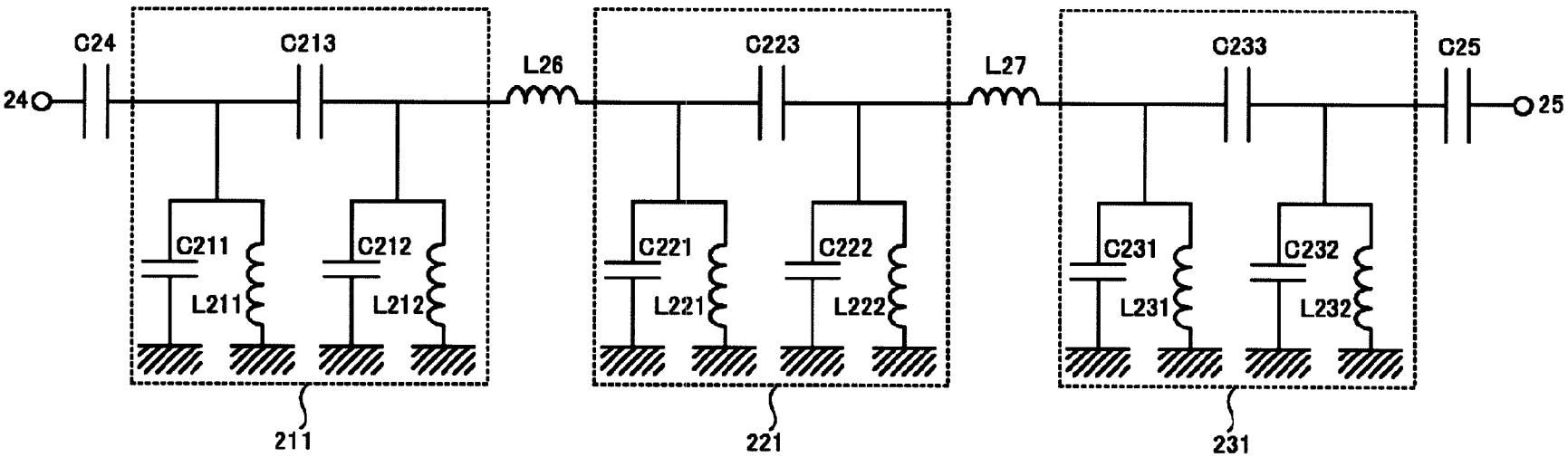
FIG. 63 is a circuit diagram showing an example of the equivalent circuit of the dielectric resonator filter shown in FIG. 63.

In this embodiment, as shown in FIG. 59, surfaces S21 to S23 of notched portions 212 to 232 respectively have a planar shape (rectangular shape) having parallel left and right sides of FIG. 63. Alternatively, surfaces S21 to S23 may have other shapes, for example, may be curved. This is because, even though the shapes of notched portions 212 to 232 (surfaces S21 to S23) are not specified, mode coupling occurs in dielectric resonators 211 to 231.

Notched portions 212 to 232 may be respectively formed by grinding dielectric resonators 211 to 231 along the axis Ax20 at the depths H21 to H23 toward the axis Ax20.

Signal terminals 24 and 25 are terminals for signal input/output. In this case, signal terminals 24 and 25 are respectively referred to as a signal input terminal and a signal output terminal.

Signal terminals 24 and 25 respectively have ends opposite the side surfaces of dielectric resonators 211 and 231. Signal terminals 24 and 25 are respectively coupled to dielectric resonators 211 and 231 by an electric field.

Signal terminals 24 and 25 are respectively arranged in the directions A24 and A25 perpendicular to the axis Ax20 from the axis Ax20 so as to be opposite the side surfaces of dielectric resonators 211 and 231. The directions A24 and A25 may be respectively defined with the centers of the ends of signal terminals 24 and 25 as reference. The directions A24 and A25 may be respectively defined in accordance with the angles θ24 and θ25 from the direction A20 perpendicular to the axis Ax20.

It is preferable that the angles θ28 and θ29 (θ28=θ24−θ21 and θ29=θ25−θ22) between the directions A24 and A25 of signal terminals 24 and 25 and the directions A21 and A23 of notched portions 212 and 232 is substantially "45°±90°×n" (where n is an integer).

Signal terminals 24 and 25 are arranged at the angle θ (=θ25−θ24) corresponding to substantially an integer multiple of 90° with the axis Ax20 as reference. For example, because of wiring routing for signal input/output, signal terminals 24 and 25 are arranged so as to be substantially orthogonal to each other.

FIG. 63 is a circuit diagram showing the equivalent circuit of dielectric resonator filter 200. For the dual EH modes in respective dielectric resonators 211 to 231, capacitive elements (capacitors) C211, C212, C221, C222, C231, and C232, inductance elements (coils) L211, L212, L221, L222, L231, and L232 form six resonators. The resonators in respective dielectric resonators 211 to 231 are respectively coupled to capacitive elements C213 to C233. Capacitive elements C213 to C233 correspond to notched portions 212 to 232.

Capacitive element C24 copes with capacitive coupling between signal terminal 24 and dielectric resonator 211. Capacitive element C25 copes with capacitive coupling between signal terminal 25 and dielectric resonator 231. Inductance elements L26 and L27 cope with inductive coupling between dielectric resonators 211 to 231. In this example, dielectric resonators 211 to 231 are inductively coupled by the slots of partition walls 210 and 220.

Examples

The experiment result in dielectric resonator filter 200 of the foregoing embodiment will be described. In this experiment, dielectric resonators 211 to 231 and notched portions 212 to 232 were defined as follows.

Materials for dielectric resonators 211 to 231: calcium titanate (relative dielectric constant ∈r=44)

Diameters D21 to D23 of dielectric resonators 211 to 231: 37 mm

Lengths L21 to L23 of dielectric resonators 211 to 231: 10 mm

Depths H21 to H23 of notched portions 212 to 232: 1.75 mm

The correspondence relationship between the angles (θ11, θ12, θ14, and θ15) of notched portions 212 to 232 and signal terminals 24 and 25, and the characteristic of dielectric resonator filter 200 was examined.

Figure 64:
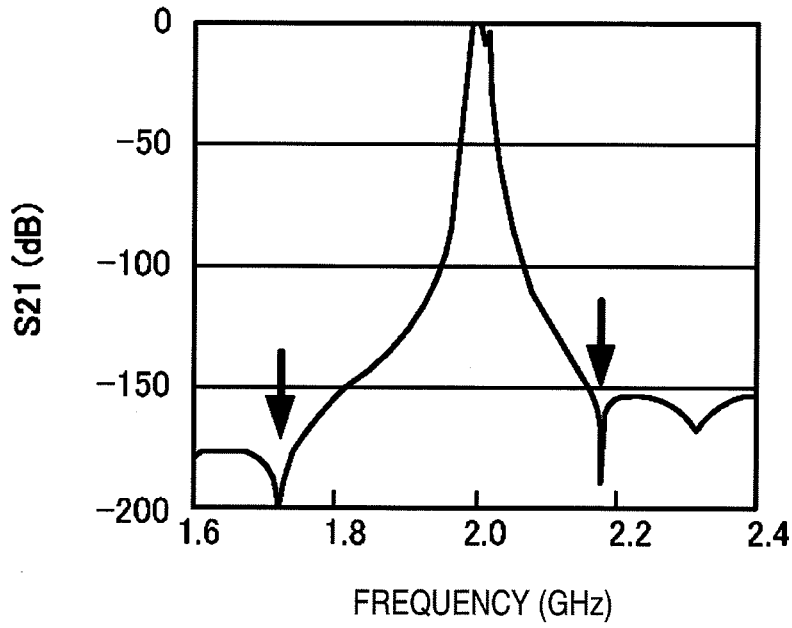
FIG. 64 is a graph showing an example of the electrical characteristic of the dielectric resonator filter.
Figure 65:
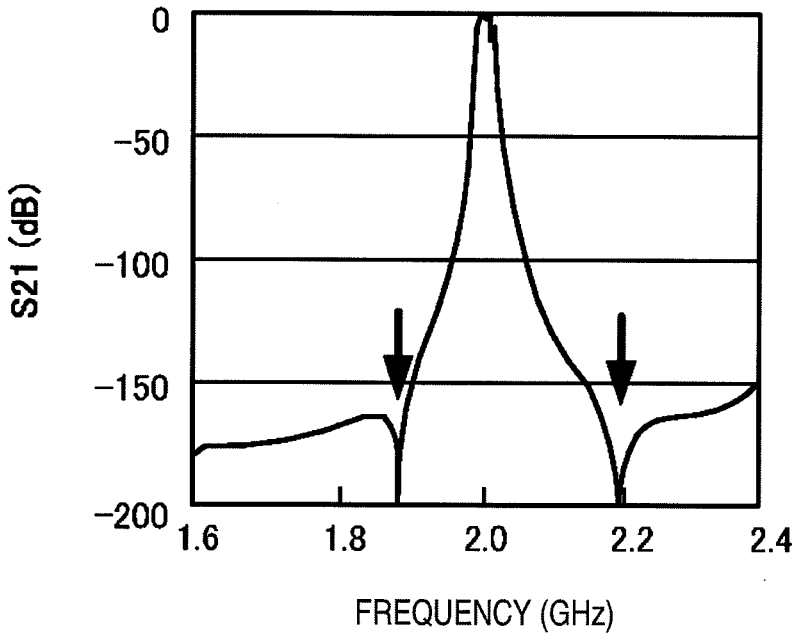
FIG. 65 is a graph showing an example of the electrical characteristic of the dielectric resonator filter.

FIGS. 64 and 65 show the characteristics of dielectric resonator filter 200 when the angles (θ21, θ22, and θ23) of notched portions 212 to 232 are (0°, 0°, and 0°) and (0°, 0°, and 90°). The position of an attenuation pole is indicated by a downward arrow.

In FIGS. 64 and 65, two attenuation poles have appeared, and in FIG. 65, the waveform was sharp. At this time, the difference θ26 (θ22−θ21) between the angles θ22 and θ21 and the difference θ27 (θ23−θ21) between the angles θ23 and θ21 were respectively 0° and 90°.

As described above, if notched portions 212 to 232 are respectively arranged in dielectric resonators 211 to 231, and the differences θ25 and θ26 between the angles of the directions A21 to A23 from the axis Ax20 toward notched portions 212 to 232 are respectively set to 0° and 90°, the bands in dielectric resonator filter 200 can be narrowed.

(Modifications)

Hereinafter, as modifications, a case where, in the first and sixth embodiments, the shape of the dielectric resonator filter or the notched portion is changed will be described. As described below, even if the shape of the dielectric resonator filter or the notched portion differs, an attenuation pole is generated by appropriately defining the angle of the notched portion, and thus the bands in the characteristics can be narrowed.

A. Modification 1

Figure 66A:
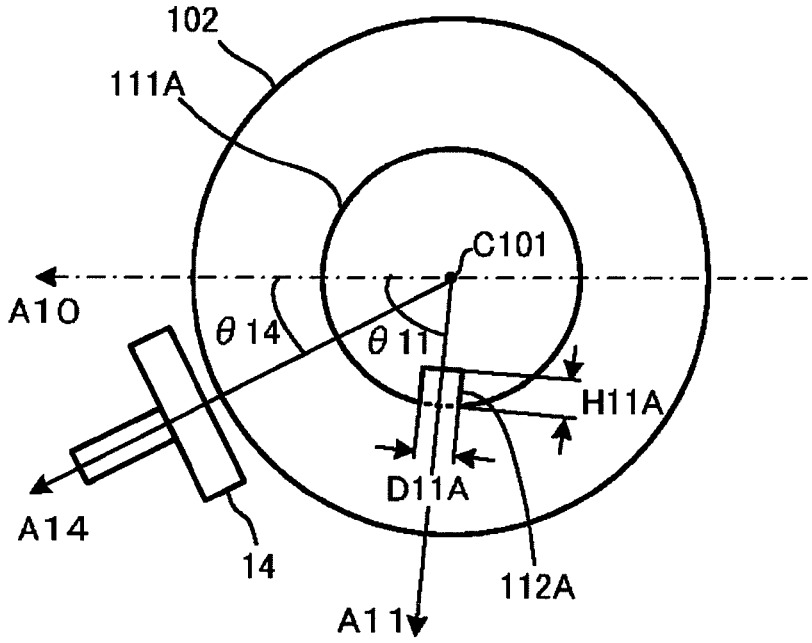
FIG. 66A is a plan view showing an upper-stage dielectric resonator according to Modification 1.
Figure 66B:
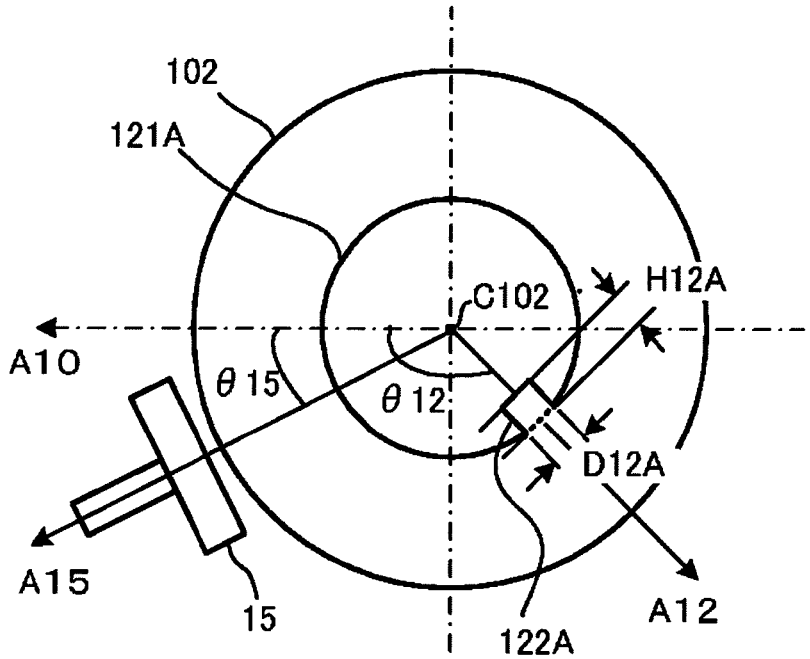
FIG. 66B is a plan view showing a lower-stage dielectric resonator according to Modification 1.

A case where the shape of the notched portion of the dielectric resonator filter in the fifth embodiment is changed will be described. Dielectric resonator filter 100A according to a modification (Modification 1) of the fifth embodiment of the invention has upper-stage and lower-stage dielectric resonators 111A and 121A. FIGS. 66A and 66B are plan views of dielectric resonators 111A and 121A when viewed from the axial direction, respectively.

Dielectric resonators 111A and 121A respectively have notched portions 112A and 122A. In the fifth embodiment, notched portions 112 and 122 respectively have planar surfaces S11 and S12. In contrast, in Modification 1, each of notched portions 112A and 122A is a substantially cuboid groove having one bottom surface and two side surfaces.

Dielectric resonator filter 100A has no substantial difference from dielectric resonator filter 100, excluding the shapes of notched portions 112A and 122A, and thus the perspective view thereof will be omitted.

The experiment result in Modification 1 will be described. In this experiment, dielectric resonators 111A and 121A and notched portions 112A and 122A were defined as follows.

Materials for dielectric resonators 111A and 121A: calcium titanate (relative dielectric constant $\in r=44$)

Diameters D11A and D12A of dielectric resonators 111A and 121A: 37 mm

Lengths L11A and L12A of dielectric resonators 111A and 121A: 10 mm

Depths H11A and H12A of notched portions 112A and 122A: 2.1 mm

Widths D11A and D12A of notched portions 112A and 122A: 3.0 mm

Figure 67:
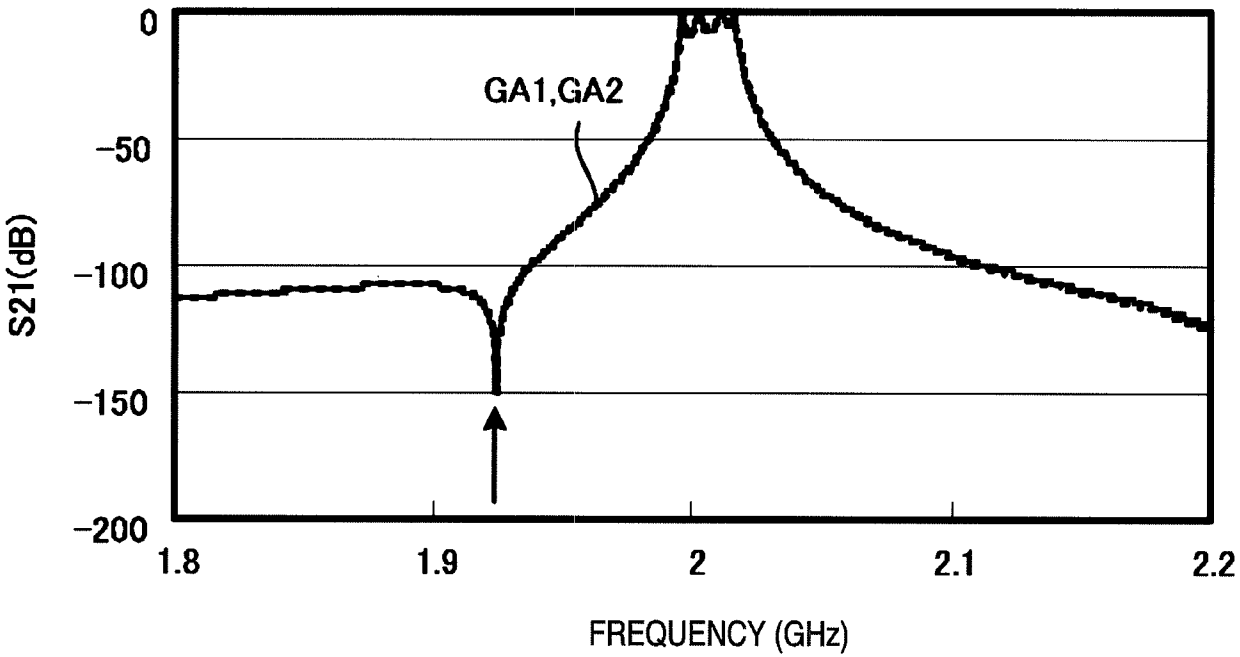
FIG. 67 is a graph showing an example of the electrical characteristic of the dielectric resonator filter according to Modification 1.

FIG. 67 shows graphs GA1 and GA2 of dielectric resonator filter 100A under the same angle conditions as G14 ($\theta 11=0°$ and) $\theta 12=270°$ and G41 ($\theta 11=270°$ and) $\theta 12=0°$ in Tables 1 and 2, respectively. In the graph of FIG. 67, the vertical axis represents intensity [dB] of a transmitted signal, and the horizontal axis represents a frequency [GHz]. The graphs GA1 and GA2 substantially overlap each other, and respectively have an attenuation pole at around 1.92 GHz (indicated by an arrow).

B. Modification 2

Figure 68A:
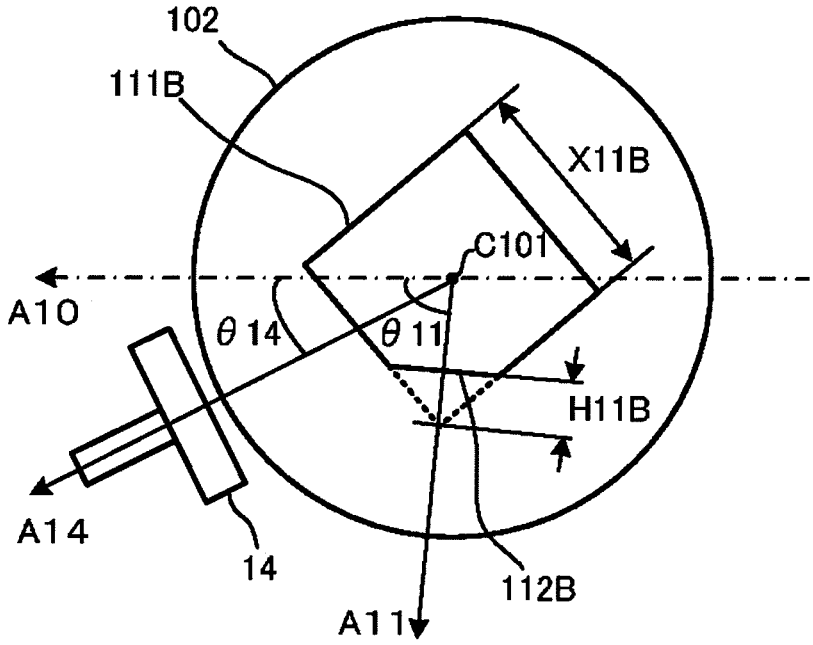
FIG. 68A is a plan view showing an upper-stage dielectric resonator according to Modification 2.
Figure 68B:
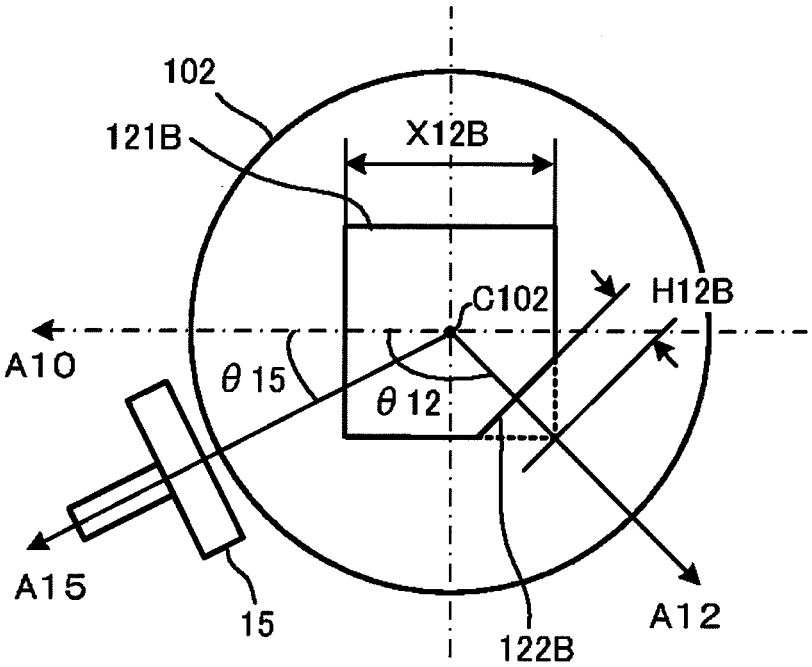
FIG. 68B is a plan view showing a lower-stage dielectric resonator according to Modification 2.

A case where the shape of the dielectric resonator filter in the fifth embodiment is changed will be described. Dielectric resonator filter 100B according to a modification (Modification 2) of the fifth embodiment of the invention has upper-stage and lower-stage dielectric resonators 111B and 121B. FIGS. 68A and 68B are plan views of dielectric resonators 111B and 121B when viewed from the axial direction, respectively.

Dielectric resonators 111B and 121B respectively have notched portions 112B and 122B. In the fifth embodiment, dielectric resonators 111B and 121B have a columnar shape. In contrast, in Modification 2, dielectric resonators 111B and 121B respectively have a regular rectangular prismatic shape.

Dielectric resonator filter 100B has no substantial difference from dielectric resonator filter 100, excluding the shapes of dielectric resonators 111B and 121B, and thus the perspective view thereof will be omitted.

The experiment result in Modification 2 will be described. In this experiment, dielectric resonators 111A and 121A and notched portions 112B and 122B were defined as follows.

Materials for dielectric resonators 111B and 121B: calcium titanate (relative dielectric constant $\in r=44$)

Lengths X11B and X12B of sides of dielectric resonators 111B and 121B: 26 mm

Lengths L11B and L12B of dielectric resonators 111B and 121B: 10 mm

Depths H11B and H12B of notched portions 112B and 122B: 6 mm

Figure 69:
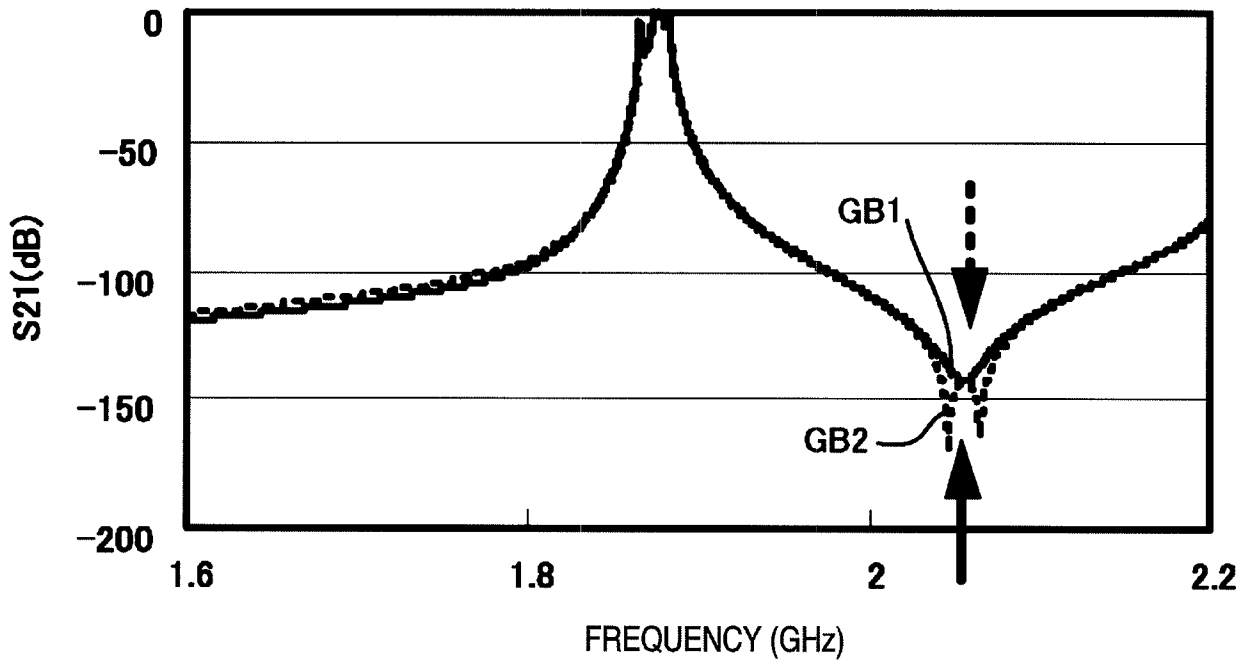
FIG. 69 is a graph showing an example of the electrical characteristic of the dielectric resonator filter according to Modification 2.

FIG. 69 shows graphs GB1 and GB2 of dielectric resonator filter 100B under the same angle conditions as G14 ($\theta 11=0°$ and) $\theta 12=270°$ and G41 ($\theta 11=270°$ and) $\theta 12=0°$ in Tables 1 and 2, respectively. In the graph of FIG. 69, the vertical axis represents intensity [dB] of a transmitted signal, and the horizontal axis represents a frequency [GHz]. The graphs GB1 and GB2 respectively have one attenuation pole and two attenuation poles at around 2.06 GHz (indicated by arrows).

C. Modification 3

A case where the shape of the notched portion of the dielectric resonator filter in the sixth embodiment is changed will be described. Dielectric resonator filter 200A according to a modification (Modification 3) of the sixth embodiment of the invention has dielectric resonators 211A to 231A.

Dielectric resonators 211A to 231A respectively have notched portions 212A to 232A. Similarly to Modification 1, each of notched portions 212A to 232A is a substantially cuboid groove having one bottom surface and two side surfaces.

Dielectric resonator filter 200A has no substantial difference from dielectric resonator filter 100A, excluding the number of dielectric resonators, and thus dielectric resonator filter 200A will not be shown.

The experiment result in Modification 3 will be described. In this experiment, dielectric resonators 211A to 231A and notched portions 212A to 232A were defined as in Modification 1.

Figure 70:
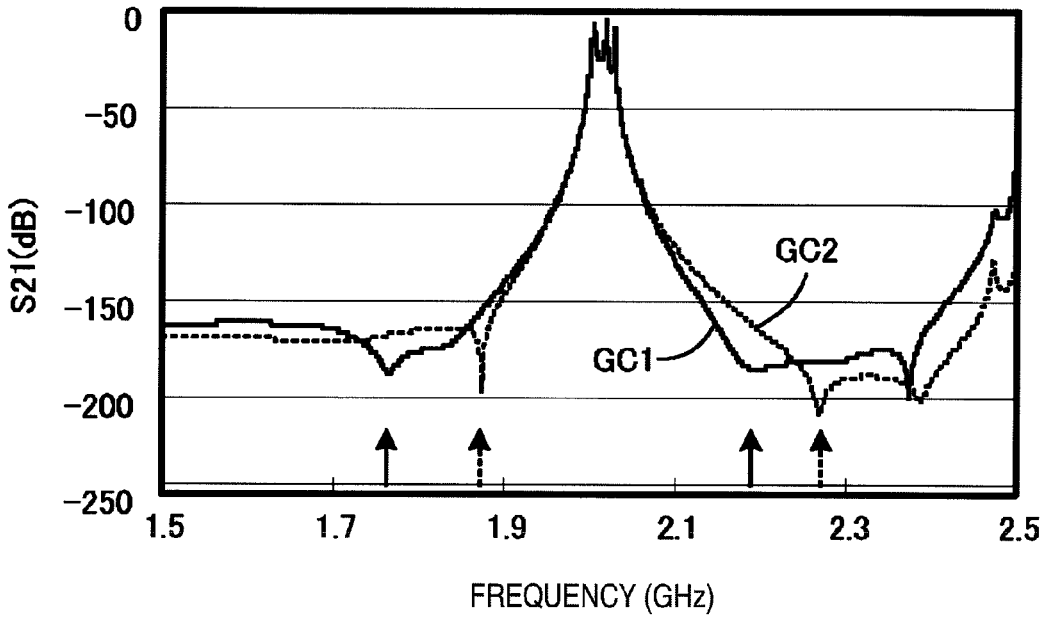
FIG. 70 is a graph showing an example of the electrical characteristic of a dielectric resonator filter according to Modification 3.

FIG. 70 shows the characteristics (graphs GC1 and GC2) of dielectric resonator filter 200A when the angles ($\theta 21$, $\theta 22$, and $\theta 23$) of notched portions 212 to 232 are (0°, 0°, and 0°) and (0°, 0°, and 90°). The graph GC1 has two attenuation poles at around 1.75 GHz and 2.19 GHz, and the graph GC2 has two attenuation poles at around 1.86 GHz and 2.27 GHz (indicated by arrows).

D. Modification 4

A case where the shape of the dielectric resonator filter in the sixth embodiment is changed will be described. Dielectric resonator filter 200B according to a modification (Modification 4) of the sixth embodiment of the invention has dielectric resonators 211B to 231B. Dielectric resonators 211B to 231B respectively have notched portions 212B to 232B.

Similarly to Modification 2, dielectric resonators 211B to 231B respectively have a regular rectangular prismatic shape.

Dielectric resonator filter 200B has no substantial difference from dielectric resonator filter 100B, excluding the number of dielectric resonators, and thus dielectric resonator filter 200B will not be shown.

The experiment result in Modification 4 will be described. In this experiment, dielectric resonators 211B to 231B and notched portions 212B to 232B were defined as in Modification 2.

Figure 71:
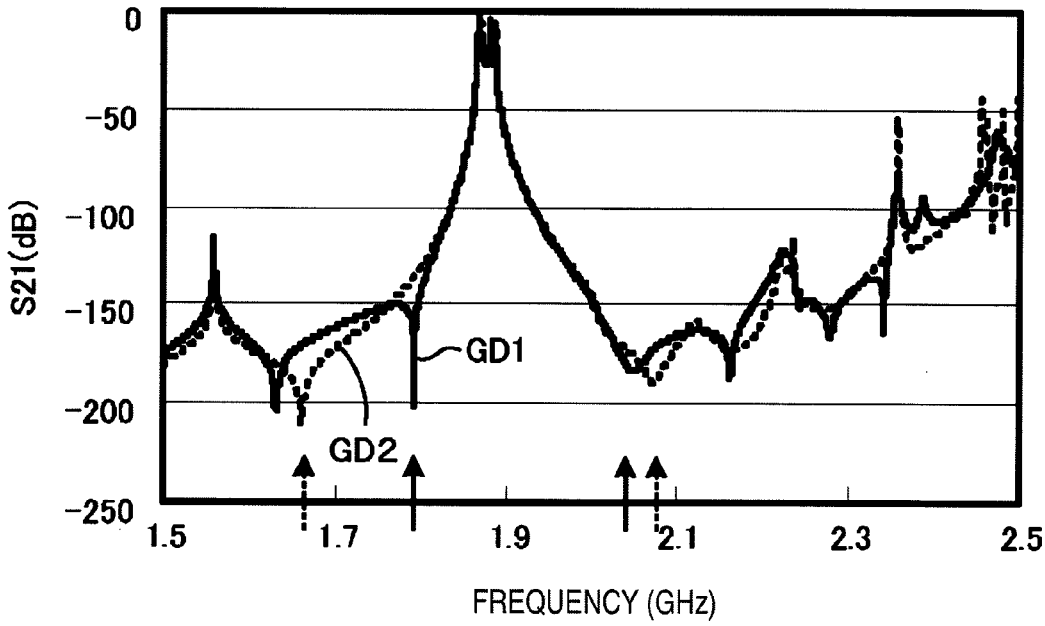
FIG. 71 is a graph showing an example of the electrical characteristic of a dielectric resonator filter according to Modification 4.

FIG. 71 shows the characteristics (graphs GD1 and GD2) of dielectric resonator filter 200C when the angles (θ21, θ22, and θ23) of notched portions 212 to 232 are (0°, 0°, and 0°) and (0°, 0°, and 90°). The graph GD1 has two attenuation poles at around 1.78 GHz and 2.04 GHz, and the graph GD2 has two attenuation poles at around 1.66 GHz and 2.07 GHz (indicated by arrows).

Other Embodiments

Embodiments of the invention are not limited to the foregoing embodiments, and may be expanded and changed. The expansions and changes still fall within the technical scope of the invention.

As described above, the dielectric resonator and the notched portion may have various shapes. As described in the embodiments, the dielectric resonator may be a column or a regular rectangular prism. An intermediate shape, for example, an octagonal prism or an elliptical column may be used. A plate, instead of a column, may be used. As described in the foregoing embodiments, the notched portion may have various shapes, such as a flat plate, a groove, and the like. The shape may differ between a plurality of dielectric resonators. It is considered that electromagnetic coupling between the dielectric resonators is significantly influenced by a stud or a slot arranged between the dielectric resonators, and the influence on electromagnetic coupling of the shape of the dielectric resonator or the notched portion is not quite so significant.

With regard to the angle relationship, a slight width is permitted. For example, with regard to the angle θ16 (θ12–θ11) between the directions A11 and A12 of notched portions 111 and 121, a width of about ±10° (preferably, ±5°) is permitted centered around 90°, and within this range, the bands in dielectric resonator filter 100 can be narrowed. With regard to other angles, the same width was permitted.

In general, a resonator filter is mounted in a base station of a mobile phone or the like. In terms of a compact and high-performance resonator filter, a multiple-mode resonator which can excite a plurality of resonance modes so as to cope with a plurality of frequencies is attracting attention. With regard to such a multiple-mode resonator, various structures are suggested, including a structure using a column as the basic shape, a structure using a cuboid, and the like (for example, see Japanese Patent Unexamined Publication Nos. S57-194603-A and S61-121502-A). In order to excite a plurality of resonance modes in the structure using cuboid, it is necessary to use a structure in which a plurality of cuboids are combined or a structure in which a part of a cuboid is removed three-dimensionally. Further, in order to excite a plurality of resonance modes in the structure using a columnar shape, it is necessary to use a structure in which a screw member or a columnar hole for adjusting the characteristic of the resonator body is provided.

However, of the above-described multiple-mode resonators, the structure using the cuboid shape inevitably has a complex shape for adjusting a desired filter characteristic during manufacturing, which causes an increase in manufacturing costs. Meanwhile, of the above-described multiple-mode resonators, the structure using the columnar shape is made such that the structure of the resonator body is comparatively simple and easily manufactured. However, on the assumption that the above-described structure for characteristic adjustment is provided, the screw member may cause an increase in the transmission signal loss, or complex processing needs to be carried out in order to form the columnar hole. Further, when the frequency adjustment of the multiple-mode resonator is performed by using the structure for characteristic adjustment, a plurality of frequencies are changed complexly according to the design conditions. As a result, a desired filter characteristic is not easily realized, as compared with a single-mode resonator.

Accordingly, it is yet another object of the invention to provide a multiple-mode dielectric resonator capable of easily adjusting a desired characteristic while reducing a transmission loss with a comparatively simple structure.

In order to solve the above-described problem, a dielectric resonator according to yet another embodiment of the invention includes a prism-shaped dielectric resonant element fixed in a cavity surrounded by an external conductor so as to excite a plurality of resonance modes, and a dielectric adjustment piece arranged to be opposite the top surface or bottom surface of the dielectric resonant element and configured such that the distance from the dielectric resonant element is adjustable.

With this dielectric resonator, the prism-shaped dielectric resonant element excites a plurality of resonance modes, and the frequency characteristics corresponding to the resonance modes are provided to the transmission signals. Then, the dielectric adjustment piece is displaced so as to adjust the distance from the dielectric resonant element, so an optimum frequency characteristic can be set. Therefore, it is not necessary to provide a special structure, such as a screw member or a columnar hold for adjusting the frequency characteristic. As a result, a multiple-mode dielectric resonator capable of easily adjusting a plurality of frequencies can be realized without using complex processing.

A part of the dielectric resonant element may be cut so as to excite a plurality of resonance modes, and the frequency characteristic may have an attenuation pole. With this configuration, the frequency characteristics corresponding to a plurality of resonance modes can be easily realized according to the positional relationship between the cut surface of the dielectric resonant element, and the electrical signal input section and electrical signal output section.

The electrical signal input section and the electrical signal output section may be attached to the external conductor on the side surface of the dielectric resonant element, the directions from the central axis to the electrical signal input section and the electrical signal output section within the circular section of the dielectric resonant element may be perpendicular to each other, and the normal to the cut surface of the dielectric resonant element may be at about 45 degrees with respect to the two directions. With this configuration, from the symmetry regarding the arrangement of the cut surface with respect to the electrical signal input section and the electrical signal output section, a multiple-mode dielectric resonator capable of easily adjusting two frequencies can be realized.

The dielectric resonant element may be formed to have a columnar shape. Further, the dielectric resonant element may be formed to have a polygonal sectional shape. In this case, the sectional shape may be an octagonal shape.

The dielectric adjustment piece may be formed to have a columnar shape arranged on the same central axis as the dielectric resonant element. In this case, the dielectric adjustment piece may be formed by using the same dielectric material as the dielectric resonant element.

The dielectric resonant element may excite the resonance mode at a first frequency and the resonance mode at a second frequency higher than the first frequency. The first frequency and the second frequency may be changed with the adjustment of the dielectric adjustment piece, and the coupling coefficient of the first frequency and the second frequency may be maintained constant. Therefore, the first frequency and the second frequency can be changed in conjunction with each other, so a filter characteristic capable of freely varying a pass frequency can be easily realized.

Yet another embodiment of the invention provides a method of adjusting a multiple-mode dielectric resonator in which, for the dielectric resonant element configured to excite the resonance mode at a first frequency and the resonance mode at a second frequency higher than the first frequency, frequency characteristics are adjusted by adjusting the dielectric adjustment piece and changing the first frequency and the second frequency while maintaining the coupling coefficient of the first frequency and the second frequency constant.

As described above, according to the embodiment of the invention, the multiple-mode dielectric resonator includes the prism-shaped dielectric resonator body, and the dielectric adjustment piece arranged to be opposite the top surface or bottom surface of the dielectric resonator body. Therefore, the frequency characteristics in which a plurality of resonance modes are excited can be realized with simple configuration, and the frequency characteristics can be easily controlled by adjusting the distance between the dielectric resonator body and the dielectric adjustment piece. In this case, if a part of the dielectric resonator body is cut, and the terminals for transmission signal input/output are appropriately arranged, the frequencies corresponding to a plurality of resonance modes can be changed in conjunction with each other. That is, the filter characteristic in which two frequencies are changed in the same direction while the coupling coefficient is maintained constant can be realized. According to the embodiment of the invention, it is possible to realize a multiple-mode dielectric resonator capable of ensuring good manufacturing capability without using complex processing for frequency adjustment, easily adjusting accurate frequency characteristics with a small transmission loss, and being applied to various filters.

Embodiments of the invention will be described with reference to the drawings. Hereinafter, the invention is applied to a dielectric resonator whose frequency characteristic has two peaks to correspond to two resonance modes (dual mode). Two embodiments having different structures will be described.

Seventh Embodiment

Figure 72:
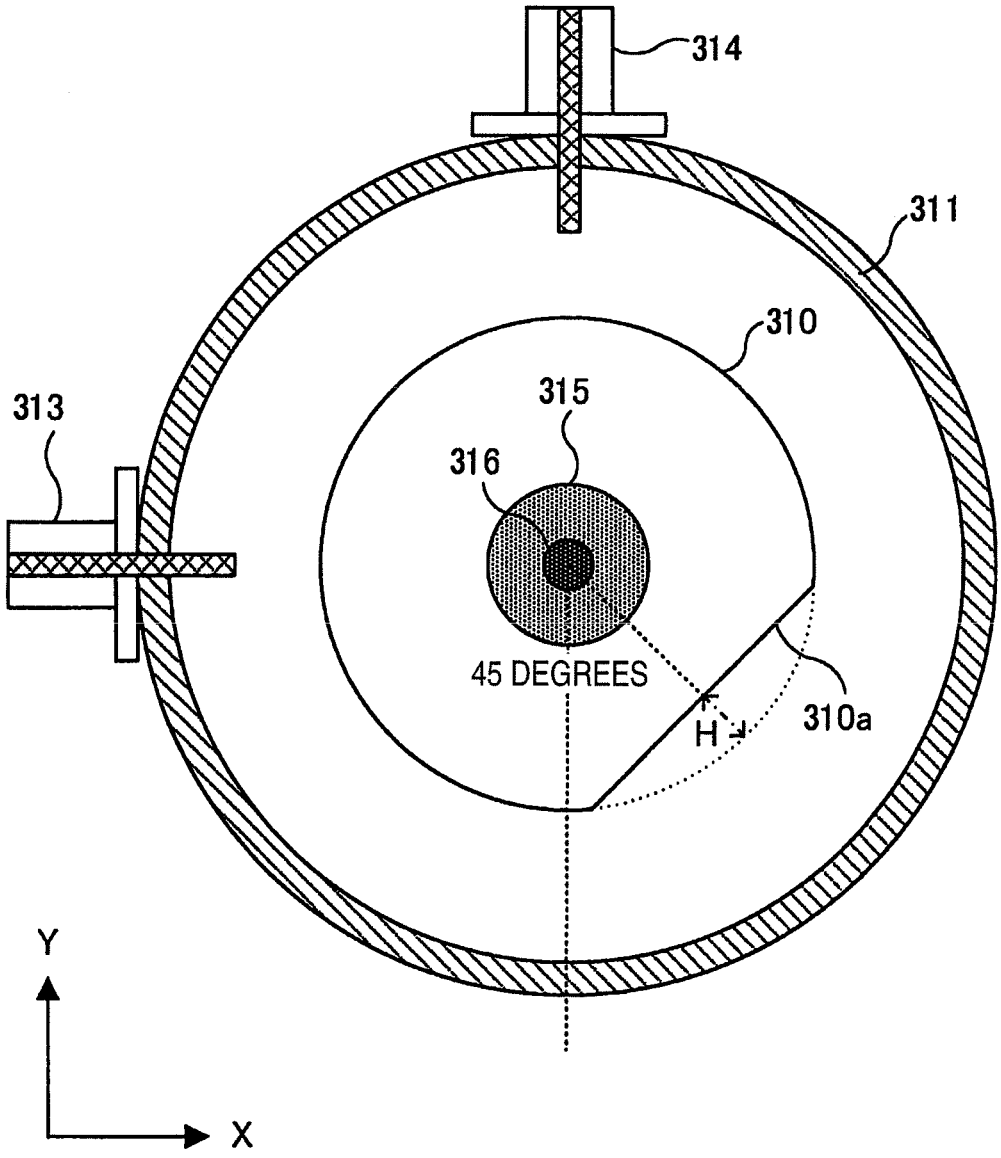
FIG. 72 is a top view of a dielectric resonator according to a seventh embodiment.
Figure 73:
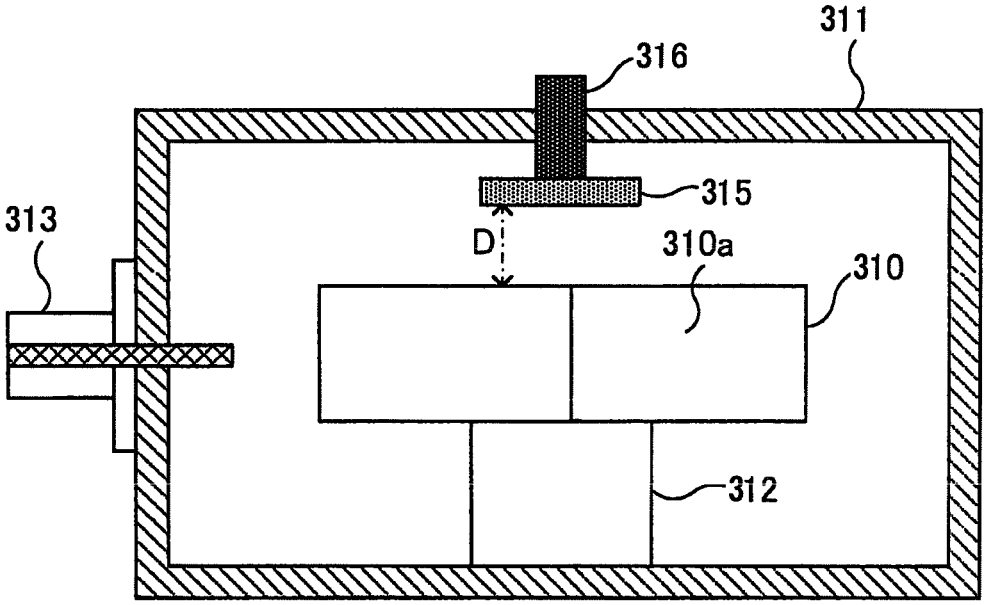
FIG. 73 is a side view of the dielectric resonator shown in FIG. 72.

The structure of a dielectric resonator of a seventh embodiment will be described with reference to FIGS. 72 and 73. FIG. 72 is a top view of a dielectric resonator according to the seventh embodiment. FIG. 73 is a side view of the dielectric resonator shown in FIG. 72. As shown in FIGS. 72 and 73, the dielectric resonator of the seventh embodiment includes dielectric resonator body (also referred to as dielectric resonant element) 310, conductor case 311, support board 312, input terminal (also referred to as electrical signal input section) 313, output terminal (also referred to as electrical signal output section) 314, dielectric adjustment piece 315, and support rod 316.

Dielectric resonator body 310 has a shape in which a part of a column is cut, and is arranged at the substantially center of a cavity surrounded by cylindrical conductor case 311. The bottom surface of dielectric resonator body 310 is fixed by support board 312 attached to conductor case 311. Dielectric resonator body 310 is formed of a dielectric material having a predetermined relative dielectric constant. Dielectric resonator body 310 is electrically isolated from an external space by surrounding conductor case 311. Support board 312 is formed of, for example, alumina or the like, and has a cylindrical shape.

Input terminal 313 and output terminal 314 are attached to the side surface of conductor case 311. Input terminal 313 is a terminal to which input signals supplied from the outside are supplied, and output terminal 314 is a terminal through which output signals excited in a plurality of resonance modes are output to the outside. For convenience, the X axis and the Y axis are shown at the lower portion of FIG. 72. When viewed from the central axis of dielectric resonator body 310, input terminal 313 is arranged in the X direction, and output terminal 314 is arranged in the Y direction. That is, input terminal 313 and output terminal 314 are positioned so as to be orthogonal to each other within the plan including the circular section of dielectric resonator body 310. Input terminal 313 and output terminal 314 may be arranged reversely.

Cut surface 310*a* of dielectric resonator body 310 is formed such that the normal thereof is at an angle of 45 degrees with respect to the X axis and the Y axis within the horizontal plane. The structure in which cut surface 310*a* is formed at such an angle is an example of the structure in which dielectric resonator body 310 excites two resonance modes. The cut amount H of cut surface 310*a* shown in FIG. 72, that is, the distance from the circumference position of the circular section of dielectric resonator body 310 before cutting to the center position of cut surface 310*a*, has a large influence on the characteristics of the resonance modes, so it is preferable to determine an optimum cut amount H so as to obtain a desired characteristic.

Dielectric adjustment piece 315 is arranged to be opposite the top surface of dielectric resonator body 310, and has a columnar shape whose central axis matches dielectric resonator body 310. In the seventh embodiment, the diameter of the circular section of dielectric adjustment piece 315 is set to be sufficiently smaller than that of dielectric resonator body 310, and dielectric adjustment piece 315 is formed of the same dielectric material as dielectric resonator body 310. Support rod 316 is attached to the upper portion of dielectric adjustment piece 315, so the position of dielectric adjustment piece 315 in the vertical direction can be changed by support rod 316. Therefore, the distance D (see FIG. 73) between dielectric resonator body 310 and dielectric adjustment piece 315 can be freely adjusted.

With the configuration of the seventh embodiment, the arrangement of each of input terminal 313 and output terminal 314 is symmetric to the arrangement of cut surface 310*a* in the vertical direction. Therefore, when dielectric adjustment piece 315 is displaced in the vertical direction, the substantially same operation is provided to the two resonance modes. As a result, two frequencies corresponding to the two resonance modes are changed in conjunction with each other. This will be described below in detail.

Figure 74:
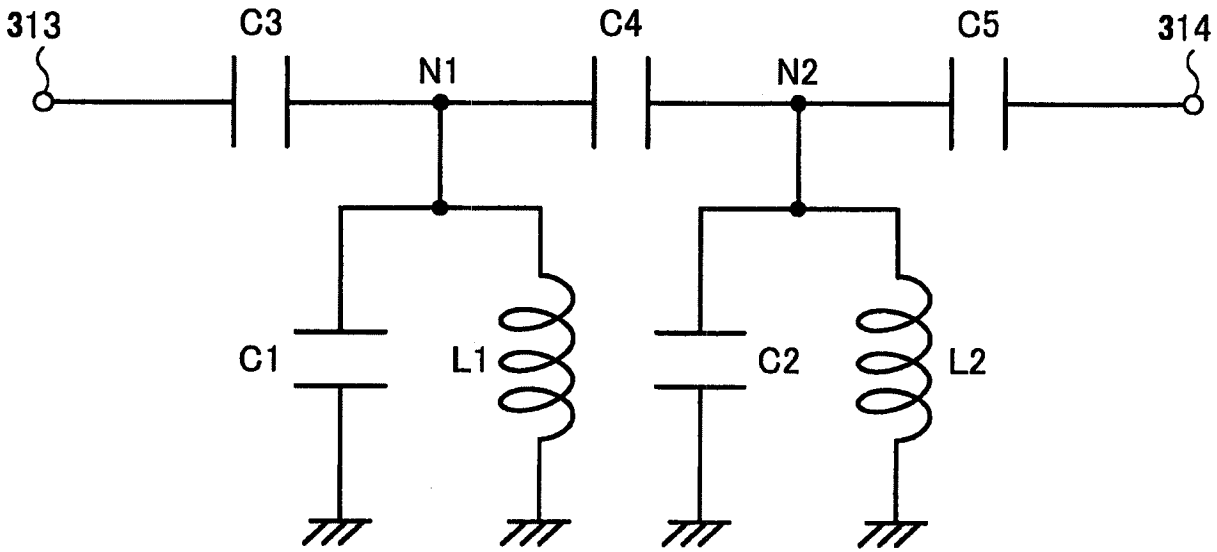
FIG. 74 is a diagram showing the equivalent circuit of the dielectric resonator according to the seventh embodiment.

Next, FIG. 74 is a diagram showing the equivalent circuit of the dielectric resonator of the seventh embodiment. The equivalent circuit shown in FIG. 74 includes capacitance C3, C4, and C5 connected in series between input terminal 313 and output terminal 314, capacitance C1 and inductance L1 connected in parallel between node N1 and the ground, and capacitance C2 and inductance L2 connected in parallel between node N2 and the ground.

Capacitance C1 and inductance L1 form a resonance circuit corresponding to one resonance mode of the dielectric resonator. Capacitance C2 and inductance L2 form a second resonance circuit corresponding to the other resonance mode of the dielectric resonator. Capacitance C3 is coupling capacitance between input terminal 313 and the first resonance circuit, and capacitance C5 is a coupling circuit between output terminal 314 and the second resonance circuit. Capacitance C4 is inter-stage coupling capacitance formed by cut surface 310*a*.

The constants of the respective circuit elements shown in FIG. 74 are changed depending on the material or size of each member constituting the dielectric resonator. In particular, changes in the values of capacitance C1, C2, and C4 and inductance L1 and L2 depending on the position and size of cut surface 310*a* formed in dielectric resonator body 310 control the characteristics of the resonance modes, so it is important to form optimum cut surface 310*a*.

Next, the characteristics of the dielectric resonator of the seventh embodiment will be described with reference to FIGS. 75 to 77. With regard to the sizes of dielectric resonator body 310 and dielectric adjustment piece 315, for example, dielectric resonator body 310 has a diameter of about 40 mm and a height of about 10 mm, dielectric adjustment piece 315 has a diameter of about 10 mm and a height of about 0.25 mm. The adjustment range of dielectric adjustment piece 315 supposes that the distance D from dielectric resonator body 310 is displaced in the range of 1 to 5 mm.

Figure 75:
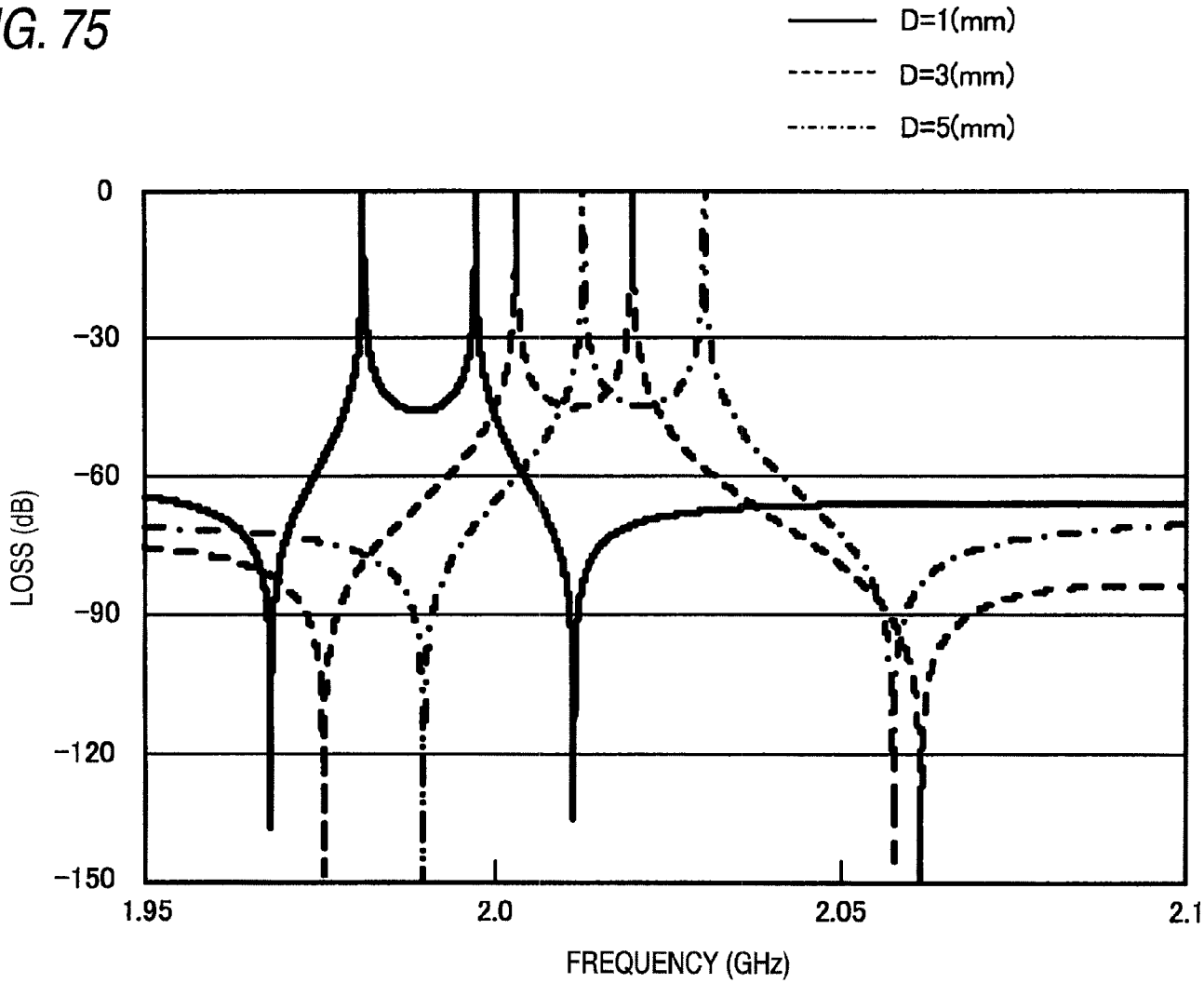
FIG. 75 is a diagram showing the frequency characteristic of a transmission signal in the dielectric resonator according to the seventh embodiment.

FIG. 75 shows the frequency characteristic of a transmission signal in the dielectric resonator. A graph represents a signal loss between input terminal 313 and output terminal 314 in a comparatively narrow frequency range of around 2 GHz. FIG. 75 shows the frequency characteristics in comparison when the distance D is adjusted to three values (D=1, 3, and 5 mm). As will be seen from FIG. 75, a peak at which a loss is close to 0 (dB) at a first frequency on the low frequency side and a second frequency on the high frequency side is generated, but a loss increases at other frequencies.

The two peaks in the frequency characteristics of FIG. 75 are generated to correspond to the two resonance modes of the dielectric resonator. When the first frequency is FL and the second frequency is FH, the first frequency and the second frequency have a frequency difference of about 200 MHz. It can be seen that, as the distance D of dielectric adjustment piece 315 increases to 1 mm, 3 mm, and 5 mm, the first and second frequencies FL and FH in the frequency characteristics increase together.

The frequency characteristics of FIG. 75 have downward peaks as well as two upward peaks at the frequencies FL and FH. The downward peak in the frequency characteristic is called an attenuation pole. In general, the filter characteristic should be steep, so it is preferable that an attenuation pole exists. The attenuation pole in the frequency characteristic can be generated according to the position of cut surface 310*a* formed in dielectric resonator body 310.

Figure 76:
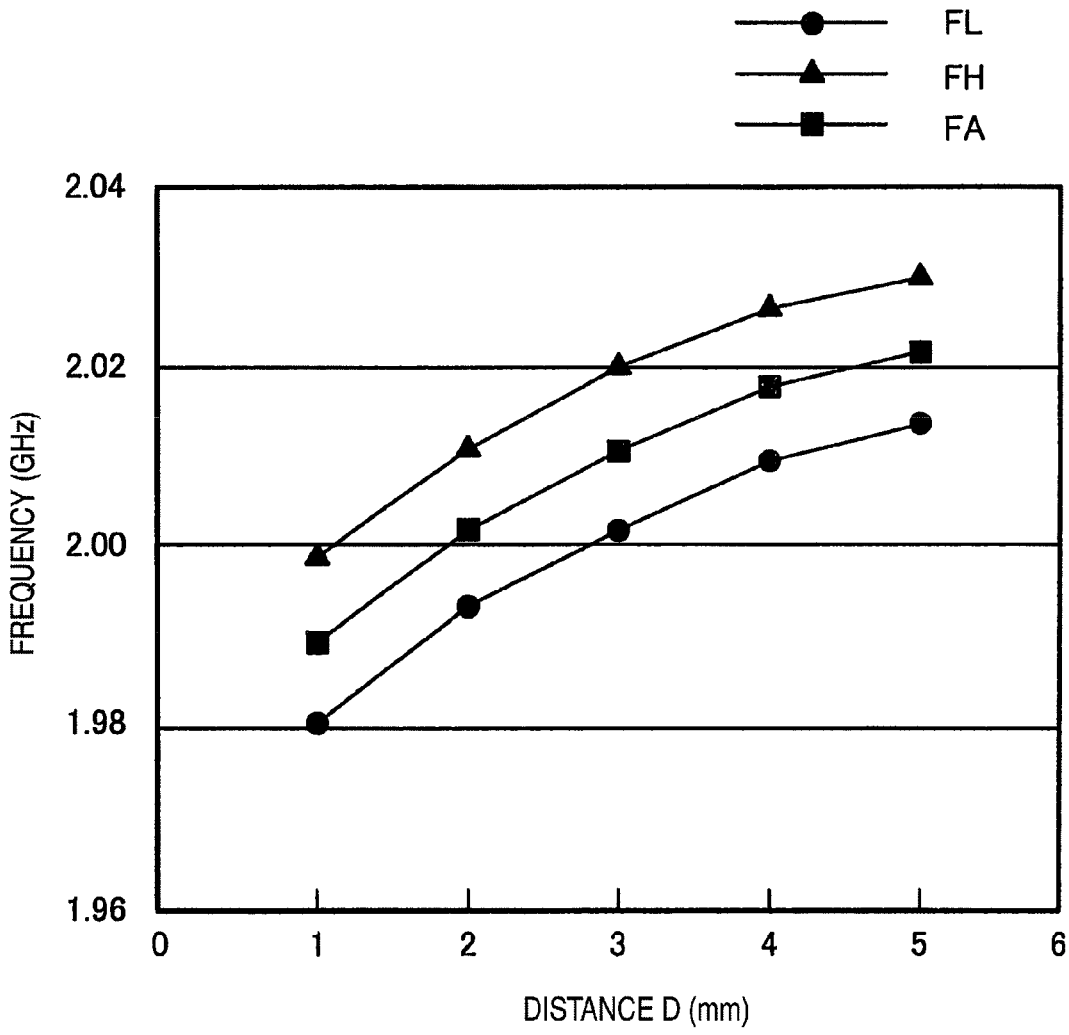
FIG. 76 is a diagram showing the relationship between a distance D and a frequency characteristic in the dielectric resonator according to the seventh embodiment.

FIG. 76 shows the relationship between the change in the distance D and the frequency characteristic. As shown in FIG. 76, in addition to the first frequency FL and the second frequency FH, a change in an average frequency FA (FA=(FL+FH)/2) with respect to the distance D is indicated by a graph. From the above-described frequency characteristics, it can be seen that, as the distance D increases, the frequencies FL, FH, and FA gradually increase. Further, the changes in the frequencies FL, FH, and FA with respect to the distance D are in conjunction with each other on the same tendency. This is based on the operation of displacement of dielectric adjustment piece 315 with respect to two resonance modes, as described above.

Figure 77:
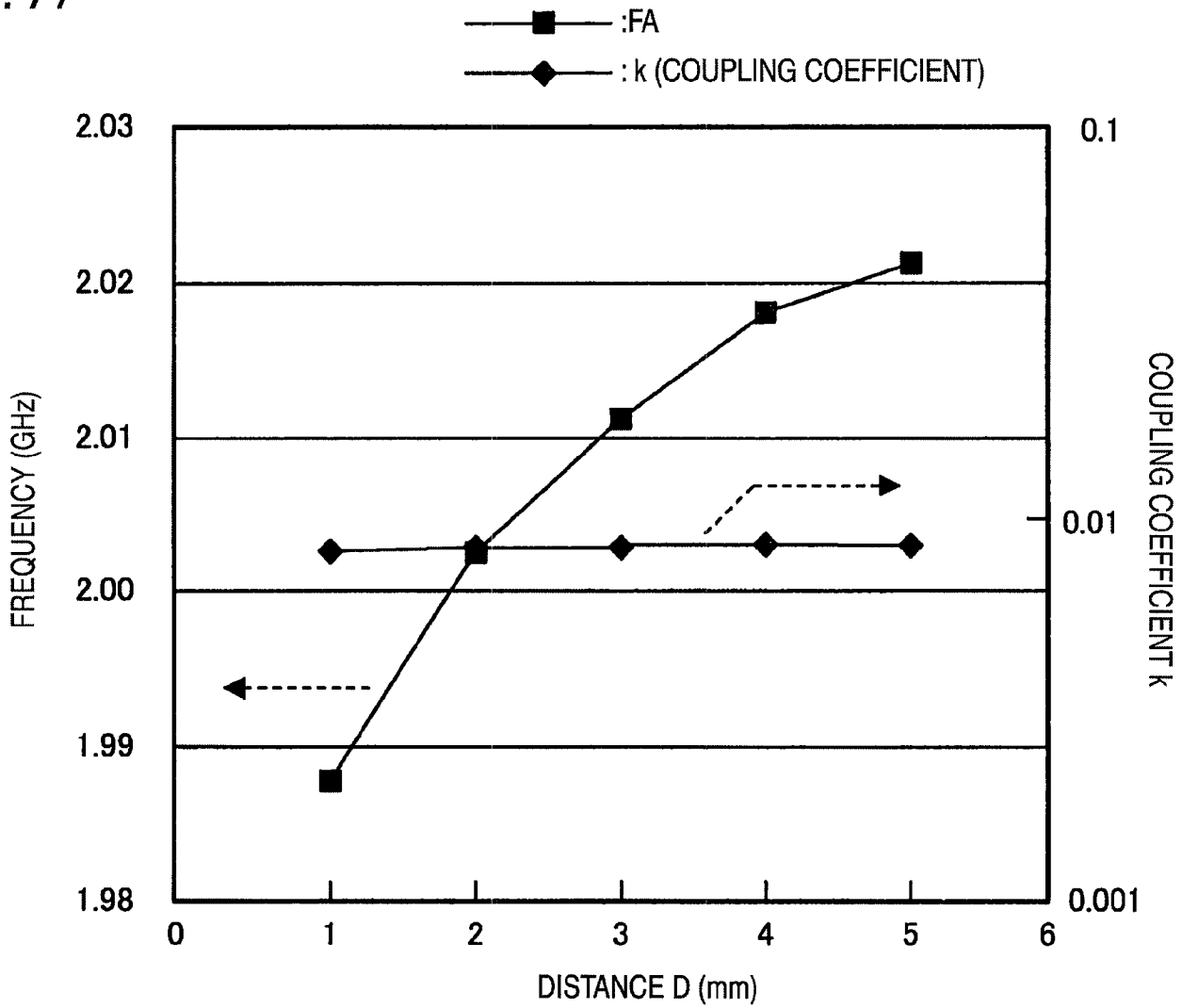
FIG. 77 is a diagram showing the relationship between a change in a distance D, an average frequency FA, and a coupling coefficient k in the dielectric resonator according to the seventh embodiment.

FIG. 77 shows the relationship between the change in the distance D, the average frequency FA, and the coupling coefficient k. The coupling coefficient k is calculated by k=(FH−FK)/FA, and is the amount indicating how much the first frequency FL and the second frequency FH are relatively separated from each other. The frequency axis of FIG. 77 magnifies and shows a change in the average frequency FA on a scale in a range narrower than FIG. 76. It can be seen that, the smaller the distance D is, the more the average frequency FA increases, and the average frequency FA has maximum value at D=5 mm. It can be seen that the coupling coefficient k is stably maintained at the value of about 0.01 over the entire range of the distance D.

Although in the example of FIG. 77, the coupling coefficient k is maintained at the value of about 0.01, a different coupling coefficient k may be set by changing the cut amount H (FIG. 72) with respect to dielectric resonator body 310. It should suffice that the cut amount H increases so as to increase the coupling coefficient k with reference to FIG. 77, and the cut amount H decreases so as to decrease the coupling coefficient k. The optimum value of the coupling coefficient k that should be set is determined in accordance with a necessary frequency characteristic in a circuit having the dielectric resonator of the seventh embodiment.

FIGS. 75 to 77 show examples of the characteristic obtained by using the dielectric resonator of the seventh embodiment. Actually, various characteristics may be realized according to the design conditions. Especially, the sizes of dielectric resonator body 310 and dielectric adjustment piece 315 have a great influence on the frequency characteristic, so it is preferable that a desired design condition is optimized.

As described above, the dielectric resonator of the seventh embodiment has the characteristics shown in FIGS. 75 to 77, so the first and second frequencies FL and FH can be adjusted in conjunction with each other by dielectric adjustment piece 315 while the coupling coefficient k is maintained constant. For example, if a filter is configured to have the dielectric resonator of this embodiment, the pass frequency band including the first and second frequencies FL and FH is freely variable. In this case, the frequencies FL, FH, and FA (FIG. 77) can be changed in detail with respect to the change in the distance D, which facilitates the application to a band variable filter in which accurate frequency adjustment is possible. Further, dielectric adjustment piece 315 which is displaceable in the vertical direction is used as the means for frequency adjustment, so it is possible to suppress a transmission signal loss or processing complexity when a structure, such as a screw member or a columnar hole is used.

Figure 78:
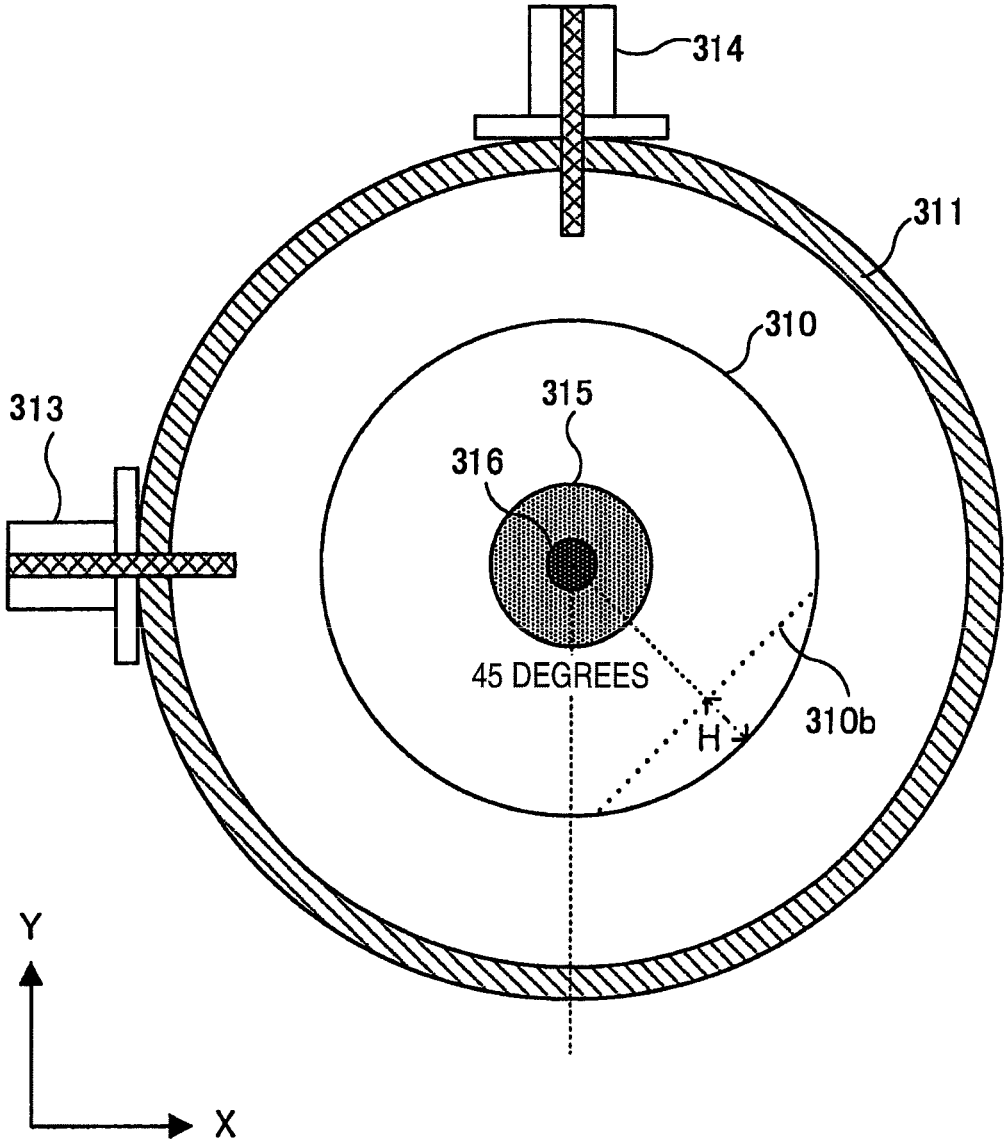
FIG. 78 is a top view of a dielectric resonator according to a modification of the seventh embodiment.
Figure 79:
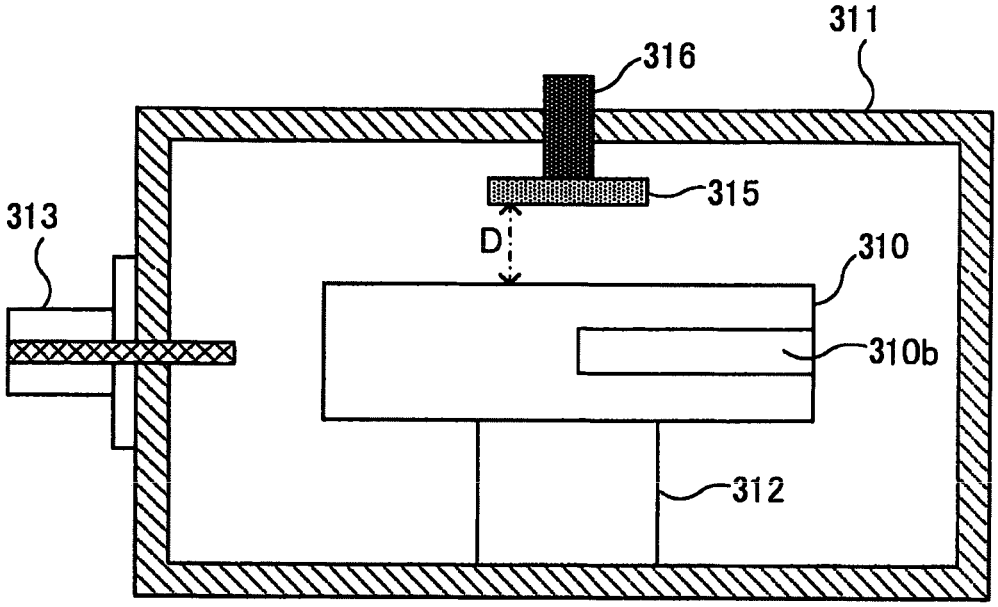
FIG. 79 is a side view of the dielectric resonator shown in FIG. 78.

Next, a modification of the seventh embodiment will be described. FIG. 78 is a top view of a dielectric resonator according to a modification of the seventh embodiment. FIG. 79 is a side view of the dielectric resonator shown in FIG. 78. As shown in FIGS. 78 and 79, the modification of the seventh embodiment is made by changing the structure of dielectric resonator body 310 shown in FIGS. 72 and 73. In FIG. 79, cut surface 310*b* of dielectric resonator body 10 is formed to have a concave section when viewed from the lateral direction. That is, a part around the center of the side surface of dielectric resonator body 310 in the central axis direction is cut, and the top surface and the bottom surface are not cut. In FIGS. 78 and 79, the same structure as shown in FIGS. 72 and 73 is provided, excluding dielectric resonator body 310 and cut surface 310*b*. The structure of cut surface 310*b* of FIGS. 78 and 79 is an example, and the position or width of the concave section is changeable. In the modification of the seventh embodiment, even though cut surface 310*b* of FIGS. 78 and 79 is formed, the characteristics shown in FIGS. 75 to 77 can be realized by appropriately setting the dimension condition and the like.

Eighth Embodiment

Figure 80:
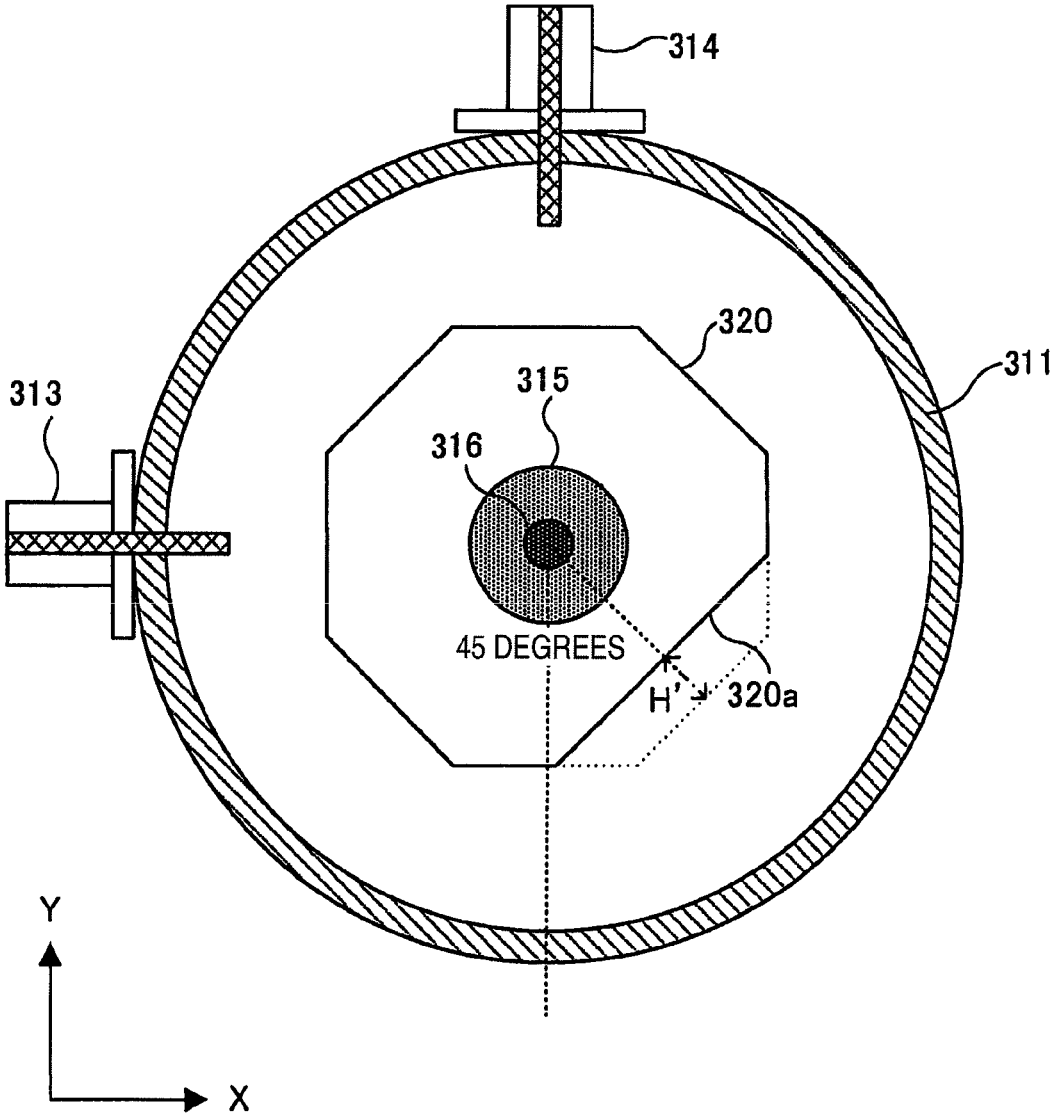
FIG. 80 is a top view of a dielectric resonator according to an eighth embodiment.
Figure 81:
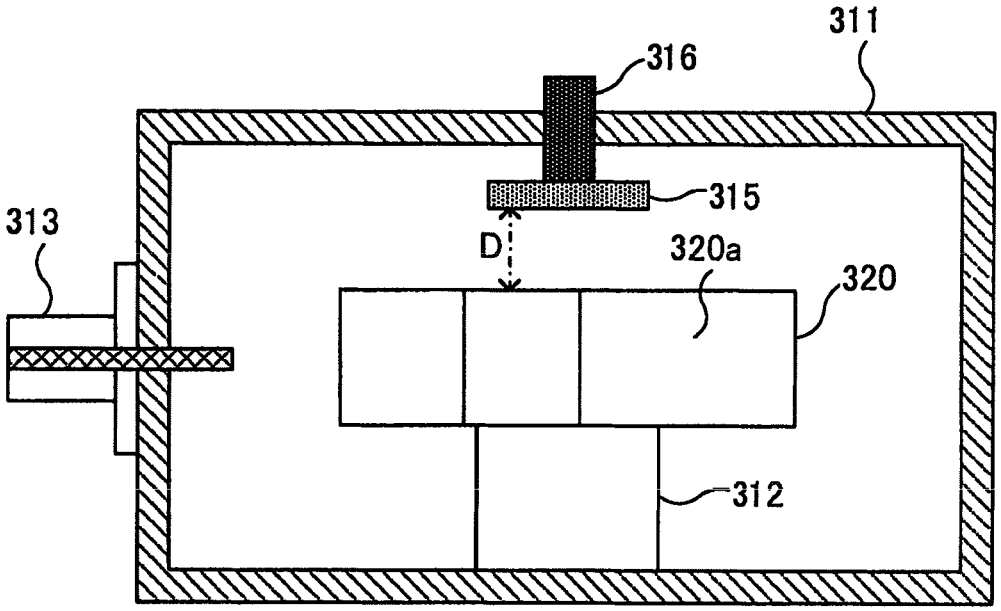
FIG. 81 is a side view of the dielectric resonator shown in FIG. 80.

Next, the structure of a dielectric resonator of an eighth embodiment will be described with reference to FIGS. 80 and 81. FIG. 80 is a top view of a dielectric resonator according to an eighth embodiment. FIG. 81 is a side view of the dielectric resonator shown in FIG. 80. The dielectric resonator of the eighth embodiment includes dielectric resonator body 320 having a different shape from that in the seventh embodiment. With regard to conductor case 311, support board 312, input terminal 313, output terminal 314, dielectric adjustment piece 315, and support rod 316, the same structures as in the seventh embodiment are provided.

As shown in FIG. 80, dielectric resonator body 320 of the eighth embodiment has an octagonal sectional shape, not a columnar shape, and the central axis of dielectric resonator body 320 is arranged at the same position as in FIG. 72. In dielectric resonator body 320 of FIG. 80, cut surface 320*a* is formed on one side in the same direction as cut surface 310*a* of FIG. 72 when viewed from the central axis. Within the section of dielectric resonator body 320, one side facing cut surface 320*a* is closer to the central axis by a distance H' than are the other sides. Dielectric adjustment piece 315 has the same structure as in FIG. 72, and the distance D (FIG. 81) from dielectric resonator body 320 can be adjusted by rotating support rod 316 around the rotation axis of dielectric resonator body 320 in the central axis direction.

Figure 82:
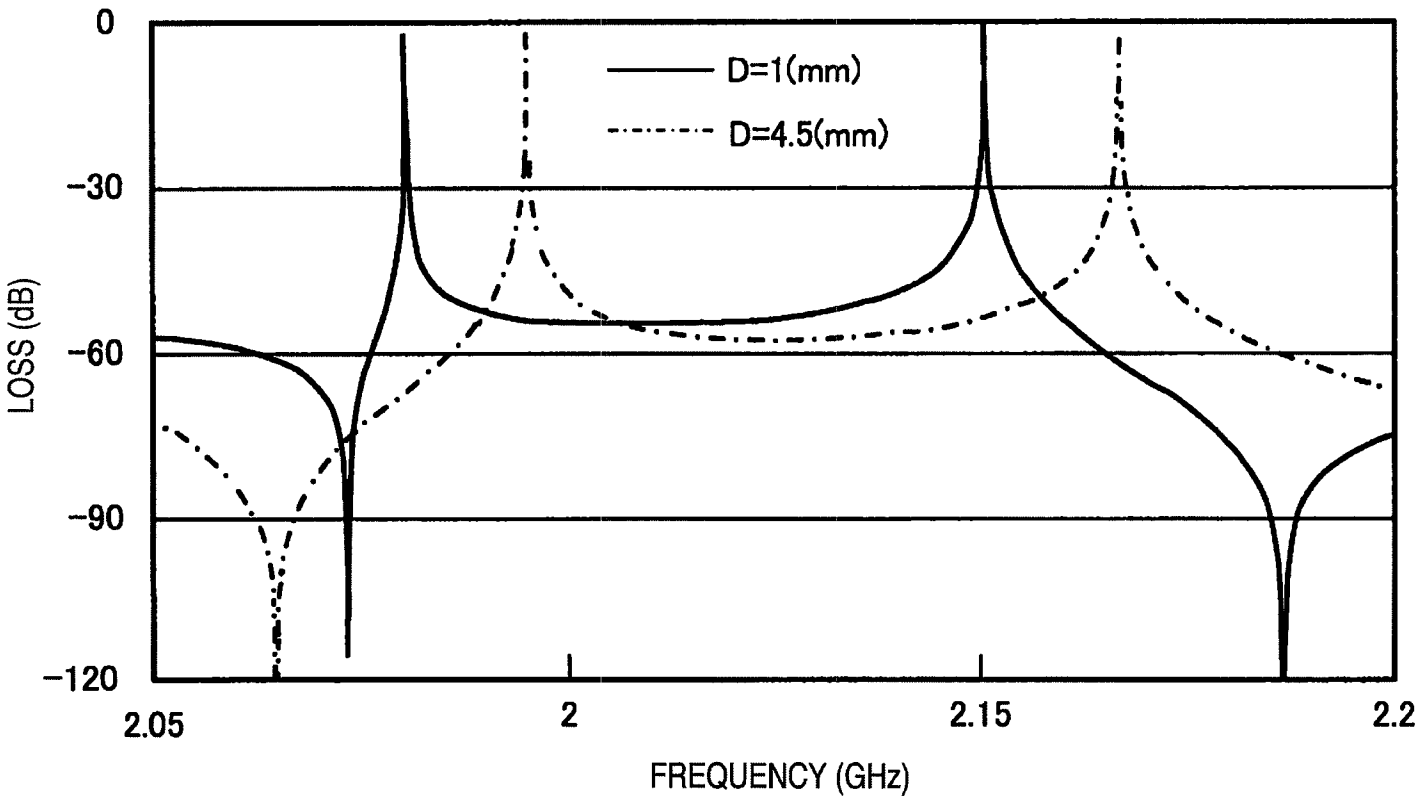
FIG. 82 is a diagram showing the frequency characteristic of a transmission signal in the dielectric resonator according to the eighth embodiment.

Next, the characteristic of the dielectric resonator of the eighth embodiment will be described with reference to FIGS. 82 and 83. FIG. 82 is a graph showing the frequency characteristic of a transmission signal in the dielectric resonator of the eighth embodiment, similarly to FIG. 75 of the seventh embodiment. FIG. 82 shows the frequency characteristics in comparison when the distance D is adjusted to two values, D=1 mm and D=4.5 mm. As will be apparent from FIG. 82, similarly to FIG. 75, the low frequency side and the high frequency side respectively have peaks. In FIG. 82, the characteristic of the frequency at which each peak appears or the attenuation region is different from FIG. 75. This difference results from the difference in the condition regarding the size of each member or the like.

Figure 83:
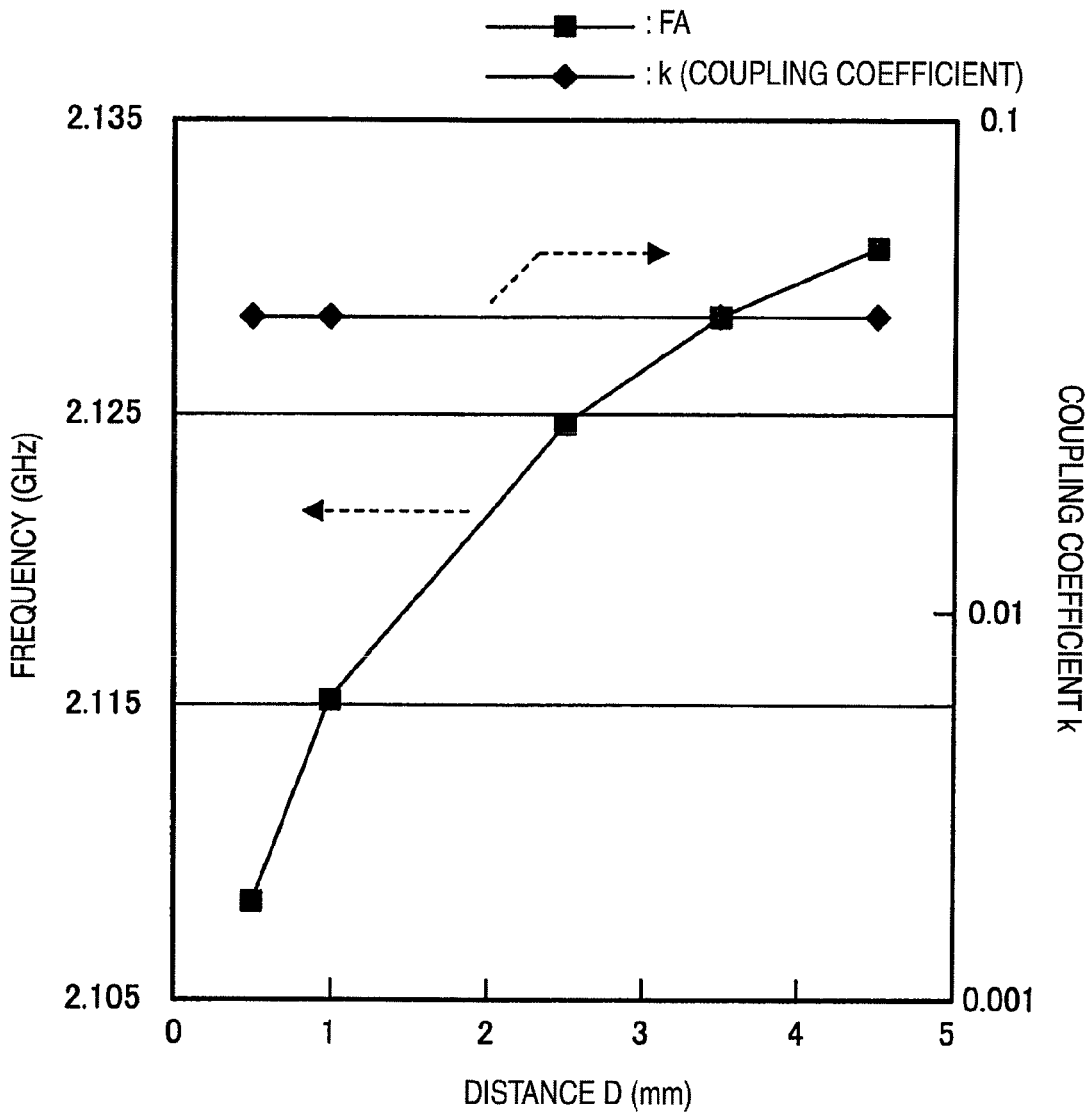
FIG. 83 is a diagram showing the relationship between a change in a distance D, an average frequency FA, and a coupling coefficient k in the dielectric resonator according to the eighth embodiment.

FIG. 83 shows the relationship between the change in the distance D, the average frequency FA, and the coupling coefficient k in the dielectric resonator of the eighth embodiment, similarly to FIG. 77 of the seventh embodiment. As will be apparent from FIG. 83, as the distance D increases, the average frequency FA increases, but even though the distance D changes, the coupling coefficient k is maintained at a constant value. Thus, the characteristic of FIG. 83 change on the substantially same tendency as FIG. 77 of the seventh embodiment.

Figure 84:
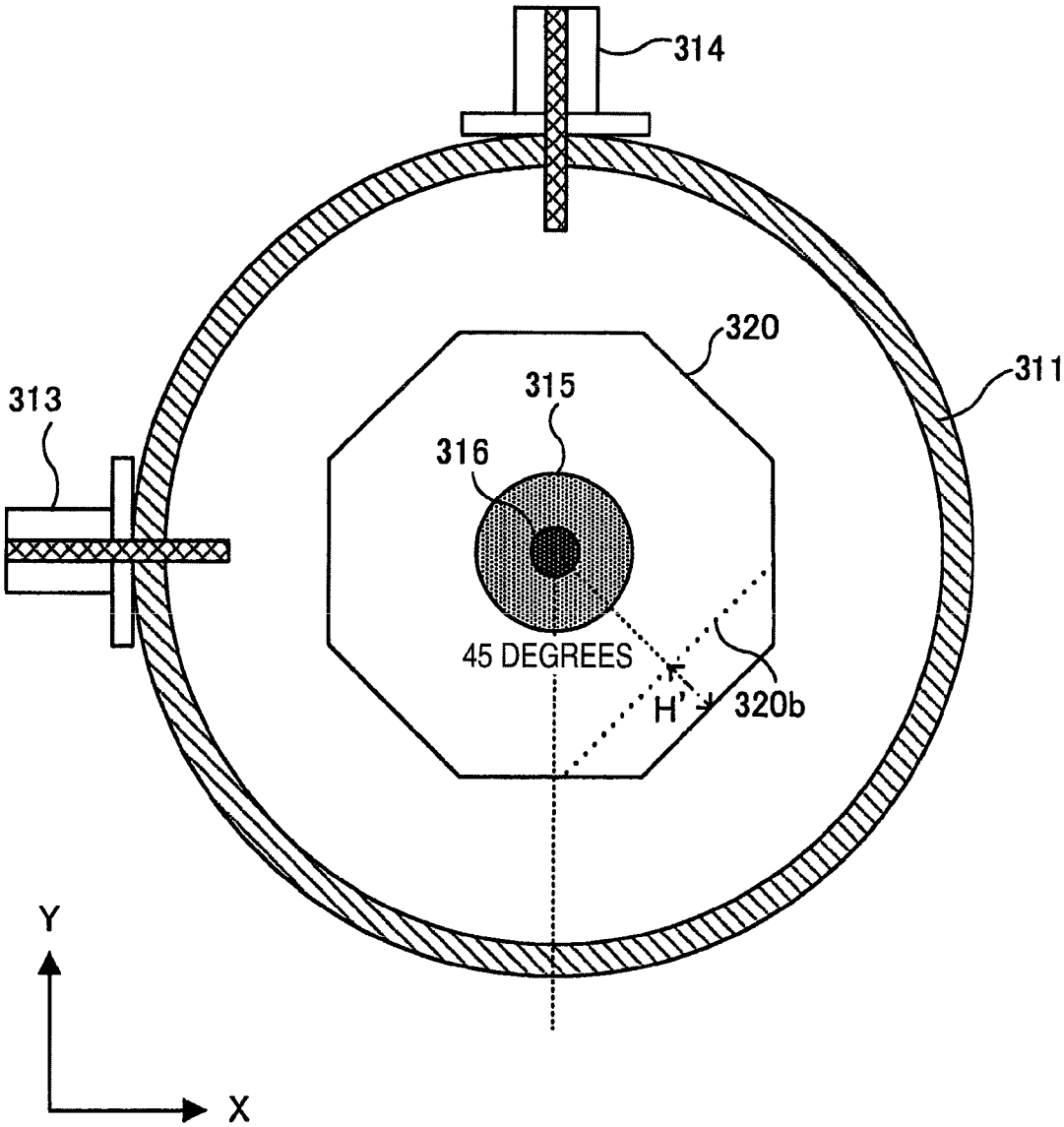
FIG. 84 is a top view of a dielectric resonator according to a modification of the eighth embodiment.
Figure 85:
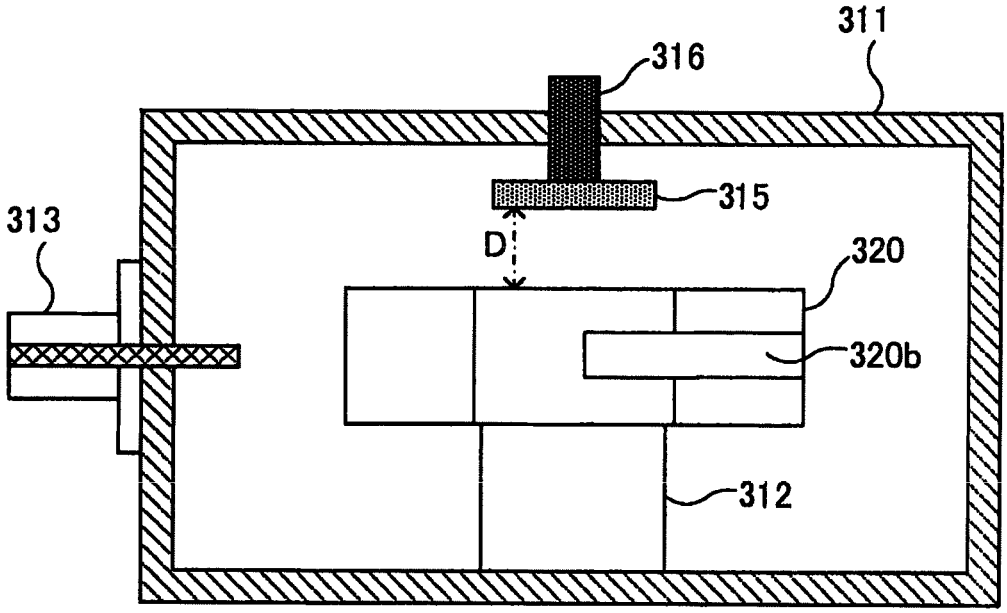
FIG. 85 is a side view of the dielectric resonator shown in FIG. 84.

Next, a modification of the eighth embodiment will be described. FIG. 84 is a top view of a dielectric resonator according to a modification of the eighth embodiment. FIG. 85 is a side view of the dielectric resonator shown in FIG. 84. As shown in FIGS. 84 and 85, from the same viewpoint as the modification of the seventh embodiment shown in FIGS. 78 and 79, the modification of the eighth embodiment is made by changing the structure of dielectric resonator body 320. In FIG. 85, similarly to FIG. 79, cut surface 320*b* of dielectric resonator body 320 is formed to have a concave section when viewed from the lateral direction. In FIGS. 84 and 85, the same structure as shown in FIGS. 80 and 81 is provided, excluding dielectric resonator body 320 and cut surface 320*b*. The structure of cut surface 320*b* of FIGS. 84 and 85 is an example, and the position or width of the concave section is changeable.

Figure 86:
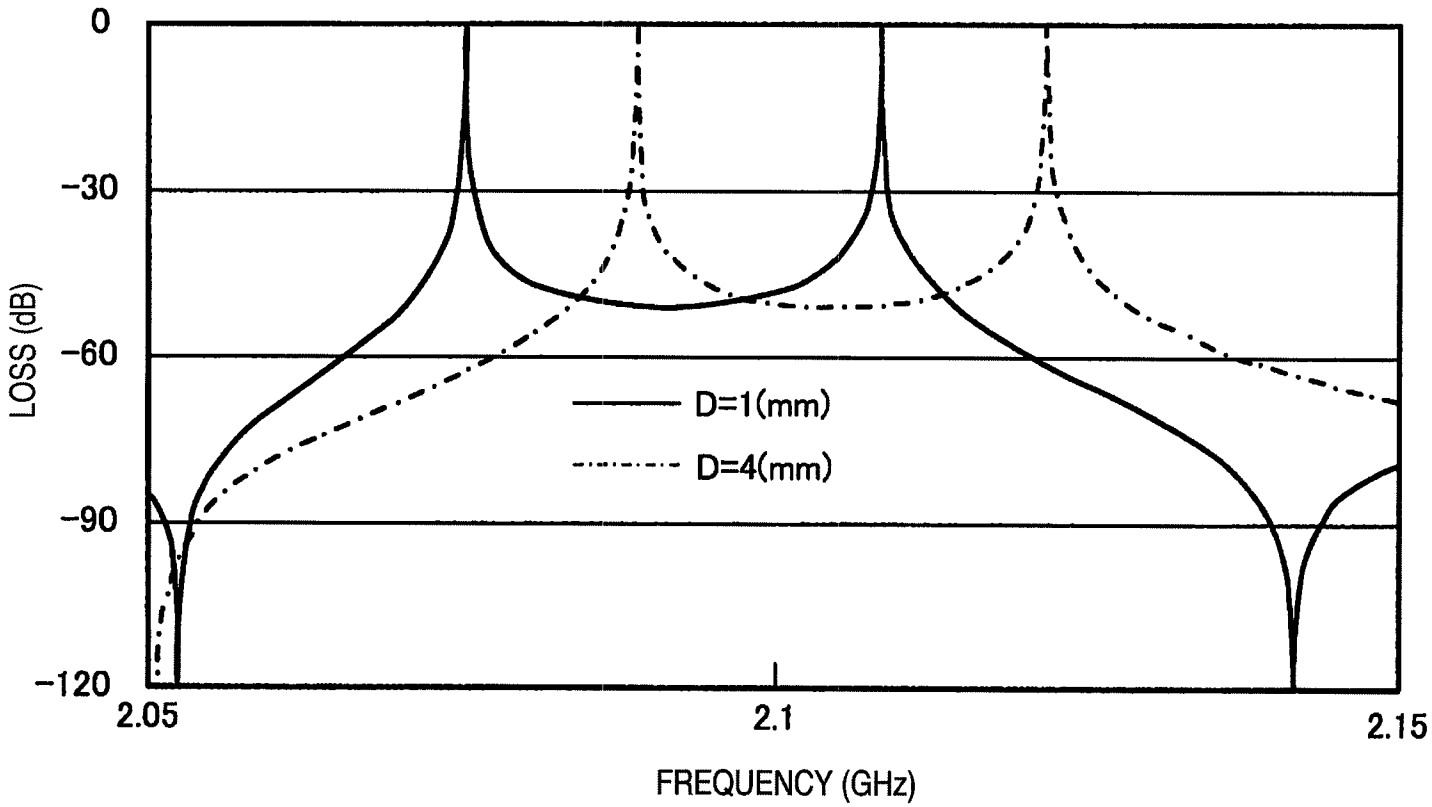
FIG. 86 is a diagram showing the frequency characteristic of a transmission signal in the dielectric resonator according to the modification of the eighth embodiment.

Next, the characteristic of the dielectric resonator according to the modification of the eighth embodiment will be described with reference to FIGS. 86 and 87. FIG. 86 is a graph showing the frequency characteristic of a transmission signal in the modification of the eighth embodiment, similarly to FIG. 82. FIG. 86 shows the frequency characteristics in comparison when the distance D is adjusted to two values, D=1 mm and D=4 mm. It can be seen that, with regard to the characteristic of FIG. 86, the substantially same tendency as in FIG. 82 appears.

Figure 87:
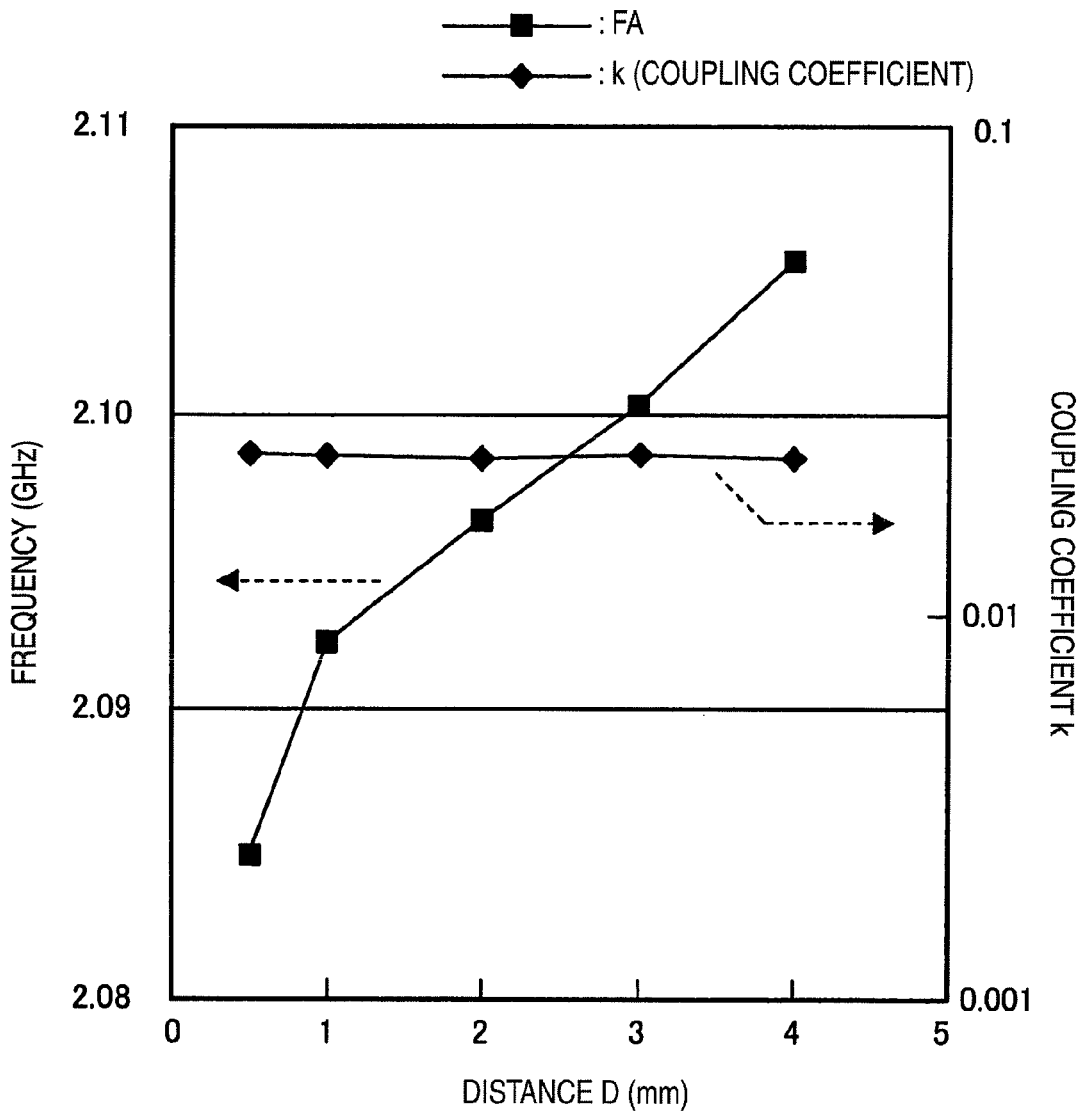
FIG. 87 is a diagram showing the relationship between a change in a distance D, an average frequency FA, and a coupling coefficient k in the dielectric resonator according to the modification of the eighth embodiment.

FIG. 87 shows the relationship between the change in the distance D, the average frequency FA, and the coupling coefficient k in the dielectric resonator according to the modification of the eighth embodiment, similarly to FIG. 83. It can be seen that, with regard to the characteristic of FIG. 87, the substantially same tendency as in FIG. 83 appears.

Although the invention has been described in detail with reference to the foregoing two embodiments, the invention is not limited to the foregoing embodiments, and various modifications may be made without departing from the subject matter of the invention. For example, although in the foregoing embodiments, a case where dielectric adjustment piece 315 is arranged to be opposite the top surface of dielectric resonator body 310 or 320 has been described, the structure of support board 312 may be changed such that dielectric adjustment piece 315 may be arranged to be opposite the bottom surface of dielectric resonator body 310 or 320. In this case, if other conditions are identical, the same advantages as in the foregoing embodiments are obtained. Although in the foregoing embodiments, a case where dielectric adjustment piece 315 is formed to have a prismatic shape having a diameter smaller than dielectric resonator body 310 has been described, it is not intended to exclude the configuration in which dielectric adjustment piece 315 is formed to have other shapes. For example, dielectric adjustment piece 315 may be formed to have a shape which is obtained by combining polygonal sections. Although in the foregoing embodiments, a case where dielectric adjustment piece 315 is formed of the same dielectric material as dielectric resonator body 310 or 320 has been described, dielectric adjustment piece 315 may be formed of a dielectric material having a different relative dielectric constant from dielectric resonator body 310 or 320.

Although in the foregoing embodiments, a case where dielectric resonator body 310 or 320 is cut at cut surface 310*a*, 310*b*, 320*a*, or 320*b* has been described, the invention is not limited to such a cutting method. The arrangement or cutting method of cut surface 310*a*, 310*b*, 320*a*, or 320*b* of dielectric resonator body 310 or 320 may be freely changed insofar as the advantages of the invention are obtained. In this case, although in the foregoing embodiments, the structure in which dielectric resonator body 310 excites two resonance modes has been described, with the studies of the cutting method, more resonance modes may be excited, and a frequency characteristic having a plurality of peaks may be realized. Cut surface 310*a*, 310*b*, 320*a*, or 320*b* is an example of the lateral structure in which dielectric resonator body 310 or 320 excites two resonance modes, and a different lateral structure may be used.

Although in the foregoing embodiments, the configuration in which the frequency characteristic is adjusted by dielectric adjustment piece 315 has been described, a different frequency adjustment mechanism may be provided, in addition to dielectric adjustment piece 315. That is, the two frequencies FL and FH are changed in conjunction with each other by dielectric adjustment piece 315, but when the two frequencies need to be change individually, adjustment may be performed by using the frequency adjustment mechanism. For example, a frequency adjustment mechanism having metal beads at the positions opposite input terminal 313 and output terminal 314 (at the wall surface of conductor case 11 on the opposite side), or a frequency adjustment mechanism having a metal piece and a dielectric piece mounted at the front end of the bead may be provided. Such a frequency adjustment mechanism may be freely provided on the assumption that the advantages of the invention should be obtained.

Although the invention has been described in detail with reference to the specific embodiments, it is obvious to those skilled in the art that various changes or modifications may be made without departing from the spirit and scope of the invention.

This application claims priority of Japanese Patent Application No. 2007-242092, filed on Sep. 19, 2007, Japanese Patent Application No. 2007-242093, filed on Sep. 19, 2007, Japanese Patent Application No. 2007-242094, filed on Sep. 19, 2007, Japanese Patent Application No. 2007-265382, filed on Oct. 11, 2007, Japanese Patent Application No. 2008-227550, filed on Sep. 4, 2008, Japanese Patent Application No. 2008-227551, filed on Sep. 4, 2008, Japanese Patent Application No. 2008-227552, filed on Sep. 4, 2008, and Japanese Patent Application No. 2008-227644, filed on Sep. 4, 2008, the contents of which are incorporated herein by reference.

The invention claimed is:

1. A dielectric resonator comprising:

a cylindrical or polygonal external conductor;

a dielectric resonant element arranged at the substantially center of the external conductor; and an electrical signal input section and an electrical signal output section, wherein at least two notched portions are formed, the two notched portions are formed at opposing surfaces of the dielectric resonant element, and the dielectric resonant element has two sections parallel to each other and perpendicular to a height direction due to the two notched portions, wherein the at least two notched portions are formed by grinding the dielectric resonant element vertically along the height direction, and wherein the at least two notched portions are formed such that a coupling coefficient of a plurality of introduced EH mode electrical signals indicates a peak.

2. The dielectric resonator of claim 1, wherein the dielectric resonant element has a prism or plate shape having a circular, elliptical, or polygonal section.

3. A method of controlling a dielectric resonator including a cylindrical polygonal external conductor and a dielectric resonant element arranged at the substantially center of the external conductor, wherein at least two notched portions are formed, and the two notched portions are formed at opposing surfaces of the dielectric resonant element such that the dielectric resonant element has two sections parallel to each other and perpendicular to a height direction due to the two notched portions, wherein the at least two notched portions are formed by grinding the dielectric resonant element vertically along the height direction, and wherein the at least two notched portions are formed such that a coupling coefficient of a plurality of introduced EH mode electrical signals indicates a peak.

4. The method of claim 3, wherein the dielectric resonant element has a prism or plate shape having a circular, elliptical, or polygonal section.

* * * * *